US011529034B2

(12) United States Patent
Conrad

(10) Patent No.: US 11,529,034 B2
(45) Date of Patent: Dec. 20, 2022

(54) EVACUATION STATION FOR A MOBILE FLOOR CLEANING ROBOT

(71) Applicant: Omachron Intellectual Property Inc., Hampton (CA)

(72) Inventor: Wayne Ernest Conrad, Hampton (CA)

(73) Assignee: Omachron Intellectual Property Inca, Hampton (CA)

( * ) Notice: Subject to any disclaimer, the term of this patent is extended or adjusted under 35 U.S.C. 154(b) by 343 days.

(21) Appl. No.: 16/933,185

(22) Filed: Jul. 20, 2020

(65) Prior Publication Data

US 2022/0015593 A1 Jan. 20, 2022

(51) Int. Cl.

| | |
|---|---|
| ***A47L 9/14*** | (2006.01) |
| ***A47L 9/28*** | (2006.01) |
| ***A47L 9/12*** | (2006.01) |

(52) U.S. Cl.

CPC ..... *A47L 9/149* (2013.01); *A47L 9/12* (2013.01); *A47L 9/2873* (2013.01); *A47L 2201/022* (2013.01); *A47L 2201/024* (2013.01)

(58) Field of Classification Search

CPC ..... A47L 9/149; A47L 9/12; A47L 9/2873; A47L 2201/022; A47L 2201/024

See application file for complete search history.

(56) References Cited

U.S. PATENT DOCUMENTS

| | | | |
|---|---|---|---|
| 3,543,325 | A | 12/1970 | Hamrick |
| 5,135,552 | A | 8/1992 | Weistra |
| 5,787,545 | A | 8/1998 | Colens |
| 6,327,741 | B1 | 12/2001 | Reed |
| 6,389,329 | B1 | 5/2002 | Colens |
| 7,053,578 | B2 | 5/2006 | Diehl et al. |
| 7,247,181 | B2 | 7/2007 | Hansen et al. |
| 7,412,748 | B2 | 8/2008 | Lee et al. |
| 7,473,289 | B2 | 1/2009 | Oh et al. |
| 7,849,555 | B2 | 12/2010 | Hahm et al. |
| 7,861,366 | B2 | 1/2011 | Hahm et al. |
| 7,887,613 | B2 | 2/2011 | Ruben |
| 8,572,799 | B2 | 11/2013 | Won et al. |
| 8,635,739 | B2 | 1/2014 | Lee et al. |
| 8,695,159 | B2 | 4/2014 | Van Der Kooi et al. |

(Continued)

FOREIGN PATENT DOCUMENTS

| | | | |
|---|---|---|---|
| CA | 978485 | A | 11/1975 |
| CA | 2492737 | A1 | 11/2005 |

(Continued)

OTHER PUBLICATIONS

International Search Report and Written Opinion, received in connection to c-pending International Patent Application No. PCT/CA2021/050965, dated Oct. 12, 2021.

(Continued)

*Primary Examiner* — Andrew A Horton

(74) *Attorney, Agent, or Firm* — Philip C. Mendes da Costa; Bereskin & Parr LLP/S.E.N.C.R.L., s.r.l.

(57) ABSTRACT

An evacuation station for a mobile floor cleaning robot comprises a housing having a perimeter extending around the housing and an air treatment assembly. The air treatment assembly is moveable from an in use position in which the air treatment assembly is mounted to the housing and a removal positon in which all of the air treatment assembly is positioned outwardly of the perimeter.

20 Claims, 40 Drawing Sheets

(56) References Cited

U.S. PATENT DOCUMENTS

| | | | |
|---|---|---|---|
| 8,984,708 | B2 | 3/2015 | Kuhe et al. |
| 9,192,272 | B2 | 11/2015 | Ota |
| 9,462,920 | B1 | 10/2016 | Morin et al. |
| 9,492,048 | B2 | 11/2016 | Won et al. |
| 9,526,391 | B2 | 12/2016 | Lee et al. |
| 9,788,698 | B2 | 10/2017 | Morin et al. |
| 9,888,818 | B2 | 2/2018 | Kuhe et al. |
| 9,931,007 | B2 | 4/2018 | Morin et al. |
| 10,595,696 | B2 | 3/2020 | Harting et al. |
| 2013/0305481 | A1 | 11/2013 | Jung et al. |
| 2014/0059983 | A1 | 3/2014 | Ho |
| 2017/0196430 | A1 | 7/2017 | Machida et al. |
| 2018/0000302 | A1 | 1/2018 | Hyun et al. |
| 2018/0078107 | A1 | 3/2018 | Gagnon et al. |
| 2018/0199776 | A1* | 7/2018 | Sato ..... A47L 9/2884 |
| 2018/0228335 | A1 | 8/2018 | Miller |
| 2020/0122164 | A1 | 4/2020 | Conrad |
| 2020/0179953 | A1 | 6/2020 | Conrad |

FOREIGN PATENT DOCUMENTS

| | | | |
|---|---|---|---|
| CA | 2972252 | A1 | 6/2016 |
| CN | 1212095 | C | 7/2005 |
| EP | 1243218 | B1 | 5/2010 |
| EP | 1707094 | B1 | 4/2012 |
| EP | 3669733 | A1 | 6/2020 |
| GB | 539973 | A | 10/1941 |
| GB | 2467403 | A | 8/2010 |
| GB | 2522658 | B | 4/2016 |
| JP | 2003180587 | A | 7/2003 |
| KR | 1020070012109 | A | 1/2007 |

OTHER PUBLICATIONS

English machine translation of EP3669733, published on Jun. 24, 2020.

International Search Report and Written Opinion received in connection to co-pending international patent application No. PCT/CA2019/051431, dated Jan. 2, 2020.

English machine translation of KR1020070012109A, published on Jan. 25, 2007.

English machine translation of EP1243218B1, published on May 19, 2010.

English machine translation of JP2003180587A, published on Jul. 2, 2003.

English machine translation of CN1212095, published on Jul. 27, 2005.

* cited by examiner

EVACUATION STATION FOR A MOBILE FLOOR CLEANING ROBOT

FIELD

This disclosure relates generally to evacuation stations that receive and store dirt and/or debris from a mobile floor cleaning robot.

INTRODUCTION

The following is not an admission that anything discussed below is part of the prior art or part of the common general knowledge of a person skilled in the art.

Various types of evacuation stations for receiving dirt and/or debris from a mobile floor cleaning robot, which may also be referred to as an autonomous surface cleaning apparatus or a robotic surface cleaning apparatus or vacuum cleaner, are known. Evacuation stations may have a suction motor to draw dirt from a dirt storage chamber in a robotic vacuum cleaner and an air treatment assembly to remove entrained dirt from the air drawn into the evacuation station. Evacuation stations may also charge the mobile surface cleaning apparatus when the mobile surface cleaning apparatus is connected or docked to the evacuation station.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

In one aspect of this disclosure, which may be used by itself or with one or more of the other aspects disclosed herein, there is provided an evacuation station for receiving dirt and/or debris (hereinafter "dirt") from a mobile surface cleaning apparatus when the mobile surface cleaning apparatus has docked at the docking station. The docking station stores dirt that is transferred to the docking station from the mobile surface cleaning apparatus. The dirt may be transferred from the mobile surface cleaning apparatus to the docking station by any means known in the vacuum cleaner arts. For example, the docking station may have an air treatment assembly comprising, e.g., a suction motor, for drawing dirt from the mobile surface cleaning apparatus and, e.g., a cyclone or filter bag, for separating dirt and storing the dirt in the evacuation station. The docking station comprises a housing and an air treatment assembly that is removable from the housing to facilitate removal of the dirt and/or debris stored therein. The air treatment assembly, or at least the dirt storing portion of the air treatment assembly, is linearly removable (in a generally horizontal direction, e.g., sideways or rearwardly) from the housing of the evacuation station to enable the air treatment assembly to be emptied.

In accordance with the broad aspect, there is provided an evacuation station for a mobile floor cleaning robot, the evacuation station comprising:

(a) an air flow path extending from an evacuation station air inlet to an evacuation station air outlet;

(b) a housing having a perimeter extending around the housing; and, (c) an air treatment assembly comprising an air treatment member, wherein the air treatment assembly is removably mountable to the housing, the air treatment assembly is moveable from an in use position in which the air treatment assembly is mounted to the housing and a removal positon in which all of the air treatment assembly is positioned outwardly of the perimeter.

In any embodiment, the evacuation station air inlet may be provided in the housing and the evacuation station air inlet may be in fluid communication with an outlet port of the mobile floor cleaning robot when the mobile floor cleaning robot is docked with the evacuation station.

In any embodiment, a suction motor and the evacuation station air outlet may each be provided in the housing.

In any embodiment, the air treatment member may comprise a momentum air separator and a filter media downstream thereof and the filter media may be accessible when the air treatment assembly is removed from the housing.

In any embodiment, the momentum air separator may comprise a chamber having an air inlet wherein at least one wall of the chamber comprise a screen forming an air outlet of the chamber.

In any embodiment, the filter media may be housed in the removable air treatment assembly.

In any embodiment, the housing may have a front robot docking side, a rear side and two laterally opposed ends and the air treatment assembly may have a front side, a rear side and two laterally opposed ends and the filter media may be provided at one of the laterally opposed ends.

In any embodiment, the housing may have a front robot docking side, a rear side and two laterally opposed ends and the air treatment assembly may translate laterally to the removal position.

In any embodiment, the housing may have a front robot docking side, a rear side and two laterally opposed ends and the air treatment assembly may translate rearwardly to the removal position.

In any embodiment, the evacuation station may further comprise a translation member which is operable to translate the air treatment assembly to the removal position.

In any embodiment, the evacuation station may further comprise a locking assembly which locks the air treatment assembly in the in use position and the locking assembly may comprise the translation member.

In any embodiment, the locking assembly may comprise male and female alignment members.

In any embodiment, the male alignment member may comprise a key and the female alignment member may comprise a slot that removably receives the key.

In any embodiment, the evacuation station may further comprise male and female alignment members.

In any embodiment, the male alignment member may comprise a key and the female alignment member may comprise a slot that removably receives the key.

In any embodiment, the evacuation station may further comprising a handle moveable between a storage position and a removal position wherein, in the storage position, the handle extends generally laterally and, in the removal position, the handle extends generally vertically.

In accordance with this broad aspect, there is also provided an evacuation station for a mobile floor cleaning robot comprising, the evacuation station comprising:

(a) an air flow path extending from an evacuation station air inlet to an evacuation station air outlet;

(b) a housing having a perimeter extending around the housing; and, (c) an air treatment assembly comprising an air treatment member, wherein the air treatment assembly is removably mountable to the housing, wherein one of the housing and the air treatment member has a male alignment member and the other of the housing and the air treatment member has a female alignment member.

In any embodiment, the male alignment member may comprise a key and the female alignment member may comprise a slot that removably receives the key.

In any embodiment, the air treatment assembly may be moveable from an in use position in which the air treatment assembly is mounted to the housing and a removal positon and the evacuation station may further comprise a translation member which is operable to translate the air treatment assembly to the removal position.

In any embodiment, the evacuation station may further comprise a locking assembly which locks the air treatment assembly in the in use position and the locking assembly may comprise the translation member.

In another aspect of this disclosure, which may be used by itself or with one or more of the other aspects disclosed herein, there is provided a low profile docking station. According to this aspect, the docking station may be arranged with some or all of the operating components (e.g., the dirt separation member such as a cyclone, a pre-motor filter, a suction motor and a post motor filter) arranged linearly (e.g., one beside the other). An advantage of this design is that the height of the docking station may be limited and therefore, the docking station may be less obtrusive when positioned in a room of a dwelling.

In accordance with this aspect, there is provided an evacuation station for a mobile floor cleaning robot, the evacuation station having a front robot docking side, a rear side and first and second opposed evacuation station ends that are spaced apart in a lateral direction, the evacuation station comprising:

(a) an air flow path extending from an evacuation station air inlet to an evacuation station air outlet;

(b) a housing having the evacuation station air inlet, the evacuation station air outlet, first and second opposed housing ends that are spaced apart in a lateral direction, wherein a housing air inlet is provided on the first lateral housing end; and, (c) an air treatment assembly comprising an air treatment member, the air treatment assembly having an air treatment assembly air inlet and an air treatment assembly air outlet, wherein the air treatment assembly is provided on the first lateral housing end whereby the air treatment member air outlet faces the housing air inlet, and wherein the air treatment assembly is removably mountable to the housing, and wherein the evacuation station air inlet is in fluid communication with an outlet port of the mobile floor cleaning robot when the mobile floor cleaning robot is docked with the evacuation station.

In any embodiment, the evacuation station may have a lateral length between the first and second opposed evacuation station ends and the evacuation station air inlet may be positioned at about a midpoint of the lateral length of the evacuation station.

In any embodiment, the air treatment member may comprise a chamber having a chamber air inlet wherein a first wall of the chamber may comprise a screen forming an air outlet of the chamber.

In any embodiment, the air flow path may comprise an upstream air flow path portion that extends from the evacuation station air inlet to the air treatment member and includes the chamber air inlet and the upstream portion of the air flow path extends through the first wall.

In any embodiment, the first wall may extend laterally and may be located at a front robot docking side of the chamber.

In any embodiment, the evacuation station may have a height which is proximate the height of the mobile floor cleaning robot.

In accordance with this aspect, there is also provided an evacuation station for a mobile floor cleaning robot, the evacuation station having a front robot docking side, a rear side and first and second opposed evacuation station ends that are spaced apart in a lateral direction, the evacuation station comprising:

(a) an air flow path extending from an evacuation station air inlet to an evacuation station air outlet;

(b) a suction motor provided in the air flow path, the suction motor having an inlet end and an axially opposed end;

(c) a housing having first and second opposed housing ends that are spaced apart in a lateral direction; and, (d) an air treatment assembly comprising an air treatment member, the air treatment member having an air inlet and an air outlet, wherein the suction motor has a suction motor axis of rotation which extends generally laterally and the air treatment member is provided on one lateral side of the suction motor whereby the air treatment member air outlet faces the inlet end of the suction motor.

In any embodiment, the air treatment assembly may be removably mountable to the first opposed housing end.

In any embodiment, the evacuation station may further comprise a pre-motor filter media and the pre-motor filter may be provided at the first opposed housing end.

In any embodiment, the pre-motor filter media may be housed in the air treatment assembly.

In any embodiment, the evacuation station may further comprise a pre-motor filter media, wherein the air treatment assembly has first and second laterally opposed ends, the first end of the air treatment assembly may be an openable end of the air treatment member and the pre-motor filter media is housed at the second end of the air treatment assembly.

In any embodiment, the air treatment member may comprise a chamber having an air inlet wherein an outer wall of the chamber may comprise a screen forming an air outlet of the chamber and opening the first end of the air treatment assembly opens the air treatment member.

In any embodiment, the outer wall may extend laterally and may be located at a front robot docking side of the chamber and a laterally extending air flow path may be located between the outer wall and the front robot docking side of the evacuation station and opening the first end of the air treatment assembly opens the laterally extending air flow path.

In any embodiment, the evacuation station air inlet may be provided in the housing and the evacuation station air inlet may be in fluid communication with an outlet port of the mobile floor cleaning robot when the mobile floor cleaning robot is docked with the evacuation station.

In any embodiment, the evacuation station air inlet may be positioned at about a midpoint of the lateral length of the evacuation station.

In any embodiment, the air treatment member may comprise a chamber having a chamber air inlet wherein a first wall of the chamber may comprise a screen forming an air outlet of the chamber and the chamber air inlet may be positioned at about a midpoint of the lateral length of the evacuation station.

In any embodiment, the air treatment member may comprise a chamber having a chamber air inlet, a first wall of the chamber may comprise a screen forming an air outlet of the chamber, and the air flow path may comprise an upstream air flow path portion that extends from the evacuation station air inlet to the air treatment member and includes the chamber air inlet, and the upstream portion of the air flow path extends through the first wall.

In any embodiment, the first wall may extend laterally and may be located at a front robot docking side of the chamber.

In any embodiment, the evacuation station may further comprise a post-motor filter provided at the axially opposed end of the suction motor.

In any embodiment, the evacuation station air outlet may be provided at the axially opposed end of the suction motor.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
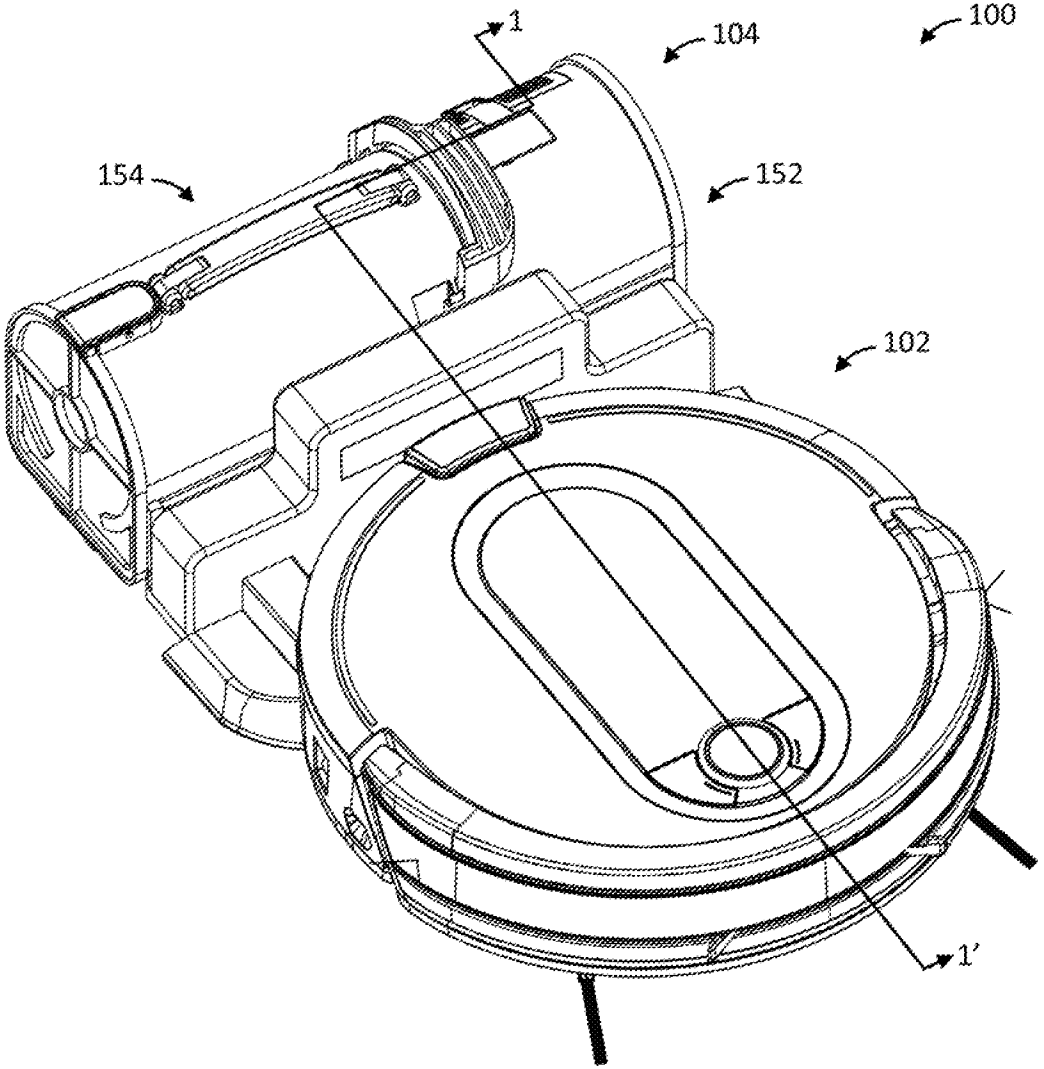
FIG. 1 is a perspective view of an evacuation station for a mobile floor cleaning robot and a mobile floor cleaning robot, wherein the mobile floor cleaning robot is docked with the evacuation station.
Figure 2:
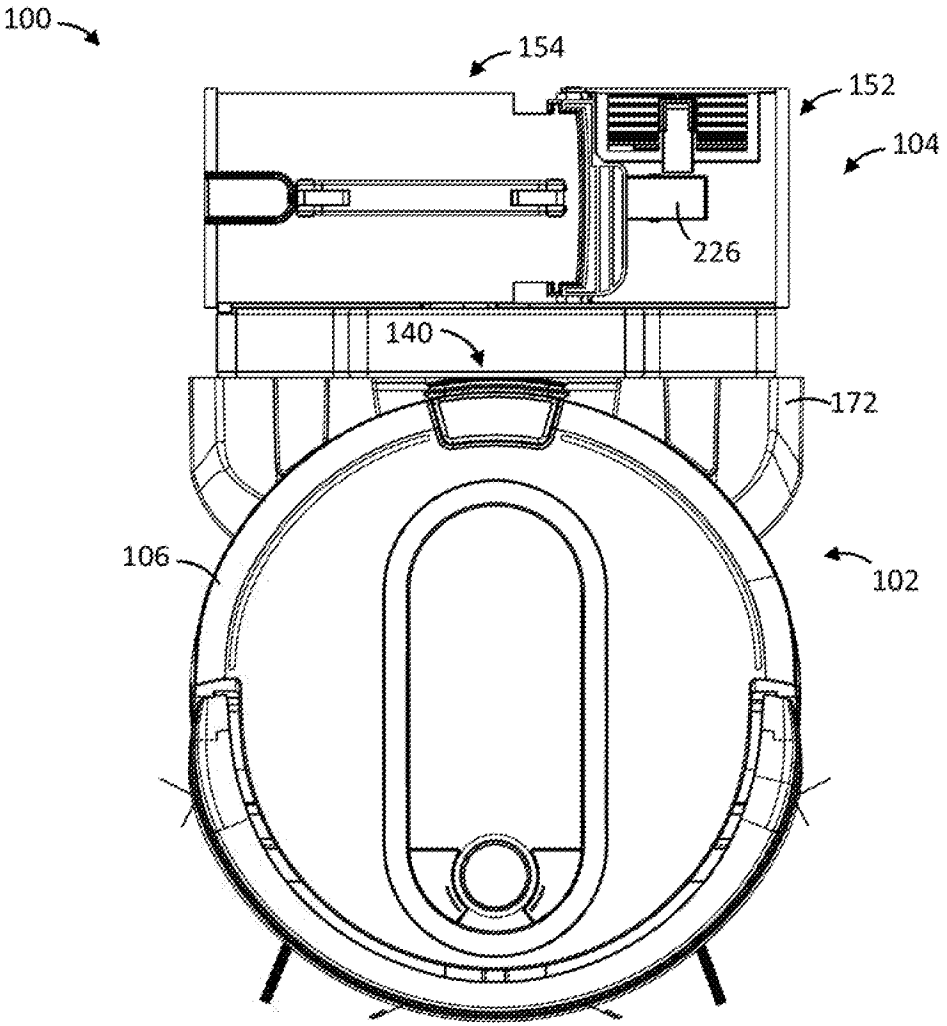
FIG. 2 is a top view of the evacuation station and the mobile floor cleaning robot of FIG. 1.

The drawings included herewith are for illustrating various examples of articles, methods, and apparatuses of the teaching of the present specification and are not intended to limit the scope of what is taught in any way.

DESCRIPTION OF VARIOUS EMBODIMENTS

Various apparatuses will be described below to provide an example of an embodiment of each claimed invention. No embodiment described below limits any claimed invention and any claimed invention may cover apparatuses that differ from those described below. The claimed inventions are not limited to apparatuses having all of the features of any one apparatus described below or to features common to multiple or all of the apparatuses described below. It is possible that an apparatus described below is not an embodiment of any claimed invention. Any invention disclosed in an apparatus described below that is not claimed in this document may be the subject matter of another protective instrument, for example, a continuing patent application, and the applicants, inventors or owners do not intend to abandon, disclaim or dedicate to the public any such invention by its disclosure in this document.

The terms "an embodiment", "embodiment", "embodiments", "the embodiment", "the embodiments", "one or more embodiments", "some embodiments", and "one embodiment" mean "one or more (but not all) embodiments of the present invention(s)," unless expressly specified otherwise.

The terms "including", "comprising", and variations thereof mean "including but not limited to", unless expressly specified otherwise. A listing of items does not imply that any or all of the items are mutually exclusive, unless expressly specified otherwise. The terms "a", "an", and "the" mean "one or more", unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

Some elements herein may be identified by a part number, which is composed of a base number followed by an alphabetical or subscript-numerical suffix (e.g. 112*a*, or $\mathbf{112}_1$). Multiple elements herein may be identified by part numbers that share a base number in common and that differ by their suffixes (e.g. $\mathbf{112}_1$, $\mathbf{112}_2$, and $\mathbf{112}_3$). All elements with a common base number may be referred to collectively or generically using the base number without a suffix (e.g. 112).

General Description of an Evacuation Station and a Mobile Floor Cleaning Robot In the course of cleaning, and during periods of inactivity, a mobile floor cleaning robot 102 may, at times, dock (or connect) to an evacuation station 104 (together referred to herein as a system 100) (see, for e.g., FIG. 1). When docked, dust, dirt, and/or debris (collectively referred to herein as "dirt"), collected by the mobile floor cleaning robot 102, may be transferred from the mobile floor cleaning robot 102 to the evacuation station 104. Dirt may be transferred by any method known in the vacuum cleaner arts. By transferring dirt from the mobile floor cleaning robot 102 to the evacuation station 104, a user of the system 100 may only be required to empty (i.e., clean-out) the evacuation station 104. That is, a user of the system 100 may not be required to empty the mobile floor cleaning robot 102, itself. Further, since the evacuation station 104 may hold a greater volume of dirt compared to that of the mobile floor cleaning robot 102, by only cleaning out the evacuation station 104, a user of the system 100 may be required to attend to the system 100 less often than if they had to clean out the mobile floor cleaning robot 102.

Optionally, the evacuation station 104 can also be used to re-charge a battery of the mobile floor cleaning robot 102 during docking.

General Description of a Mobile Floor Cleaning Robot

Mobile floor cleaning robots 102 may be of any shape and configuration and may use any dirt collection member(s) known in the vacuum cleaner arts. For example, mobile floor cleaning robots 102 may be disc shaped, box shaped, or ball shaped. The shape of the mobile floor cleaning robot 102 may be defined by a housing 106 of the mobile floor cleaning robot 102. Mobile floor cleaning robots 102 typically include wheels 108 for transporting the mobile floor cleaning robot 102 across a surface to be cleaned. Mobile floor cleaning robots 102 also typically include a battery, sensors, controls, and motors for autonomously steering and driving the mobile floor cleaning robot 102. It will be appreciated that the mobile floor cleaning robot 102 used with the evacuation station 104 disclosed herein may be of any design.

FIGS. 1-5 exemplify a mobile floor cleaning robot 102. As shown, the mobile floor cleaning robot 102 has a generally disc shaped configuration defined by a housing 106. As shown, the housing 106 has an upper end 110, a lower end 112, and a peripheral side edge 114 extending between the upper and lower ends 110, 112. A portion of the peripheral side edge 114 may define a front end 118 of the housing 106 and another portion of the peripheral side edge 114 may define a rear end 120 of the housing 106, i.e., a front end 122 and a rear end 124 of the mobile floor cleaning robot 102 (see FIG. 3).

In the example illustrated, the mobile floor cleaning robot 102 includes three wheels 108 at the lower end 112 of the housing 106. As shown, a subset of the wheels 108 may be powered wheels 128, and the remaining wheels 108 may be for support (i.e., to inhibit tipping of the mobile floor cleaning robot). In the example illustrated, the mobile floor cleaning robot 102 includes two powered wheels 128 and a caster wheel 130. As shown, the two powered wheels 128 may be positioned proximate to a center 132 (i.e., between the front end 118 and the rear end 120 of the housing 106) near the peripheral side edge 114 of the mobile floor cleaning robot 102, and the caster wheel 130 may be located proximate to the peripheral side edge 114 in the rear end 124 of the mobile floor cleaning robot 102. It will be appreciated that, in other embodiments, the mobile floor cleaning robot 102 may have any number of driven and non-driven wheels 128, 130, which may be located at any position on the housing 106 so long as they facilitate movement of the mobile floor cleaning robot 102 across a surface to be cleaned.

In order to transfer dirt to the evacuation station 104, the mobile floor cleaning robot 102 is provided with a dirt outlet port 140. The dirt outlet port 140 may be removably couplable to an evacuation station air inlet 142 by any method known in the vacuum cleaner arts to facilitate transfer of dirt from the mobile floor cleaning robot 102 to the evacuation station 104 (this process is described in more detail below). The dirt outlet port 140 may be located at any location around the housing 106 of the mobile floor cleaning robot 102, for example at the front end 118, the rear end 120, the upper end 110, or the lower end 112. In the example illustrated, the dirt outlet port 140 is provided at the front end 118 of the housing 106. Further, the mobile floor cleaning robot 102 may include more than one dirt outlet ports 140.

Figure 5:
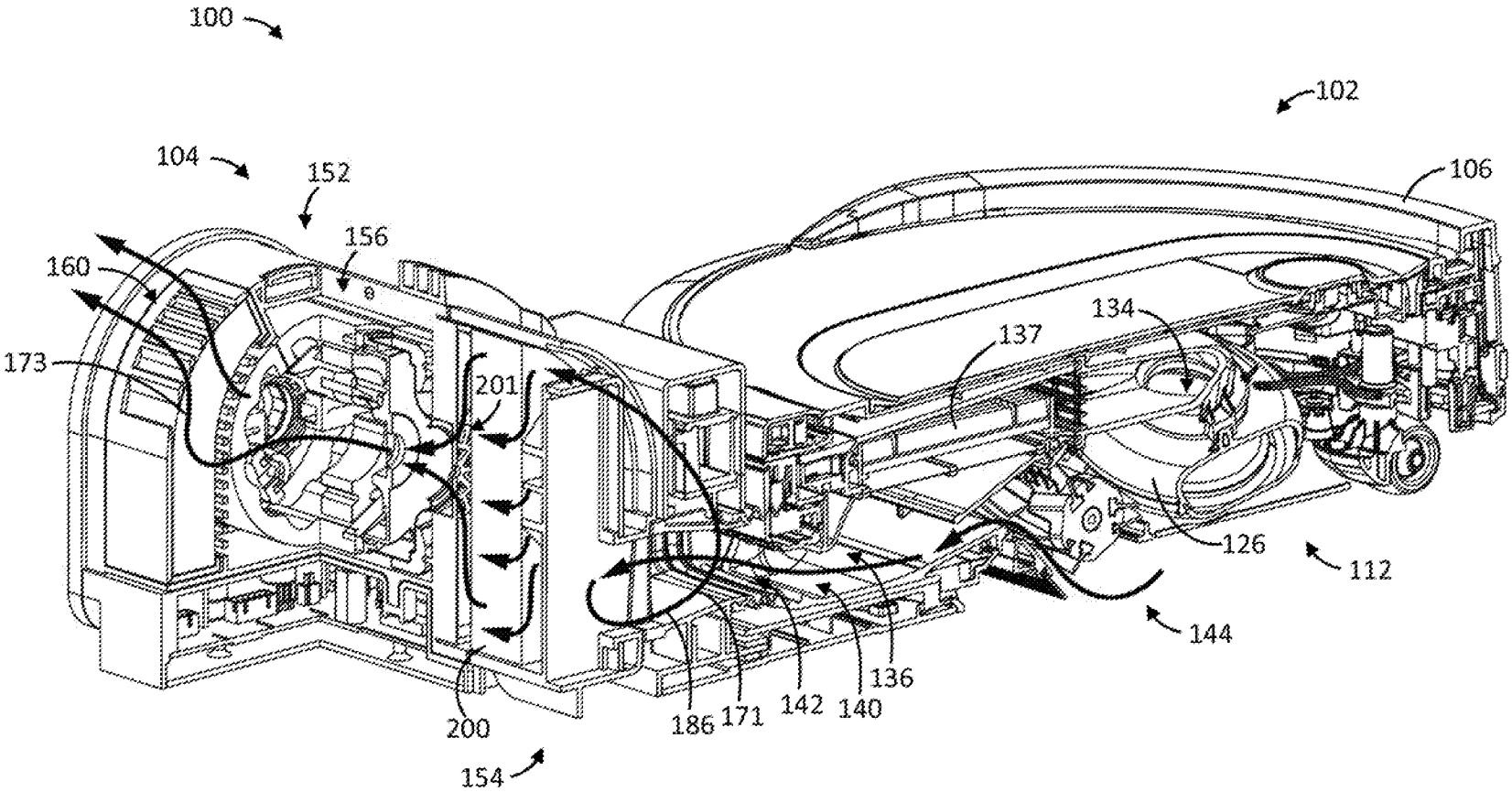
FIG. 5 is a cross-sectional view of the evacuation station and the mobile floor cleaning robot of FIG. 1, taken along section line 1-1'.

The dirt outlet port 140 may be in fluid communication with a dirt bin (or bins) 136 located inside of the housing 106 (see for example FIG. 5). The dirt bin(s) 136 may temporarily store dirt within the mobile floor cleaning robot 102. That is, the dirt bin(s) 136 may store dirt within the mobile floor cleaning robot 102 until that dirt is transferred to the evacuation station 104.

Figure 4:
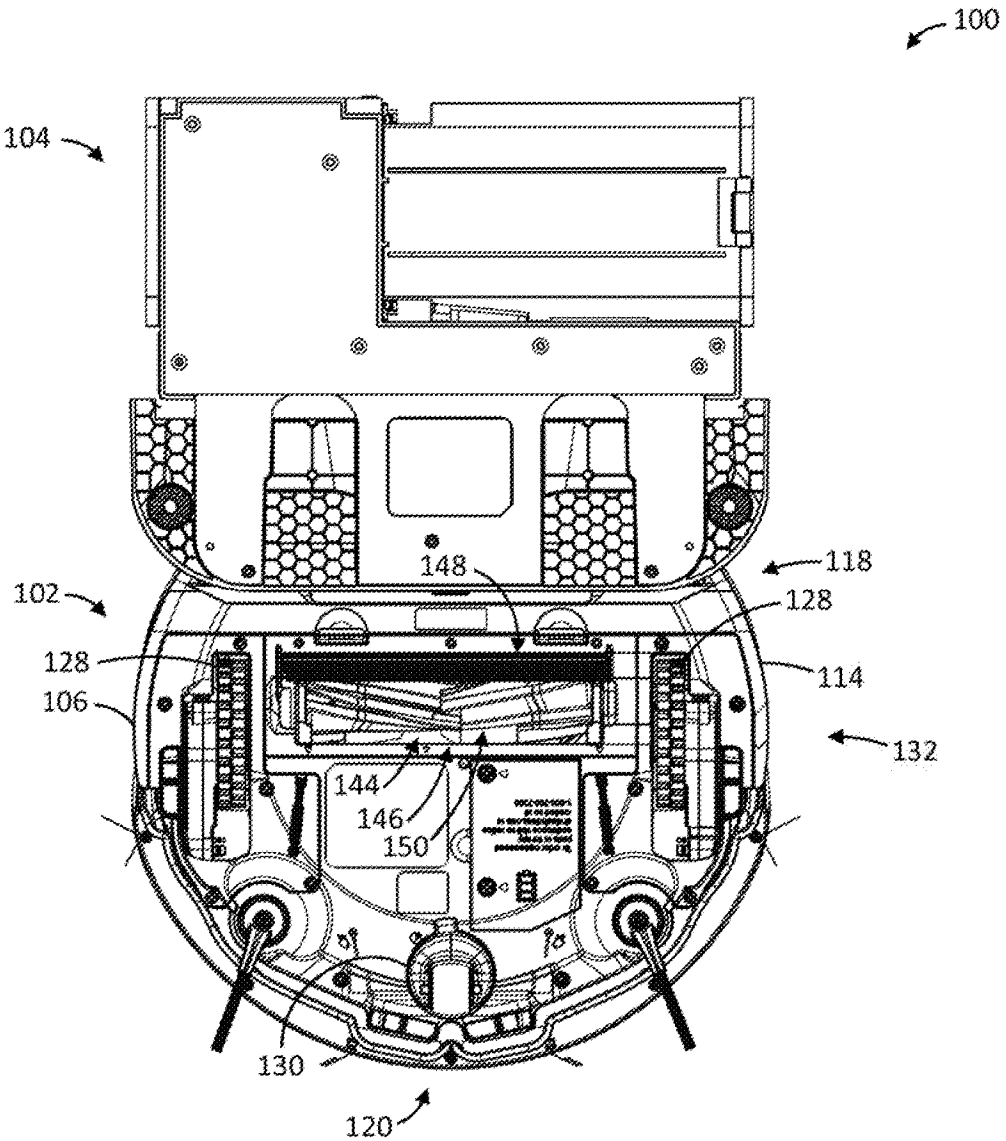
FIG. 4 is a bottom view of the evacuation station and the mobile floor cleaning robot of FIG. 1.

The mobile floor cleaning robot 102 may also include a dirt inlet 144. The dirt inlet 144 may be in fluid communication with the dirt bin(s) 136 inside of the housing 106. When in use, dirt on a surface to be cleaned may pass through the dirt inlet 144 to the dirt bin(s) 136. Referring to FIGS. 4 and 5, in the example illustrated, the dirt inlet 144 is located in the lower end 112 of the mobile floor cleaning robot 102. Specifically, in the example illustrated, the dirt inlet 144 is located proximate to an absolute center 146 of the lower end 112 of the mobile floor cleaning robot 102. In other embodiments, the dirt inlet 144 may be located in the lower end 112 of the mobile floor cleaning robot 102 proximate to the peripheral side edge 114, for example near the front end 118 or the rear end 120.

The mobile floor cleaning robot 102 may also be provided with any floor cleaning member known in the vacuum cleaner arts. For example, a sweeper 148 can be located on the lower end 112 of the mobile floor cleaning robot 102, and can be used for sweeping dirt from a surface during a cleaning operation. As exemplified, the sweeper 148 may comprise one or more rotating brushes 150 which, by itself using a mechanical sweeping action or in combination with an air flow, may convey dirt through the dirt inlet 144 to the dirt bin(s) 136.

Figure 3:
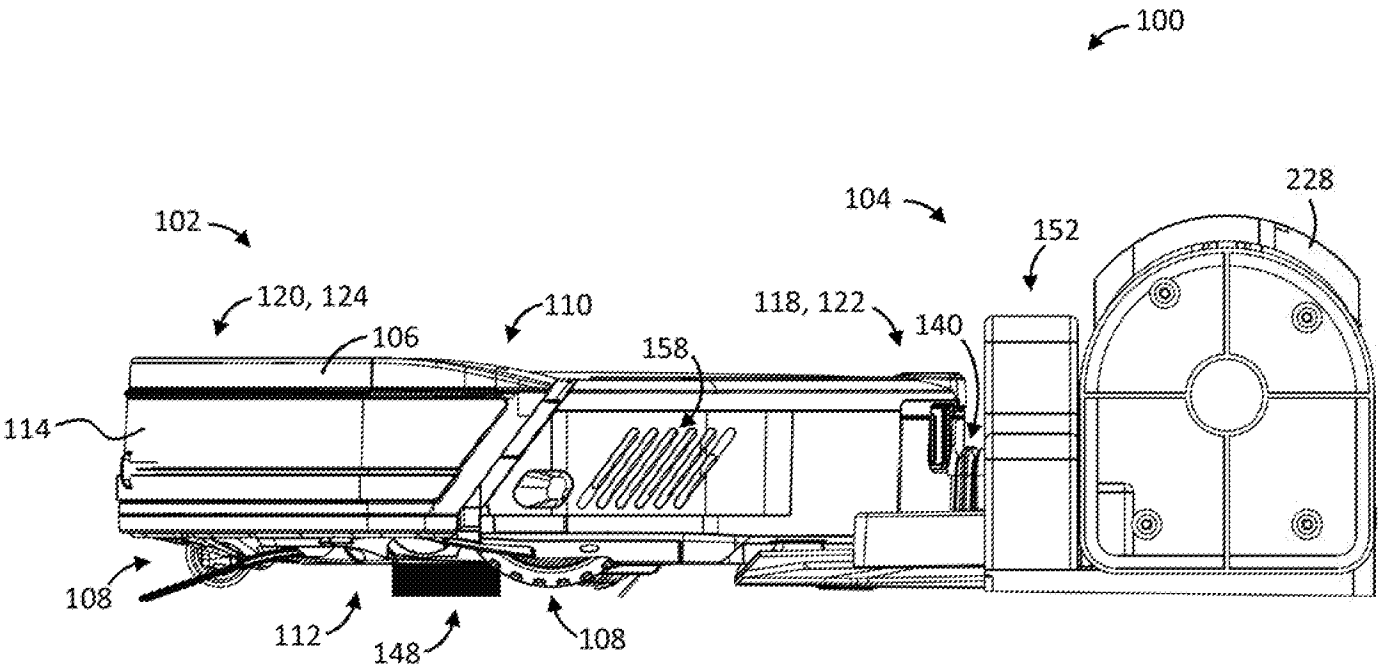
FIG. 3 is a side view of the evacuation station and the mobile floor cleaning robot of FIG. 1.

In various embodiments, in addition to a sweeper 148, the mobile floor cleaning robot 102 may also include a suction motor 134 to draw, or assist in drawing, dirt into the dirt bin(s) 136. The suction motor 134 may be positioned downstream of the dirt bin(s) 136, and may be located inside of a motor housing 126. The suction motor 134 can be, for example, a fan-motor assembly including an electric motor and impeller blade(s). If a suction motor 134 is provided, then a clean air outlet 158 may also be provided. Accordingly, a mobile floor cleaning robot air flow path may extend from the dirt inlet 144, through the dirt bin(s) 136, through the suction motor 134, and to the clean air outlet 158. Referring to FIG. 3, in the example illustrated, the clean air outlet 158 is located at the peripheral side edge 114 of the housing 106, but may alternately be provided at other locations around the housing 106 (i.e., at the upper end 110 or at the lower end 112).

Within the mobile floor cleaning robot 102, any dirt separation member known in the vacuum cleaner arts may be used. For example, the dirt bin(s) 136 may be container into which dirt is swept. Alternately, if a suction motor 134 is provided, then one or more separation members may be provided to separate dirt entrained in an air stream entering the dirt inlet 144. For example, one or more cyclones may be used.

In addition, if a suction motor 134 is provided, then one or more pre-motor filters 137 may be provided in the mobile floor cleaning robot air flow path, upstream of the suction motor 134. Pre-motor filters 137 can be formed from any suitable physical, or porous filter media. For example, pre-motor filters 137 may be one or more of a foam filter, a felt filter, a HEPA filter, or other physical filter media. In some embodiments, pre-motor filters 137 may include an electrostatic filter, or the like.

During operation of the mobile floor cleaning robot 102, the suction motor 134 may be activated to drive air flow, along the mobile floor cleaning robot air flow path, such that air is drawn through the dirt inlet 144, and into the dirt bin(s) 136. The air flow may continue through an air outlet of the dirt bin(s) 136, and downstream through an air passage to the suction motor 134. Air exiting the suction motor 134 may continue through a second air passage, and exit the mobile floor cleaning robot 102 via the clean air outlet 158.

General Description of an Evacuation Station

The evacuation station 104 may be of any shape and configuration and may use any dirt collection member(s) known in the vacuum cleaner arts to receive and retain dirt collected by the mobile floor cleaning robot 102. Accordingly, the evacuation station 104 may include a housing 152 and an air treatment assembly 154. The housing 152 of the evacuation station 104 may facilitate docking of the mobile floor cleaning robot 102. That is, the housing 152 may include components that are used when dirt is transferred from the mobile floor cleaning robot 102 to the evacuation station 104, such as the evacuation station air inlet 142. The housing 152 may also include electrical connections 138 for charging the mobile floor cleaning robot 102, when the mobile floor cleaning robot 102 is docked. The air treatment assembly 154 of the evacuation station 104 receives and stores the dirt collected by the mobile floor cleaning robot 102.

Dirt may be transferred from the mobile floor cleaning robot 102 to the evacuation station 104 mechanically, pneumatically, or both. For example, the mobile floor cleaning robot 102 may include a blowing device to blow dirt from within mobile floor cleaning robot 102 (i.e., from within the dirt bin(s) 136), through the dirt outlet port 140, and into the evacuation station air inlet 142. Alternatively, the evacuation station 104 may include a suction motor 156 that can draw the dirt out from the mobile floor cleaning robot 102, through the dirt outlet port 140, and into the evacuation station air inlet 142. Further, in some embodiments, the evacuation station 104 may have a suction motor 156 and the mobile floor cleaning robot 102 may have a blowing device.

The suction motor 156 and/or the blowing device may be, for example, a fan-motor assembly including an electric motor and impeller blade(s).

In embodiments of the evacuation station 104 that include a suction motor 156, the suction motor 156 can be located in the housing 152 or in the air treatment assembly 154.

In embodiments of the evacuation station 104 that include a suction motor 156, when in use, the suction motor 156 may generate an air flow along an air flow path 186 that extends from the evacuation station air inlet 142 to an evacuation station air outlet 160. In some embodiments, when the mobile floor cleaning robot 102 is docked, the air flow path 186 may extend to the dirt bin(s) 136 within the mobile floor cleaning robot 102 to draw dirt therefrom to the evacuation station 104. Optionally, the air flow path 186 may extend to the dirt inlet 144 of the mobile floor cleaning robot 102 (see for example, FIG. 5).

Alternatively, or in addition to the suction motor 156 and/or the blowing device, at least one of the mobile floor cleaning robot 102 and the evacuation station 104 may include a mechanical dirt transfer mechanism (not shown). See for example U.S. patent application Ser. No. 16/926,279, the disclosure of which is incorporated herein in its entirety. A mechanical dirt transfer mechanism may comprise, for example, a member (for example a ram) which physically engages and moves dirt from the mobile floor cleaning robot dirt bin(s) 136 towards and/or into the evacuation station air inlet 142. In some examples, the mechanical dirt transfer mechanism is located in the mobile floor cleaning robot 102 and pushes the dirt; in other examples, the mechanical dirt transfer mechanism is located in the evacuation station 104 and pulls the dirt; and in other examples, each of the mobile floor cleaning robot 102 and the evacuation station 104 include a mechanical dirt transfer mechanism.

Figure 13:
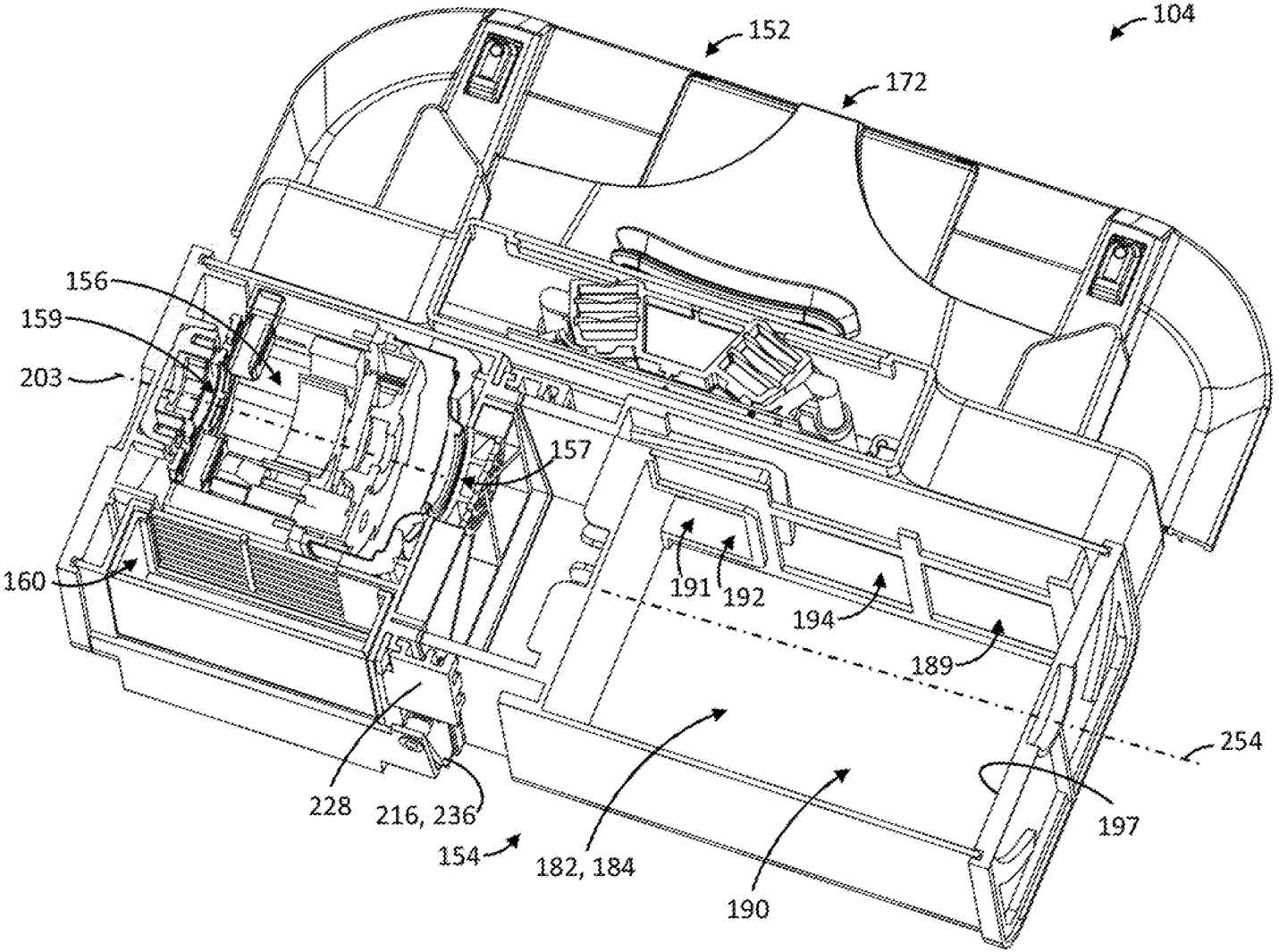
FIG. 13 is a cross-sectional view of the evacuation station of FIG. 12, taken along the section line 2-2'.
Figure 14:
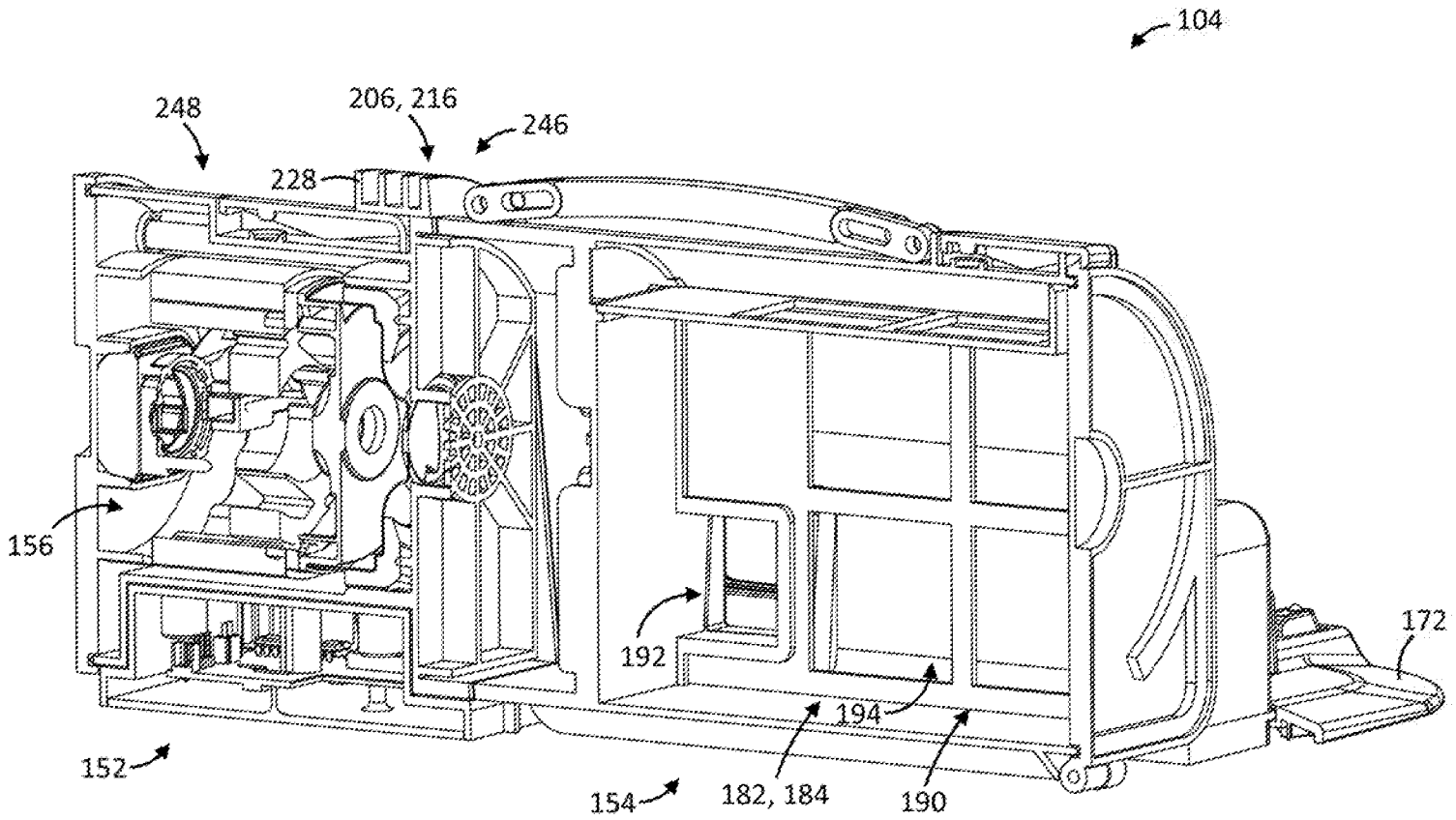
FIG. 14 is a cross-sectional view of the evacuation station of FIG. 12, taken along the section line 3-3'.
Figure 15:
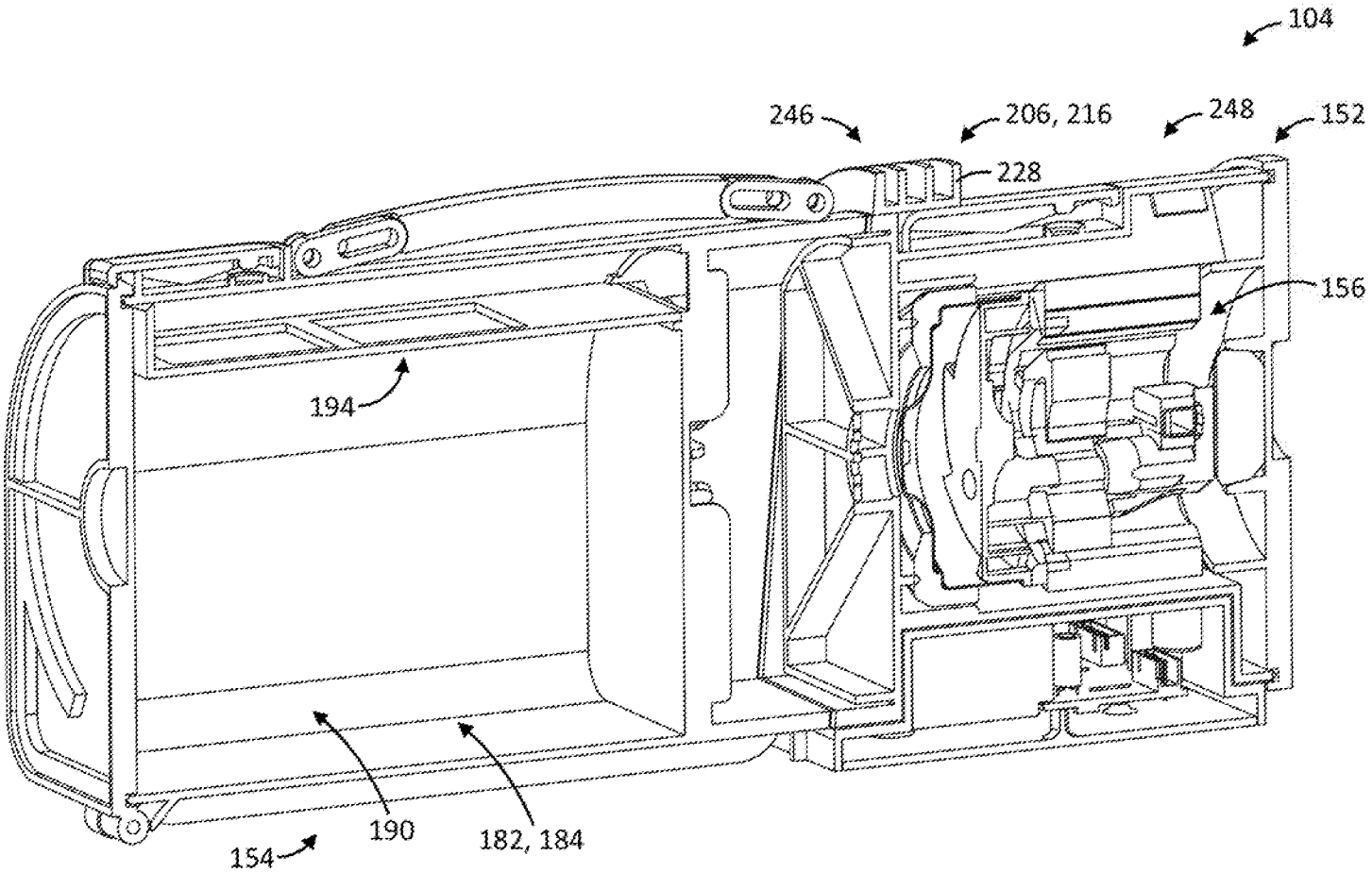
FIG. 15 is a cross-sectional view of the evacuation station of FIG. 12, taken along the section line 4-4'.

Referring now to FIG. 13, in the example illustrated, the evacuation station 104 includes a suction motor 156 located in the housing 152. In the example illustrated, the evacuation station air outlet 160 is a clean air outlet located in the housing 152 of the evacuation station 104. In an alternative embodiment, wherein the suction motor 156 is located in the air treatment assembly 154, the evacuation station air outlet 160 may be located in the air treatment assembly 154 or in the housing 152.

As discussed subsequently, in one aspect of this disclosure, the air treatment assembly 154 or at least a dirt container of the air treatment assembly may be removably mounted to the housing 152 to allow a user of the system 100 to dispose of the dirt stored therein.

The Housing of the Evacuation Station

The housing 152 of the evacuation station 104 may be of any shape and configuration and includes a perimeter 162 that extends thereabout. More specifically, the perimeter 162 of the housing 152 is a projection of an outline of the housing 152 onto a plane that is parallel to the surface on which the housing 152 may rest (i.e., a plane parallel to the surface to be cleaned). Put another way, the perimeter 162 of the housing 152 is the outline of the housing 152 when looking directly down at the housing 152 from above and the housing is positioned on a floor in the in use orientation (see for example FIG. 10).

The housing 152 has a front robot docking side 164, a rear side 166, and two laterally opposed ends 168, 170, which together define at least a portion of the perimeter 162 of the housing 152. In the example illustrated in FIG. 10, the housing 152 has an "L" shaped perimeter 162. In other embodiments, the components of the housing 152 may be arranged to form a different shaped perimeter 162, e.g., ovoid, etc.

In some examples, the housing 152 may include a platform 172 that extends outwardly from the front robot docking side 164 of the housing 152. The platform 172 may help position (i.e., may guide) the mobile floor cleaning robot 102 during the docking process. Alternately, or in addition, the platform 172 may comprise a matt which provides a surface that is at a predetermined vertical spacing with respect to the evacuation station air inlet 142 so as to ensure that the dirt outlet port 140 of the mobile floor cleaning robot 102 aligns with the evacuation station air inlet 142 when the mobile floor cleaning robot 102 is docked at the evacuation station 104. The platform 172 may also include electrical connections 138 that may engage with the mobile floor cleaning robot 102, to charge the mobile floor cleaning robot 102, while docked. Since the platform 172 is an extension of the housing 152, as shown in FIG. 10, it may form a portion of the perimeter 162 of the housing 152.

As stated above, the evacuation station 104 includes an evacuation station air inlet 142. The evacuation station 104 can receive dirt from the docked mobile floor cleaning robot 102 via the evacuation station air inlet 142. That is, the evacuation station air inlet 142 may be provided in the housing 152 and may be in fluid communication with the dirt outlet port 140 of the mobile floor cleaning robot 102 when the mobile floor cleaning robot 102 is docked. The evacuation station air inlet 142 may be located at any position on the evacuation station 104, so long as it facilitates transport of dirt from the mobile floor cleaning robot 102 to the evacuation station 104.

Figure 10:
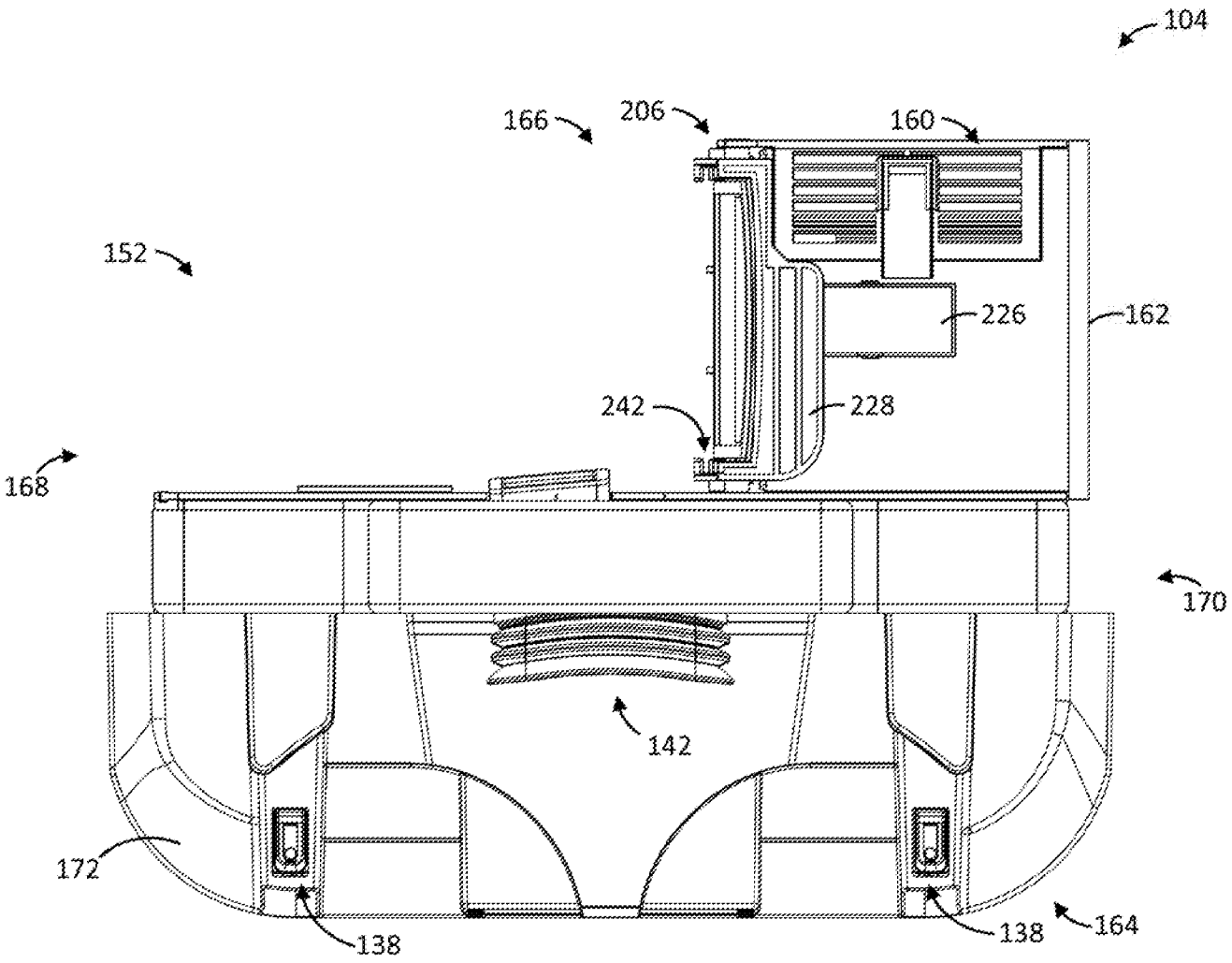
FIG. 10 is a top view of the housing of the evacuation station of FIG. 1.

Referring to FIG. 10, in the example illustrated, the evacuation station air inlet 142 is located on the front robot docking side 164 of the evacuation station 104 and is also generally centrally positioned between the two laterally opposed ends 168, 170. In other embodiments, the evacuation station air inlet 142 may be otherwise located. For example, if the dirt outlet port 140 of the mobile floor cleaning robot 102 is located on the lower end 112 thereof, the evacuation station air inlet 142 may be located in the platform 172, so that that the evacuation station air inlet 142 may be aligned with the dirt outlet port 140 when the mobile floor cleaning robot 102 is docked.

The Air Treatment Assembly of the Evacuation Station

Figure 11:
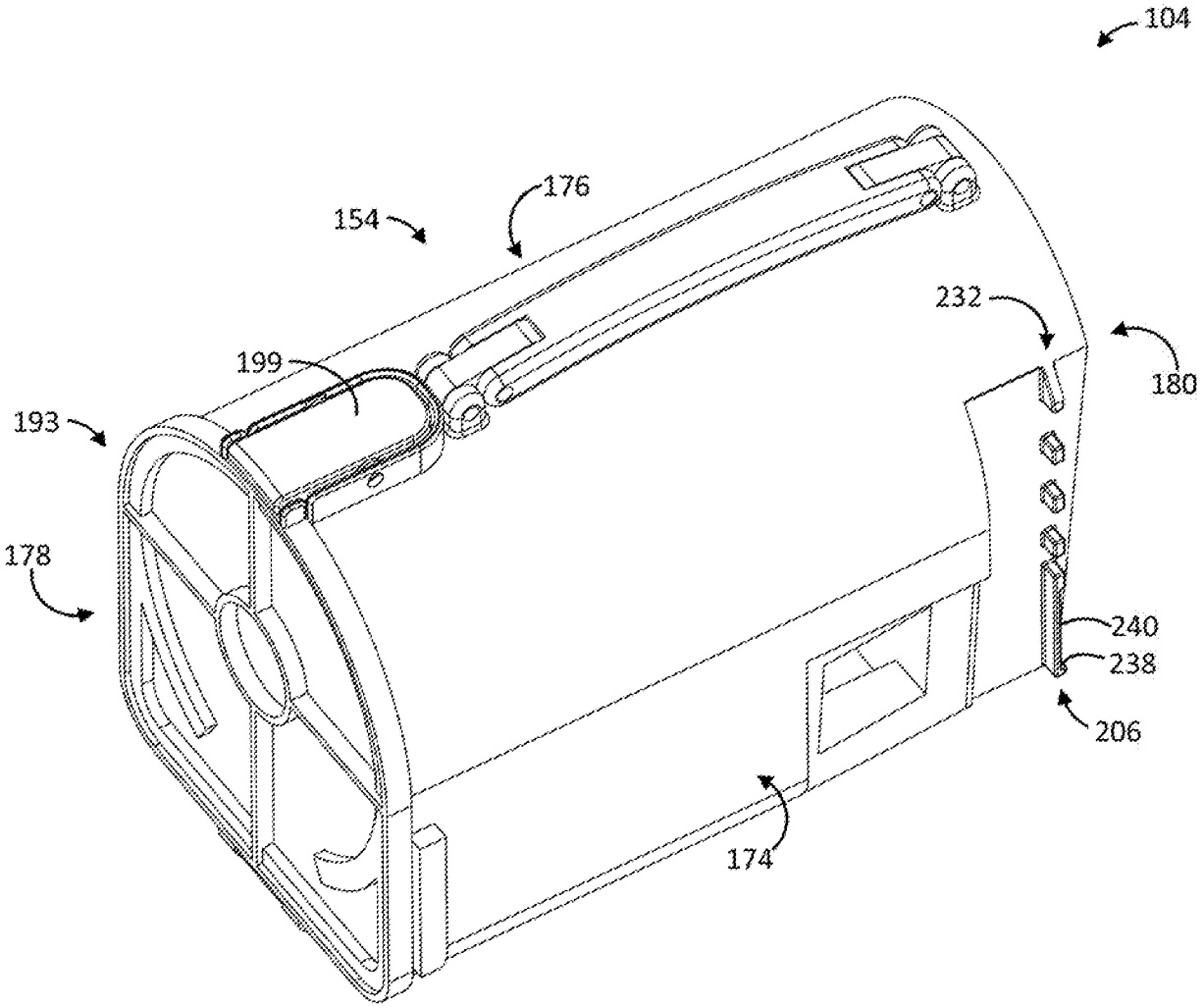
FIG. 11 is a perspective view of the air treatment assembly of the evacuation station of FIG. 1.
Figure 12:
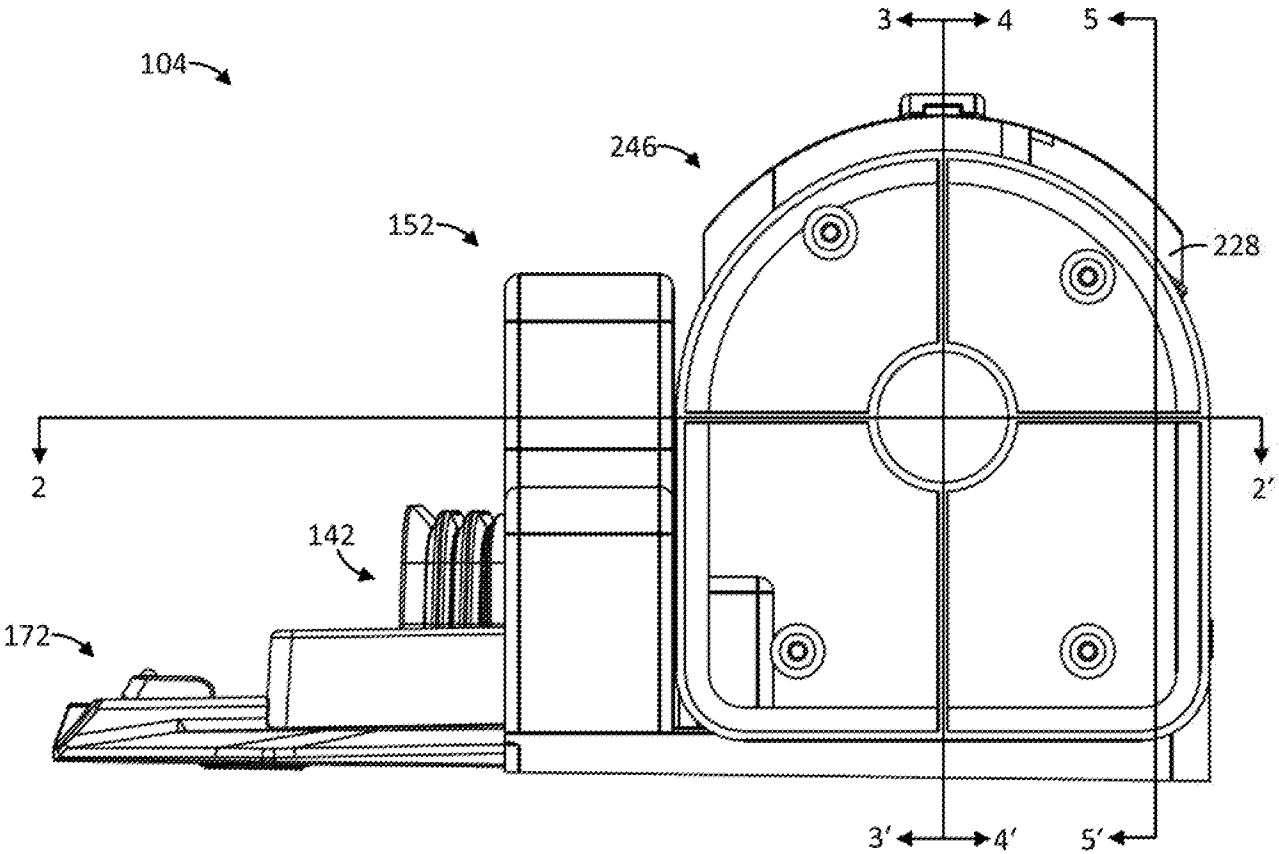
FIG. 12 is a side view of the right side of the evacuation station of FIG. 1, wherein a locking assembly of the evacuation station is in a locked position.

As stated above, the evacuation station 104 includes an air treatment assembly 154 that receives and stores dirt from the mobile floor cleaning robot 102. The air treatment assembly 154 may be removably mounted to the evacuation station and may be of any shape and configuration that facilitates mounting to the housing 152. In some embodiments, for example as shown in FIG. 11, the air treatment assembly 154 has a front side 174, a rear side 176, and two laterally opposed ends 178, 180.

In some examples, the air treatment assembly 154 includes an air treatment member 182. In embodiments of the evacuation station 104 that include a suction motor 156 and/or a blowing device, the air treatment member 182 may remove entrained dirt from the air drawn/pushed into the evacuation station 104 by the suction motor 156 and/or the blowing device. Specifically, in some examples, the air treatment member 182 may be a momentum air separator 184 (of any suitable configuration) that is configured to help separate dirt from the air flow (e.g., a baffled chamber). In other examples, the air treatment member 182 may be one or more cyclones. For example, as exemplified in FIGS. 25-27, the air treatment member 182 may be a single cyclone 196 wherein an air inlet 192 and an air outlet 194 of the air treatment member 182, i.e., in this example, the cyclone 196, are at the same end of the cyclone 196. Alternately, the air treatment member 182 may comprise two or more cyclonic cleaning stages, each of which may comprise a single cyclone or a plurality of cyclones in parallel.

Figure 25:
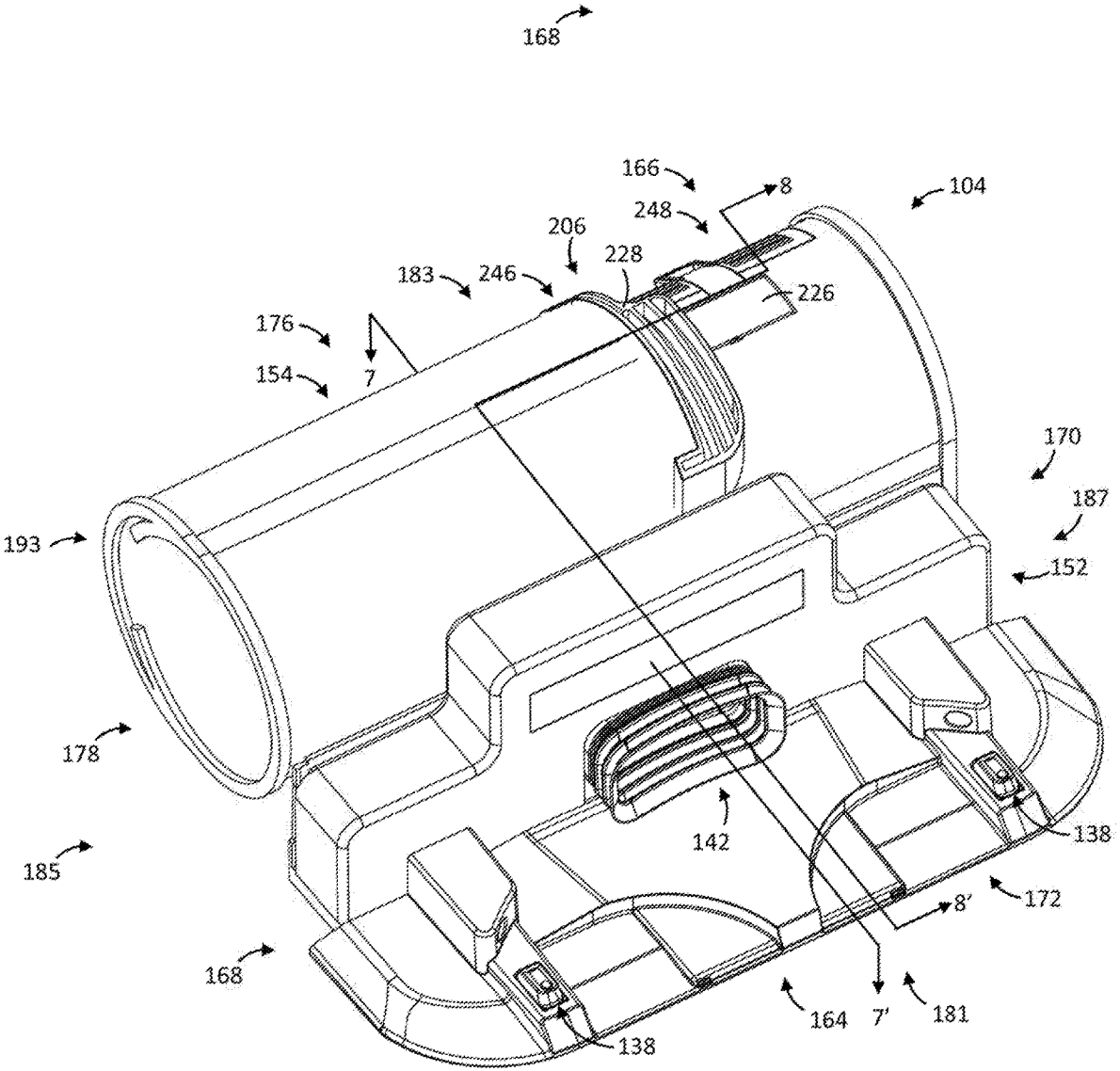
FIG. 25 is a front perspective view of an alternate embodiment of an evacuation station.
Figure 26:
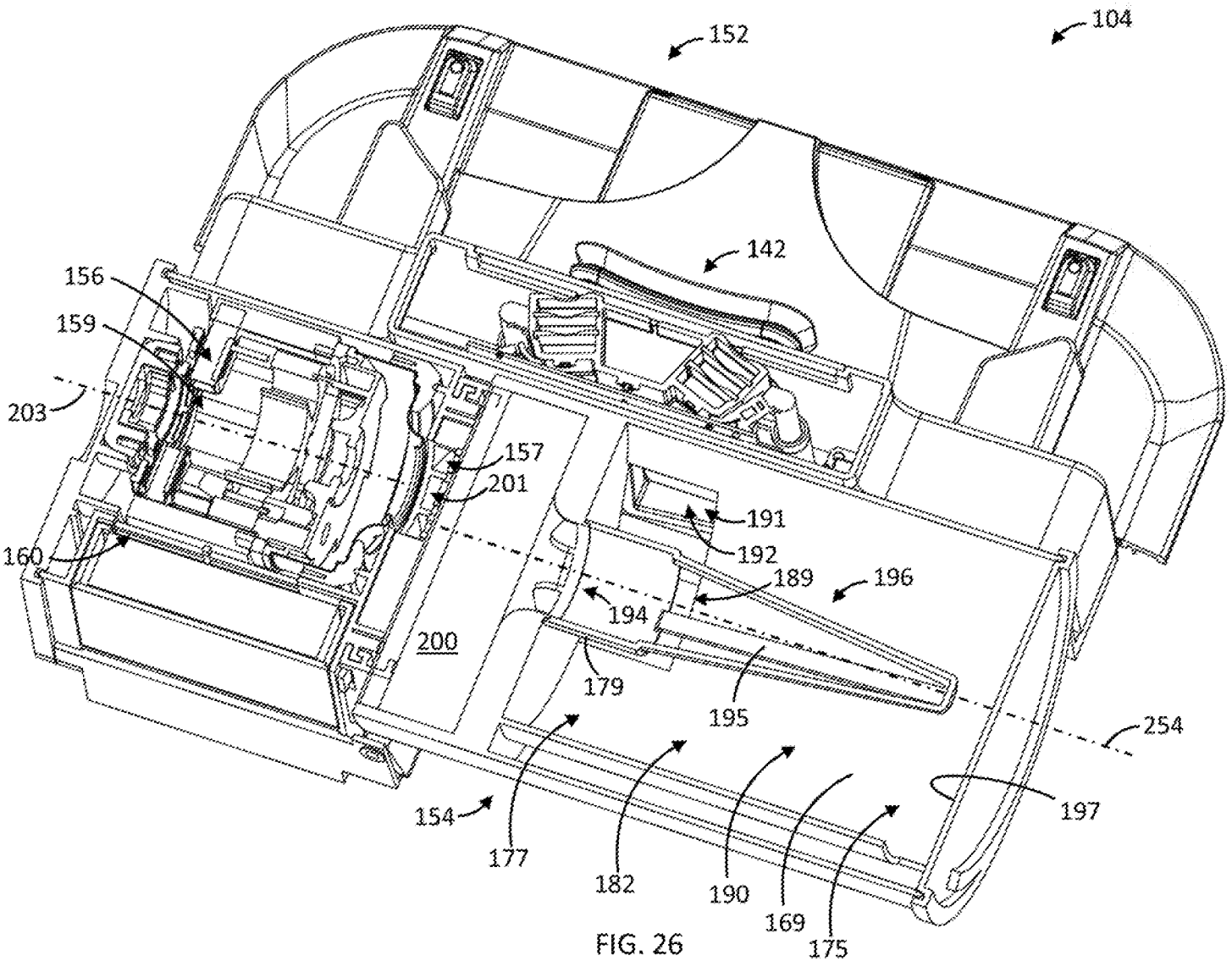
FIG. 26 is a cross-section view of the evacuation station of FIG. 25, taken along the section line 7-7'.
Figure 27:
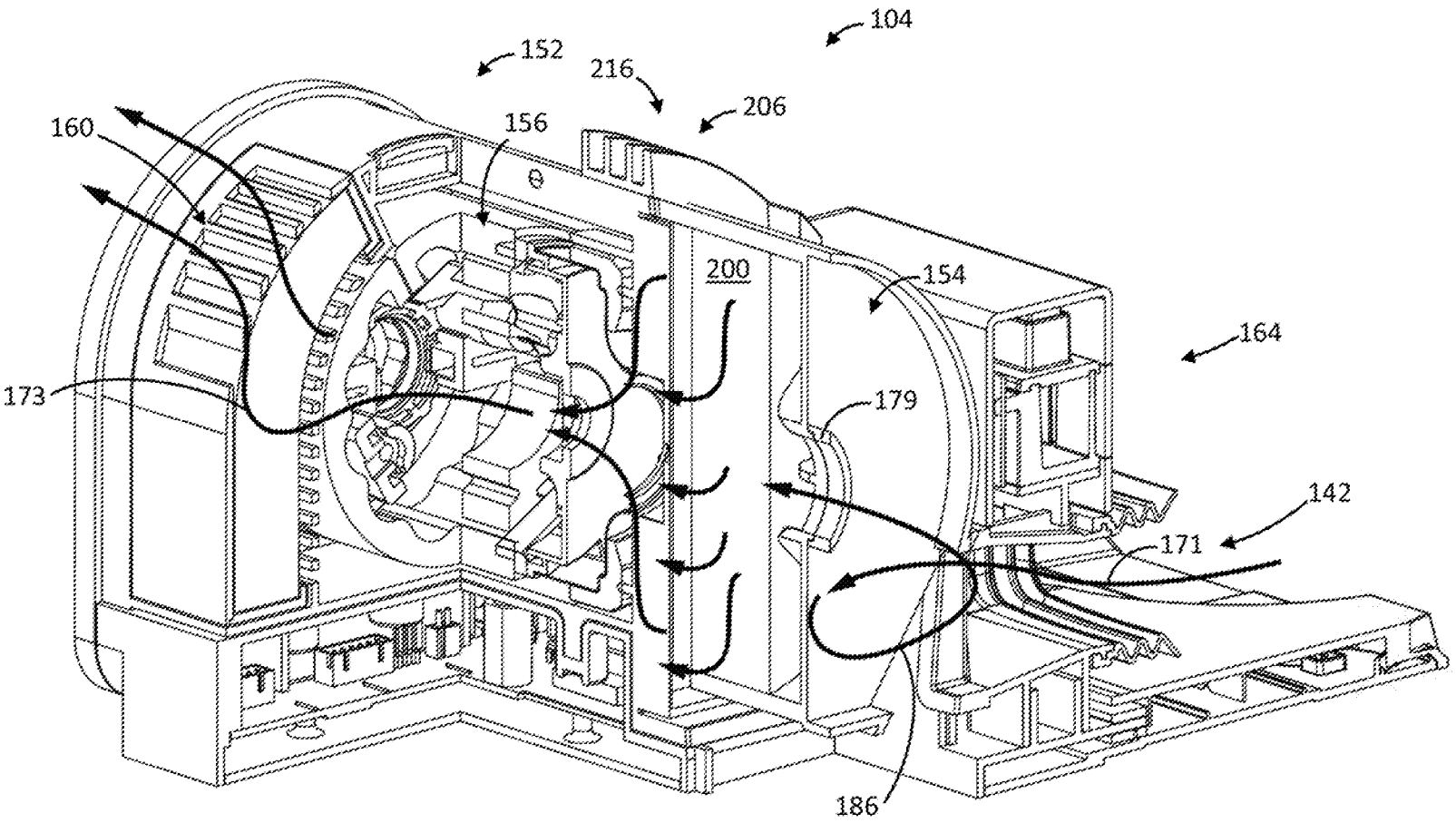
FIG. 27 is a cross-sectional view of the evacuation station of FIG. 25, taken along the section line 8-8'.
Figure 28:
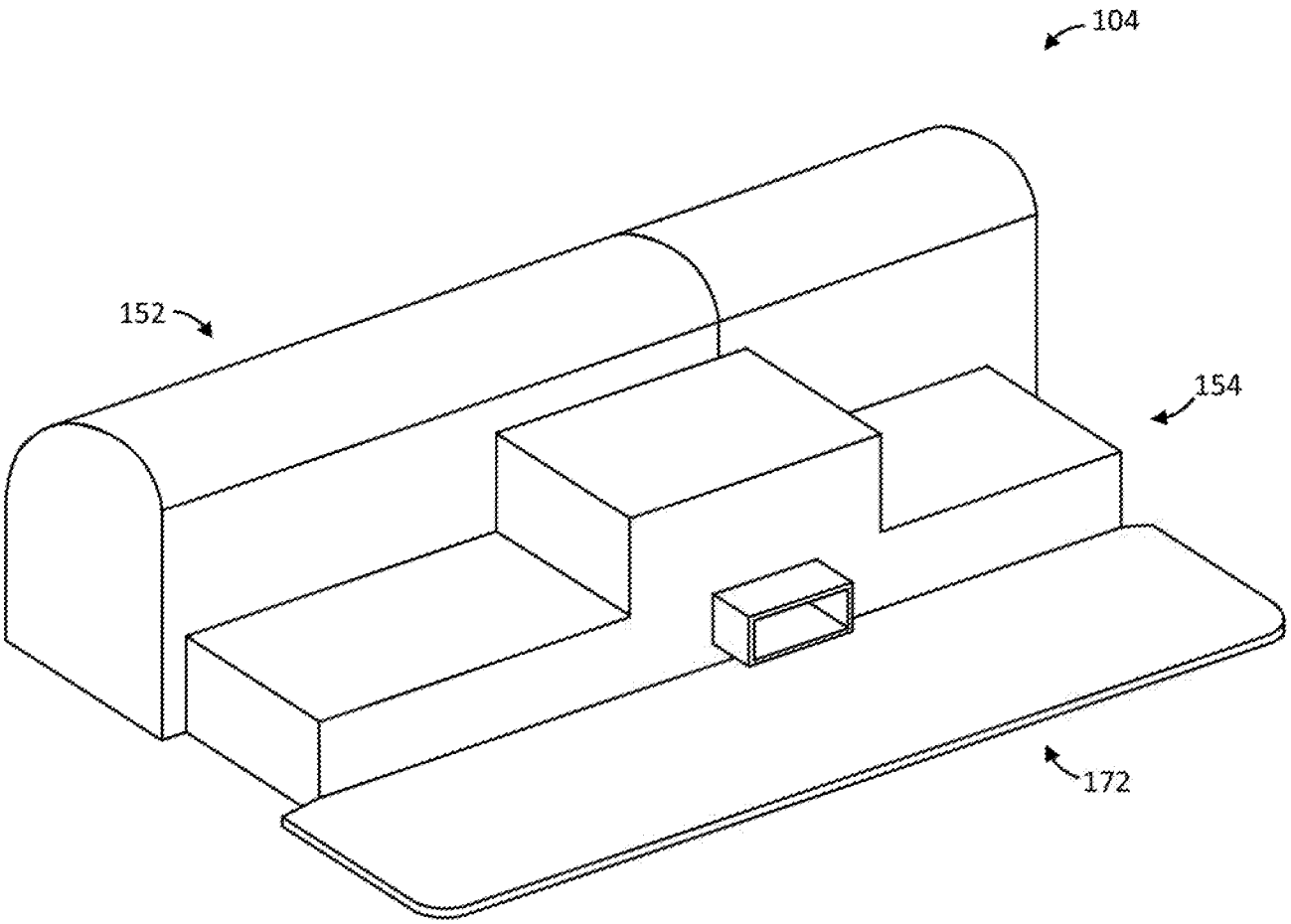
FIG. 28 is a front perspective view of an alternate embodiment of an evacuation station for a mobile floor cleaning robot

In some embodiments, the air treatment member 182, i.e., in the example illustrated in FIGS. 25-27 the cyclone 196, may include a chamber 190. The chamber 190 may be defined by an outer wall 169 and may extend from a first chamber end 175 to a second chamber end 177. The chamber 190 may store dirt separated from an air flow passing through the air treatment member, generated, for example, by the suction motor 156. That is, the air treatment member 182 may separate dirt from an air flow, and that dirt may be collected and stored in the chamber 190. In embodiments of the air treatment member 182 that include a cyclone 196, the chamber 190 may be located external to the cyclone 196. Alternately, as exemplified in FIG. 26, chamber 190 may be the cyclone chamber and separated dirt may accumulate in cyclone chamber 190.

The chamber 190 has a chamber air inlet 191. In some embodiments, the air inlet 191 to the chamber 190 may also be the air inlet 192 to the cyclone 196. It will also be appreciated that the air inlet 191 to the chamber 190 may also be the evacuation station air inlet 142.

As exemplified in FIG. 26 the cyclone chamber air inlet 192 is located adjacent the air inlet of the housing air inlet 201. In such an embodiment, the air inlet 191, 192 may be located distal to the first lateral side 178 of the air treatment assembly 154 and/or distal to the first lateral side 168 of the housing 152. Accordingly, in some embodiments, as exemplified, the chamber inlet 191 may located at about a mid-point between the laterally opposing ends 168, 170 of the housing 152 of the evacuation station 104. An advantage of this design is that the mobile floor cleaning robot 102 may dock at a central location of the evacuation station 104 while permitting a low profile evacuation station due to the horizontal orientation of the cyclone chamber 190.

Accordingly, an air stream including dirt, from the mobile floor cleaning robot 102 may pass through the air inlet 192 of the air treatment member 182. Thereafter, the air treatment member 182, i.e., in some examples the cyclone 196, may urge the dirt to separate from the air stream. The dirt may remain within the chamber 190, and the air stream may pass through an air outlet 189 of the chamber 190. In some embodiments, the air outlet 189 of the chamber 190 may also be the air outlet 194 of the air treatment member, i.e., the air outlet 194 of the cyclone 196.

In order to inhibit dirt, such as hair or the like, from exiting the chamber 190, a screen 195 may form the air outlet 189 of the chamber 190. The screen 195 may be any porous member, such as a mesh screen. As exemplified, the screen 195 extends axially from a wall 179 that is provided at the second end 177 of the chamber 190 and forms the air outlet 189 of the chamber 190. In the exemplified embodiment, the chamber 190 is a cyclone chamber and the wall 179 and screen 195 extend laterally (i.e., in line with the longitudinal axis 254 (a cyclone axis or rotational axis if the chamber 190 is a cyclone chamber)) within the air treatment assembly 154 and comprises a vortex finder.

Therefore, in some embodiments of the evacuation station 104 that include a suction motor 156, when in use, an air flow generated along an air flow path 186 by the suction motor 156 may draw dirt from the bin(s) 136 located within the mobile floor cleaning robot 102, through the evacuation station air inlet 142, through the air inlet 192 of the chamber 190, and into the chamber 190. The air treatment member 182, i.e., in some examples the momentum air separator 184 or the cyclone 196, may then separate the air from at least a portion of the dirt, and the suction motor 156 may draw the air out through the air outlet 194 of the chamber 190, through the suction motor 156, and push the air through the clean air outlet 160.

The air treatment assembly 154 may be openable to enable the collected dirt to be emptied. The air treatment assembly 154 may be openable by any means known in the vacuum cleaner arts. For example, the chamber 190 may have an openable end 193 to facilitate emptying of dirt from therein. Accordingly, opening the openable end 193 opens the laterally extending air flow path 186. In the example illustrated, the air treatment assembly 154 includes an openable end 193 at the lateral side 178 of the air treatment assembly 154. Specifically, in the example illustrated, the openable end 193 is an end wall 197 that is opposite to the air outlet 194. In some embodiments, the openable end 193 may comprise a door that is movable between and open position and a closed position. In some examples, the openable end 193 may be openable by a button 199 that may pivot like a rocker switch. In other embodiments, the openable end 193 may held in place by a friction fit and is therefore removed with a force that overcomes the friction force. In yet another embodiment, the openable end 193 may be rotatably mounted (e.g., screw threads or a bayonet mount) with a portion of the air treatment assembly 154.

In embodiments of the evacuation station 104 that include a suction motor 156 and/or a blowing device, the air treatment assembly 154 may include a pre-motor filter, such as filter media 200 that filters air that exits the chamber 190 prior to traveling through the suction motor 156. If the evacuation station 104 includes a suction motor 156, the filter media 200 may be downstream of the air treatment assembly 154 and upstream of the suction motor 156. If the evacuation station 104 includes a blowing device, the filter media 200 may be downstream of the air treatment assembly 154 and upstream of the clean air outlet 160. In some embodiments, the evacuation station 104 may also include a post-motor filter.

In embodiments of the evacuation station 104 where the suction motor 156 is located in the housing 152, the filter media 200 may also be located in the housing 152. Alternatively, in embodiments of the evacuation station 104 where the suction motor 156 is located in the housing 152, the filter media 200 may be located in the air treatment assembly 154, for example at one of the laterally opposed ends 178, 180 of the air treatment assembly 154. Regardless of whether the filter media 200 is located in the housing 152 or in the air treatment assembly 154, the filter media 200 may be accessible when the air treatment assembly 154 is removed from the housing 152.

The filter media 200 can be formed from any suitable physical or porous filter media that inhibits dirt from entering the suction motor 156 and/or being discharged through the clean air outlet 160. For example, the filter media 200 may be one or more of a foam filter, a felt filter, a HEPA filter, or other physical filter media. In some embodiments, the filter media 200 may include an electrostatic filter, or the like.

In other embodiments, the air treatment assembly 154 may not include an air treatment member 182. For example, in embodiments of the evacuation station 104 that only include a mechanical dirt transfer mechanism, the air treatment assembly 154 may not remove entrained dirt from an air flow, and rather, may be a chamber 190 that dirt may be pushed or pulled into.

Linear Arrangement of the Evacuation Station

In accordance with one aspect of this disclosure, which may be used by itself or in combination with any other aspect of this disclosure, the evacuation station 104 has a generally linear air flow path.

According to this aspect, some or all of the operating components forming the air flow path 186 through the evacuation station 104 may be arranged such that the operating components are arranged in a generally horizontal plane whereby air may travel in a generally horizontal plane between some or all of the operating components (e.g., the air treatment assembly 154, the pre-motor filter 200, the suction motor 156 and the post-motor filter). Accordingly, for example, air may travel generally horizontally between the air treatment assembly 154 and the pre-motor filter 200; the air treatment assembly 154 and the suction motor 156; the air treatment assembly 154, the pre-motor filter 200 and the suction motor 156; or the air treatment assembly 154, the pre-motor filter 200, the suction motor 156 and the post-motor filter.

Alternately, or in addition, the air may travel generally horizontally through some or all of the operating components. Accordingly, the air may travel generally horizontally through one or more of the air treatment assembly 154, the pre-motor filter 200, the suction motor 156 and the post-motor filter.

In accordance with this aspect, some or all of the operating components may be arranged side by side. For example, as exemplified herein, some or all of the operating components forming the air flow path 186 may be arranged laterally such that air travels laterally through the evacuation station 104.

An advantage of such a configuration is that the back pressure through the evacuation station may be reduced thereby enabling a smaller and lighter suction motor 156 to be used.

Figure 6:
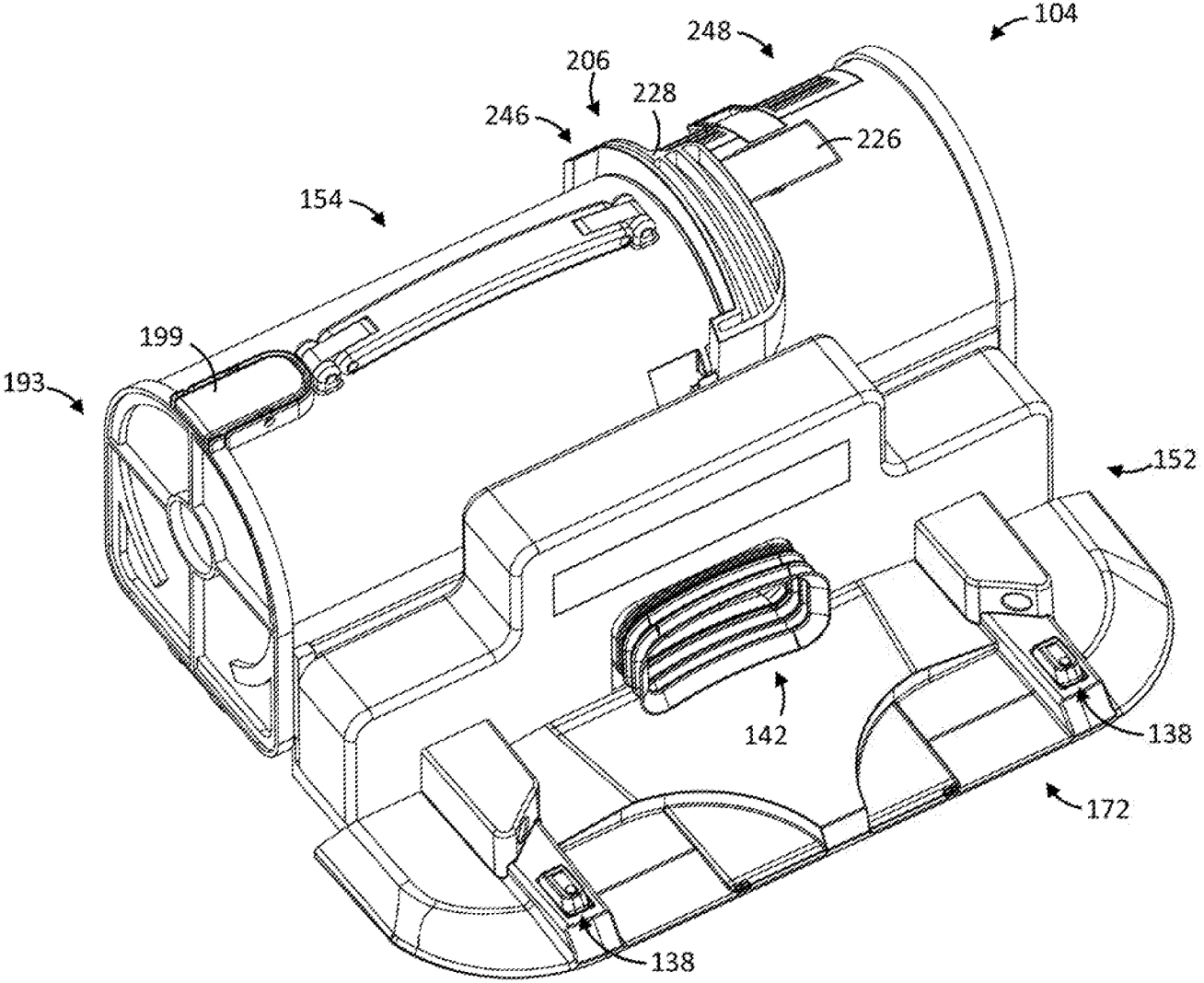
FIG. 6 is a front perspective view from above of the evacuation station of FIG. 1.

As exemplified in FIG. 6, the evacuation station 104 has an air inlet 142. In this embodiment, the air inlet 142 is provided on the front robot docking side 164 of the housing 152. It will be appreciated that, in alternate embodiments, the air inlet 142 may be part of the air treatment assembly 154 and need not be part of the housing 152.

As also exemplified, the air inlet 142 is centrally positioned between the opposed lateral sides 168, 170 of the evacuation station 104. However, it will be appreciated that, in accordance with this aspect, the air inlet 142 may be provided at any location along the lateral length of the evacuation station (i.e., at any location between opposite lateral sides 168, 170 including at either lateral side).

As exemplified in FIG. 26, the air treatment assembly comprises a cyclone. Laterally positioned (along axis 254) from the air outlet 189 of the cyclone chamber is pre-motor filter 200. Laterally positioned from the pre-motor filter 200 is the suction motor 156. As exemplified, the suction motor 156 has an inlet end 157 and a laterally opposed outlet end 159. The inlet end 157 faces towards the pre-motor filter 200. Optionally (not shown) a post-motor filter may be laterally positioned from the suction motor 156. The post-motor filter may be positioned facing the outlet end 159 of the suction motor 156.

If the air treatment member 154 is a cyclone, then the longitudinal axis 254 of the air treatment assembly 154 may be the cyclone axis of rotation. The suction motor 156 has a suction motor axis of rotation 203.

Optionally, the longitudinal axis 254 may extend through one or more of the pre-motor filter 200, the suction motor 156 and a post-motor filter. Alternately or in addition, the suction motor axis of rotation 203 may extend through one or more of the air treatment member 154, the pre-motor filter 200 and a post-motor filter. Optionally, the axes 254 and 203 may be coaxial.

It will be appreciated that by positioning the operating components laterally sequentially, the air may travel in a generally continuous lateral path sequentially between the operating components. In addition, if the operating components have a generally lateral air flow path therethrough, the air may travel in a generally continuous lateral path sequentially between and through the operating components.

It will further be appreciated that if the components are generally arranged in a common horizontal plane, then the air may have limited (or essentially no) vertical travel between the operating components. Accordingly, if the axes 254 and 203 extend through all of the operating components, the air may travel in a generally continuous lateral path sequentially between and through the operating components with little or no vertical travel component. Such a travel path may reduce the back pressure through the evacuation station 104. Accordingly, the air flow path 186 though the evacuation station 104 may extend from the evacuation station air inlet 142 to the air treatment assembly 154, through the air treatment assembly 154, i.e., from the air treatment member air inlet 192 to the air treatment member air outlet 194, back into the housing 152 via the housing air inlet 201, through the suction motor 156 and an optional post-motor filter and exit the evacuation station 104 via the evacuation station clean air outlet 160.

In the example of FIG. 26, the cyclone has an inlet 192 and an outlet 194 at the same end 180 of the cyclone chamber 190. Accordingly, air entering the evacuation station 104 through inlet 142 will enter the cyclone chamber 190 via inlet 192 and travel laterally in one direction towards the lateral side 168 and then reverse direction and travel laterally to the screen 195 and through the air outlet 189 to the air treatment member air outlet 194. The air treatment assembly air outlet 194 faces the housing air inlet 201 and the suction motor inlet end 157 is provided at the housing air inlet 201 and may be the housing air inlet 201. Accordingly, the air may then enter the suction motor and travel through the suction motor 156 to the axially opposed outlet end 159 of the suction motor 156. As exemplified in FIG. 27, the air may then travel rearwardly and exit the evacuation station 104 via clean air outlet 160.

It will be appreciated that, in an alternate embodiment, the inlet 192 may be located proximate or at lateral end 178 and the outlet 194 may be in the same position as exemplified in FIG. 26. In such a case, the air treatment member 154 may be a cyclone wherein the air travels in a single direction through the cyclone from lateral side 178 to lateral side 180.

It will be appreciated that the suction motor 156 may be provided at alternate lateral positions within housing 152. For example, the suction motor 156 may be located closer to or at lateral end 170, or any location between the lateral end having housing air inlet 201 and lateral end 170.

If the evacuation station 104 includes a pre-motor filter media 200, then the pre-motor filter 200 may be located at the first housing end 168, i.e., the second end 180 of the air treatment assembly 154. Although located at the first housing end 168, the pre-motor filter 200 may be located within the air treatment assembly air outlet 194 or the housing air inlet 201.

Low Profile of the Evacuation Station

In accordance with one aspect of this disclosure, which may be used by itself or in combination with any other aspect of this disclosure, the evacuation station 104 has a low profile.

An evacuation station 104 with a low profile is an excavation station 104 wherein the upper end of the evacuation station 104 is located closer to the floor on which the evacuation station 104 is located. As described above, the evacuation station 104 includes a housing 152 and an air treatment assembly 154. Accordingly, the maximum height of the evacuation station 104 would be the portion of the housing 152 and the air treatment assembly 154 that is furthest above the floor on which the evacuation station 104 is placed.

An advantage of this design is that the evacuation station 104 may be less noticeable in a room and therefore more aesthetically pleasing. Accordingly, for example, the evacuation station 104 may have a height that is up to three times the height of a mobile floor cleaning robot 102, twice the height of a mobile floor cleaning robot 102 and, optionally, may be about the same height as the mobile floor cleaning robot 102.

According to this aspect, some or all of the operating components forming the air flow path 186 through the evacuation station 104 may be arranged side by side. For example, as exemplified herein, some or all of the operating components forming the air flow path 186 may be arranged laterally (along axis 254), and may optionally have flow travel from one component to the next along a path that extends generally laterally (e.g., horizontally).

The inlet and the outlet of some or all of the operating components may be on a lateral side of the operating components and accordingly, air may enter or exit some or all of the operating components laterally. Optionally, air may enter one lateral side of an operating component and exit on an opposed lateral side of the operating components. Accordingly, the operating components may be arranged laterally spaced from each other and, optionally, linearly (along axis 254 and/or 203) from each other. Accordingly, some or all of the operating components need not be stacked on top of each other thereby reducing the overall height (from the floor to the portion of the housing 152 and the air treatment assembly 154 that is furthest above the floor on which the evacuation station 104 is placed) of the evacuation station 104.

Removal of the Air Treatment Assembly from the Housing

In accordance with one aspect of this disclosure, which may be used by itself or in combination with any other aspect of this disclosure, the dirt collection region and, optionally, the air treatment assembly 154 of the evacuation station 104 may be laterally removable from the housing 152. An advantage of this design is that the evacuation station 104 may be positioned under furniture (such as a side table) so as to reduce the visibility of the evacuation station 104. Accordingly, in operation, a user may unlock the air treatment assembly 154 from the housing 152 and then move the air treatment assembly 154 laterally (e.g., so that it is no longer positioned under a piece of furniture, and then lift the air treatment assembly 154 for transport for emptying.

According to this aspect, the air treatment assembly 154 may be moveable from an in use position (i.e., mounted positioned) in which the air treatment assembly 154 is mounted to the housing 152 and a removal position in which the air treatment assembly 154 is detached from the housing 152. In some embodiments, when in the removal position, the entire air treatment assembly 154 may be positioned outwardly of the perimeter 162 of the housing 152. That is, when in the removal position, when looking down at the evacuation station 104 from above, no portion of the air treatment assembly 154 overlaps with any portion of the housing 152.

When disengaging the air treatment assembly 154 from the housing 152, the air treatment assembly 154 may translate in any direction away from the housing 152. For example, in some embodiments, the air treatment assembly 154 may translate rearwardly from the housing 152 when moving from the mounted position to the removal position. In other embodiments as exemplified herein, the air treatment assembly 154 may translate laterally (along e.g., axis 254) from the housing 152 when moving from the mounted position to the removal position. As used herein, the rearward and lateral directions are defined in reference to the front robot docking side 164 of the evacuation station 104. That is, the rearward direction is parallel to the direction of travel of the mobile floor cleaning robot 102 when docking to the evacuation station 104 in a direction away from the mobile floor cleaning robot 102 when the mobile floor cleaning robot 102 is docking/docked to the evacuation station 104. Accordingly, the lateral direction is transverse to the direction of travel of the mobile floor cleaning robot 102 when the mobile floor cleaning robot 102 is docking to the evacuation station 104. In other embodiments, the air treatment assembly 154 may translate diagonally (i.e., at an angle to the lateral and rearward directions) from the housing 152 to when moving from the mounted position to the removal position.

Regardless of the direction of travel of the air treatment assembly 154 when moving from the mounted position to the removal position, when in the removal position all of the air treatment assembly 154 may be positioned outwardly of the perimeter 162 of the housing 152.

To facilitate mounting and removal of the air treatment assembly 154 to the housing 152, the evacuation station 104 may include a translation member 206. The translation member 206 may be operable to translate the air treatment assembly 154 to the removal position. For example, in some embodiments, a male alignment member 208 may be located on one of the air treatment assembly 154 and the housing 152, and a female alignment member 210 may be located on the other of the air treatment assembly 154 and the housing 152. The male and female alignment members 208, 210 may be configured such that translation of the air treatment assembly 154 with respect to the housing 152 may be limited to a single direction (i.e., rearward, lateral, or diagonal) until the air treatment assembly 154 is located external to the perimeter 162 of the housing 152. In some examples, the male alignment member 208 may include a key 212 and the female alignment member 210 may include a slot 214 that removably receives the key 212. Specific, non-limiting, examples of translation members 206 are described in detail subsequently.

In some embodiments, the evacuation station 104 may also include at least one locking assembly 216. The locking assembly 216 may lock the air treatment assembly 154 in the in use position. That is, in some examples, the locking assembly 216 may restrict translation of the air treatment assembly 154 with respect to the housing 152 in all directions (i.e., rearward, lateral, diagonal, and vertical) until the locking assembly 216 is unlocked. In other examples, the locking assembly 216 may restrict translation of the air treatment assembly 154 with respect to the housing 152 in only one direction (i.e., only one of rearward, lateral, diagonal, and vertical). Further, an evacuation station 104 may include more than one locking assembly 216, each of which may restrict translation of the air treatment assembly 154 with respect to the housing 152 in at least one direction, when locked. Any types of lock known in the art that could selectively restrict translation of the air treatment assembly 154 from the mounted position to the removal position may be used as the locking assembly 216.

In some examples, the locking assembly 216 includes the translation member 206. That is, the locking assembly 216 may restrict translation of the air treatment assembly 154 with respect to the housing 152 when in the locked position, and act as the translation member 206 when the locking assembly 216 is in the unlocked position. Specific, non-limiting, examples of locking assemblies 216 that include translation members 206 are described in detail subsequently.

Optionally, the housing 152 and/or the air treatment assembly 154 may include a biasing device 218, which, when activated may urge the air treatment assembly 154 to translate from the mounted position to the removal position. For example, in some embodiments, the translation member 206 and/or the locking assembly 216 may include the biasing device 218. The biasing device 218 may be, for example, a spring 220. In other examples, the biasing device 218 may include a motorized device, such as, for example, a motorized piston cylinder assembly, to translate the air treatment assembly 154 from the mounted position to the removal position.

In some embodiments, the air treatment assembly 154 may include a handle 222 to assist a user when removing and reattaching the air treatment assembly 154 to the housing 152. The handle 222 may be moveable between a storage position and a removal position. In the storage position, the handle 222 may extend generally laterally along the air treatment assembly 154, and, when in the removal position, the handle 222 may extend generally vertically.

In the exemplified embodiments, the air treatment assembly 154 is removably mountable to the first housing end 168. If the housing includes the evacuation station air inlet 142, then the air flow path 186 may be broken into two portions that flow through the housing 152, namely (a) an upstream air flow path portion 171 that extends from the evacuation station air inlet 142 to the air treatment member 154; and (b) a downstream air flow path portion 173 that extends from the housing air inlet 201 to the evacuation station air outlet 160. The upstream air flow path portion 171 may include the air inlet 191 to the chamber 190 and extends through the wall 179 of the chamber 190. Between the upstream 171 and downstream 173 portions, the air travels through the air treatment member 154.

EXAMPLE 1

Removal of the Air Treatment Assembly from the Housing

Referring now to FIGS. 6-27, shown therein are examples of evacuation stations 104, each having a housing 152 and a removable air treatment assembly 154.

In the examples illustrated, the suction motor 156 is located in the housing 152, however, it will be appreciated that the suction motor 156 could be located in the air treatment assembly 154.

In the examples illustrated, the pre-motor filter 200 is located in the air treatment assembly 154, however, it will be appreciated that the pre-motor filter 200 could be located in the housing 152.

Further, in the examples illustrated, the air treatment assembly 154 translates in a first lateral direction (i.e., leftward with respect the housing 152) when moving from the mounted position to the removal position. Again, it is to be understood that a similar mechanism could be implemented and the air treatment assembly 154 may translate in any one of the rearward, diagonal, and a second lateral direction (i.e., rightward with respect to the housing 152) when moving from the mounted position to the removal position.

Figure 7:
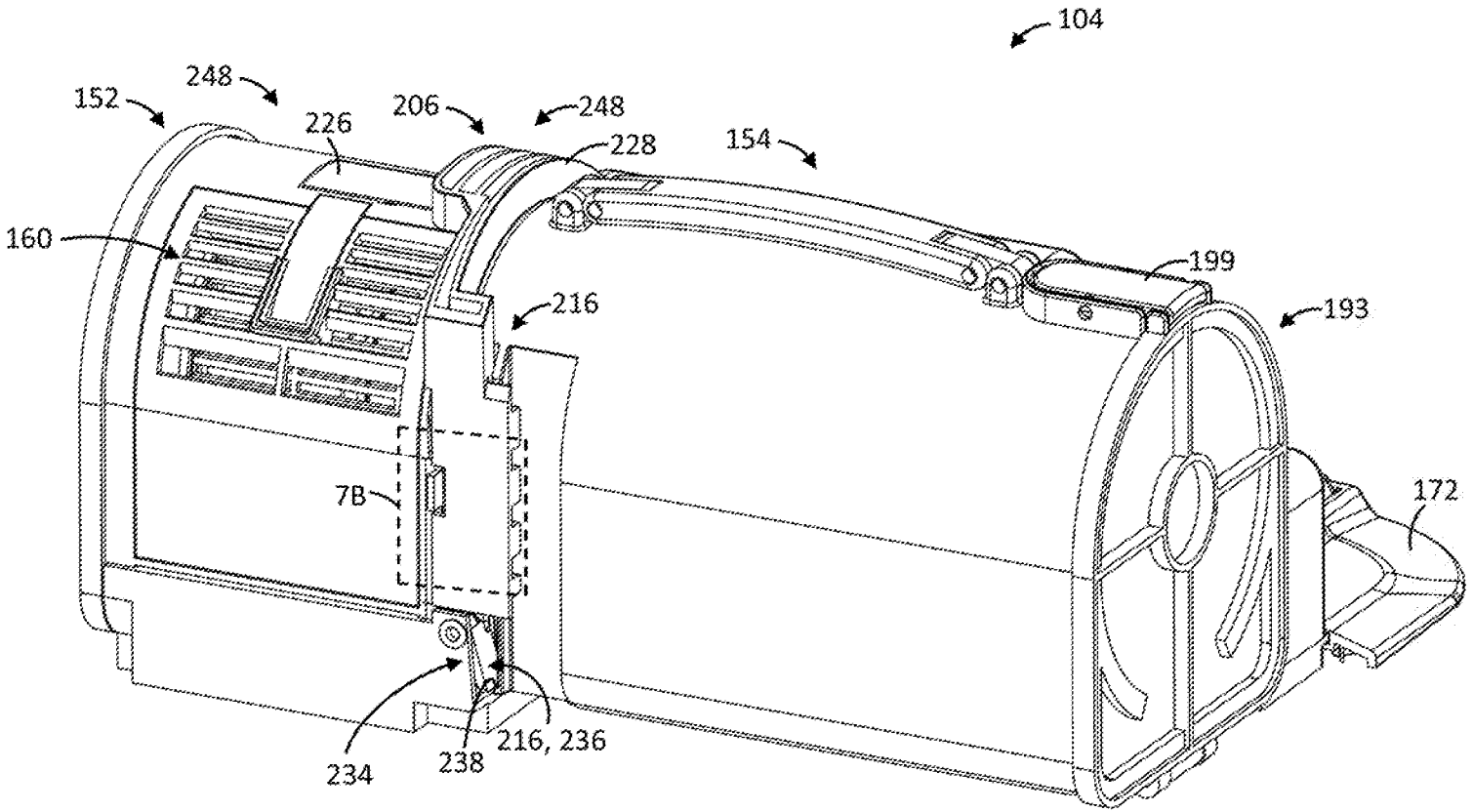
FIG. 7 is a rear perspective view of the evacuation station of FIG. 1.
Figure 7B:
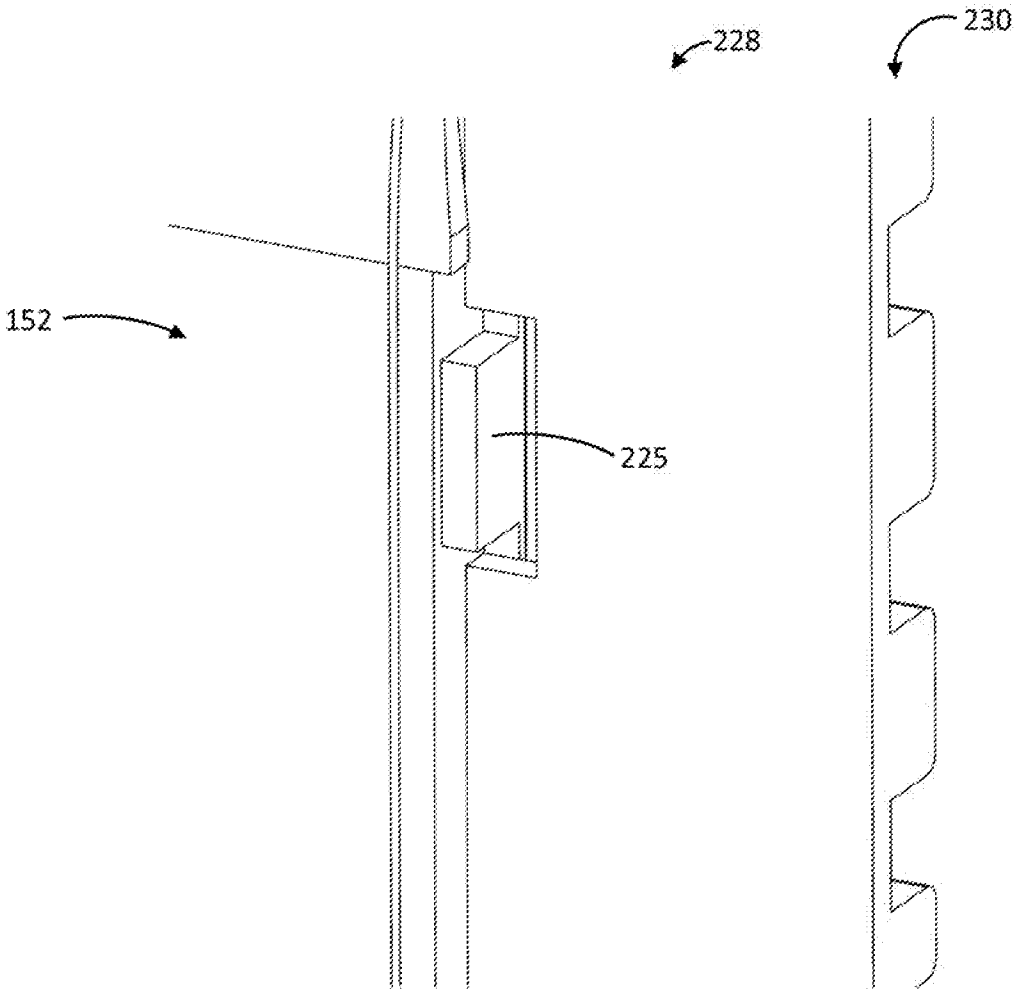
FIG. 7B is an enlarged view of the evacuation station of FIG. 7, taken at section 7B.
Figure 8:
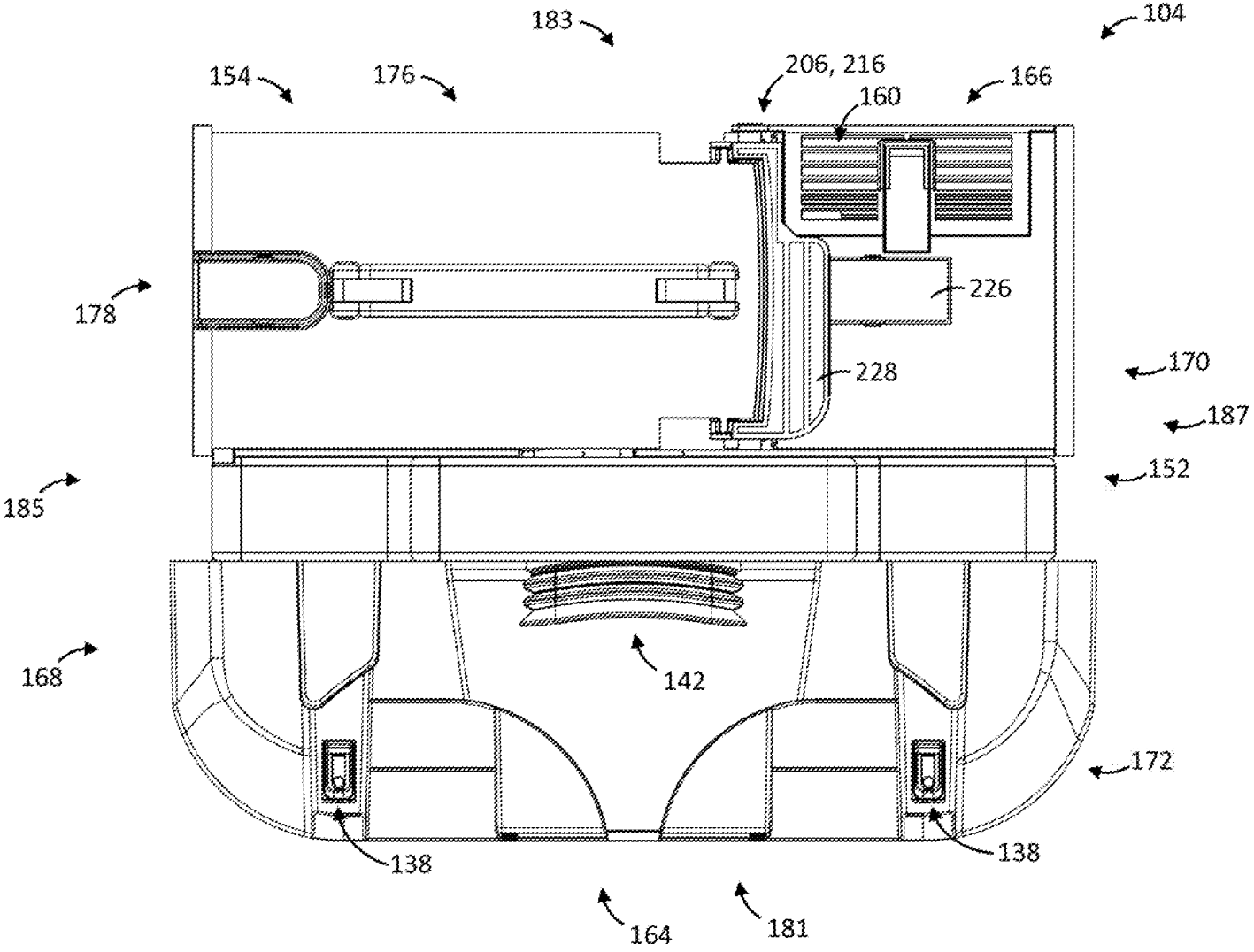
FIG. 8 is a top view of the evacuation station of FIG. 1.
Figure 9:
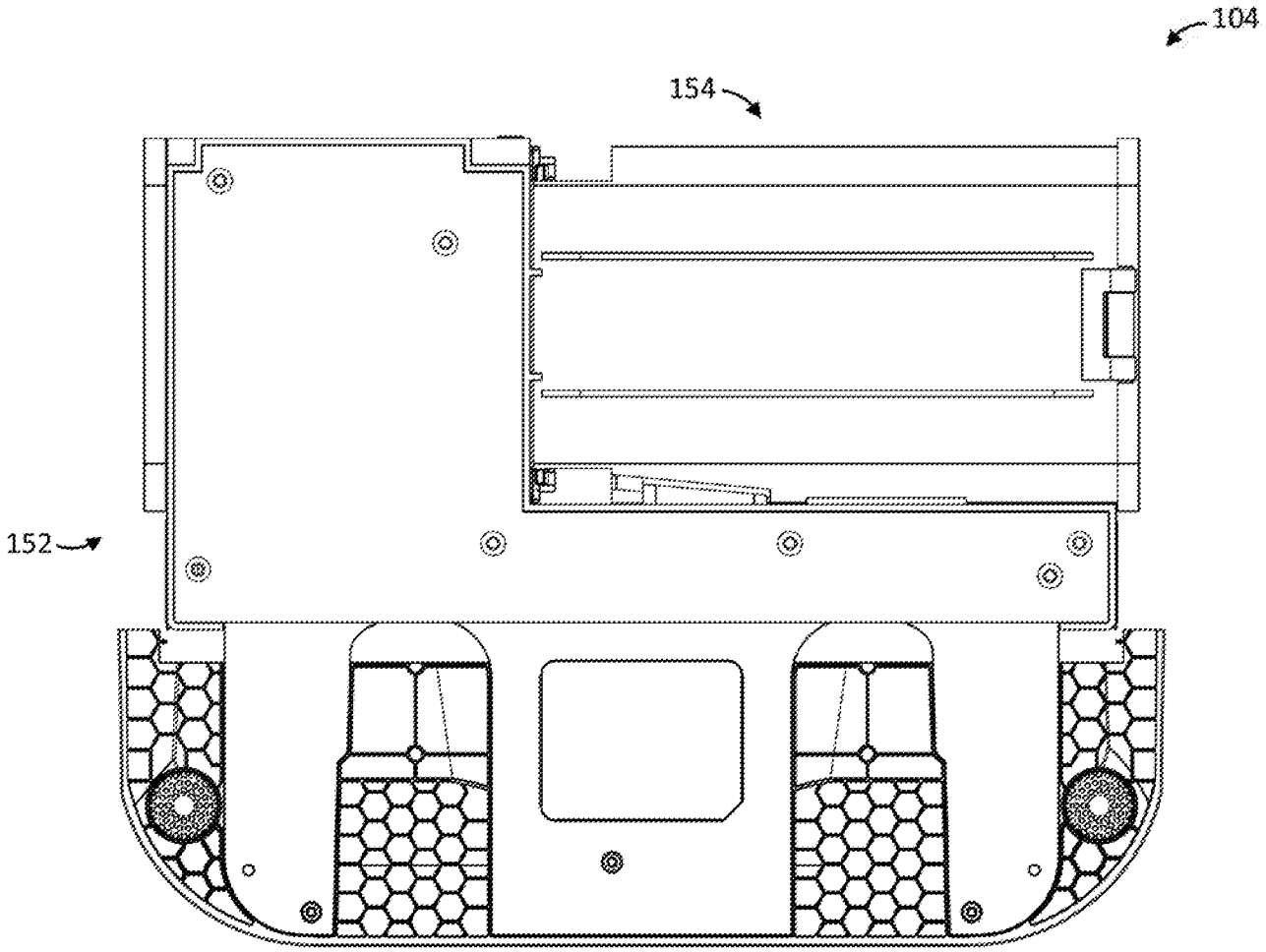
FIG. 9 is a bottom view of the evacuation station of FIG. 1.

In the examples illustrated, to remove the air treatment assembly 154 from the housing 152, a user may first push an actuator, e.g., push spring button 226 located on the top of the housing 152. The push spring button 226 may be located anywhere on the evacuation station 104. Pushing on the push spring button 226 releases a first locking assembly 216 of the evacuation station 104. Specifically, pushing on the push spring button 226 causes a locking horseshoe 228 to translate from a locked position (see FIGS. 12 and 16) to an unlocked position (see FIGS. 17-19). In an alternative embodiment, there may not be a push spring button 226, and the first locking assembly 216 may be unlocked by a user gripping the locking horseshoe 228 and translating it vertically. In some examples, referring to FIG. 7B, the housing may include a restraint 225 to limit translation of the locking horseshoe 228.

Figure 16:
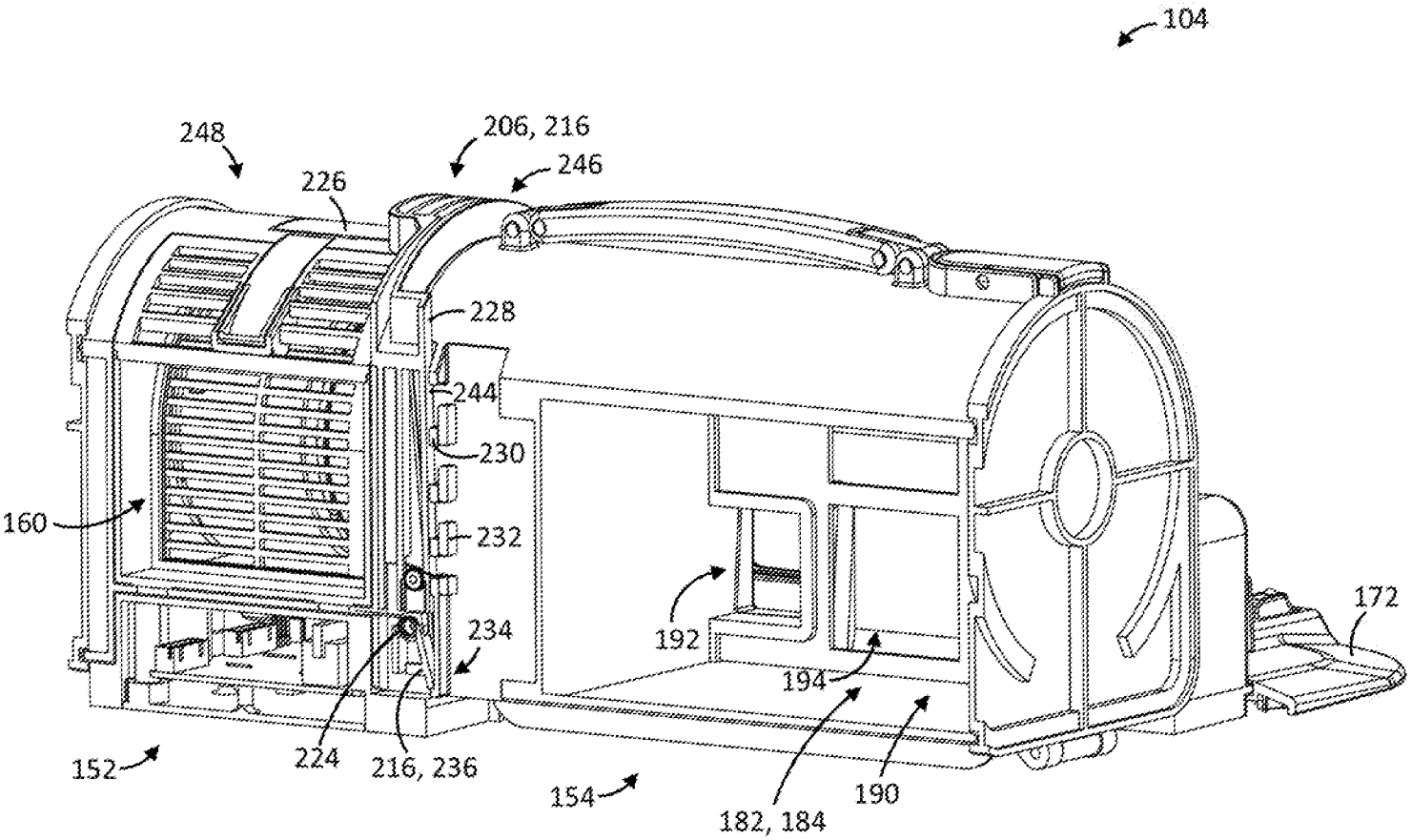
FIG. 16 is a cross-sectional view of the evacuation station of FIG. 12, taken along the section line 5-5', wherein an air treatment member of the evacuation station is engaged to a housing of the evacuation station.
Figure 17:
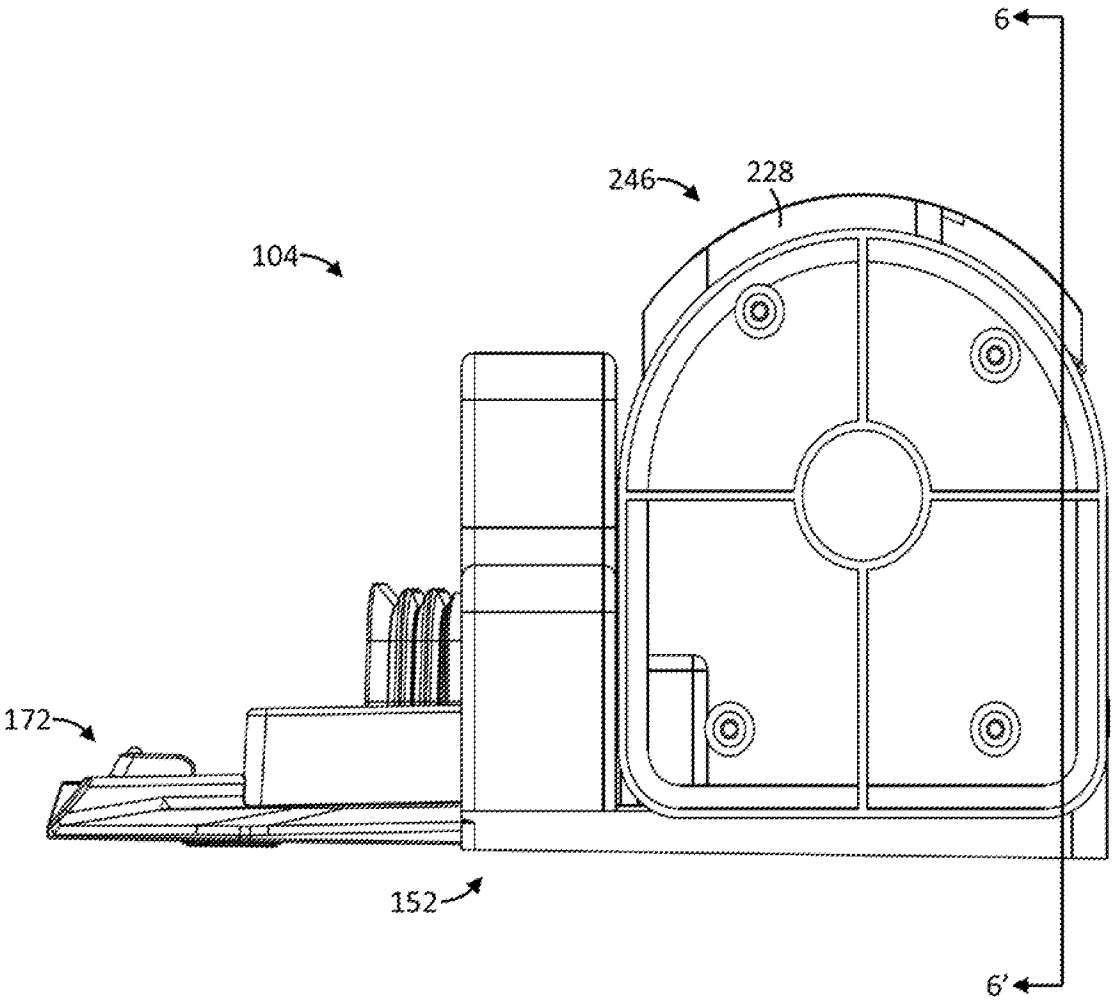
FIG. 17 is a side view of the right side of the evacuation station of FIG. 12, wherein the locking assembly is in an unlocked position.

Referring now to FIG. 16, in the example illustrated, when in the locked position, a first set of teeth 230 located on the locking horseshoe 228 are horizontally aligned with a second set of teeth 232 located on the air treatment assembly 154. That is, in the locked position, the two sets of teeth 230, 232 are horizontally aligned and therefore restrict translation in the first lateral direction of the air treatment assembly 154 with respect to the housing 152.

In the example illustrated, the housing 152 also includes a second locking assembly 234 which restricts vertical translation of the air treatment assembly 154 with respect to the housing 152. Specifically, in the example illustrated, the second locking assembly 234 is located on the housing 152 and is a latch 236. As shown, the latch 236 may engage with an engagement surface 238 on the air treatment assembly 154, therefore restricting vertical translation of the air treatment assembly 154 with respect to the housing 152.

In some embodiments, as shown, the latch 236 may be biased by a spring 224 to a locking position.

Figure 18:
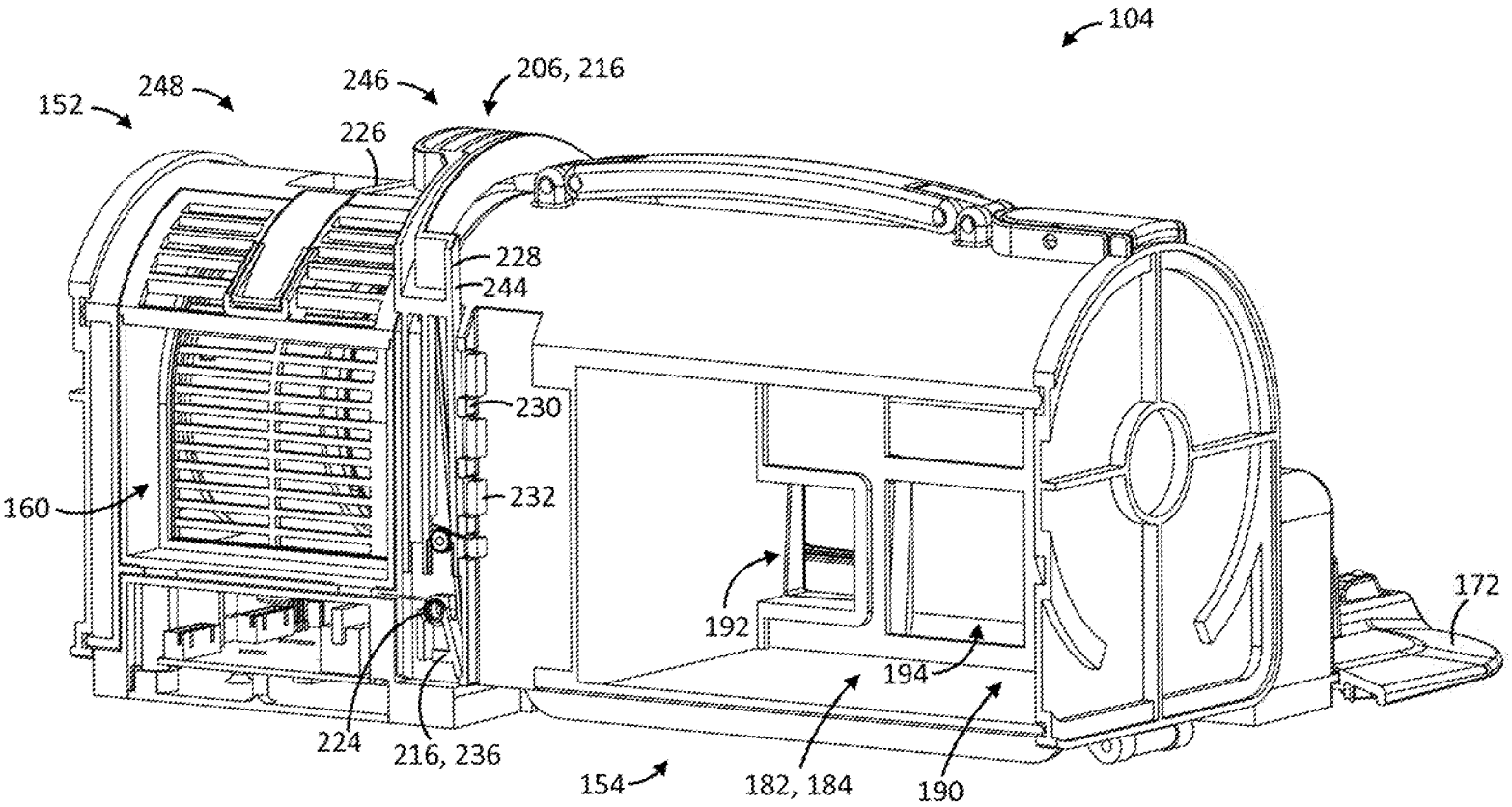
FIG. 18 is a perspective view of the evacuation station of FIG. 17, taken along the section line 6-6', wherein an air treatment member of the evacuation station is partially disengaged from a housing of the evacuation station.
Figure 19:
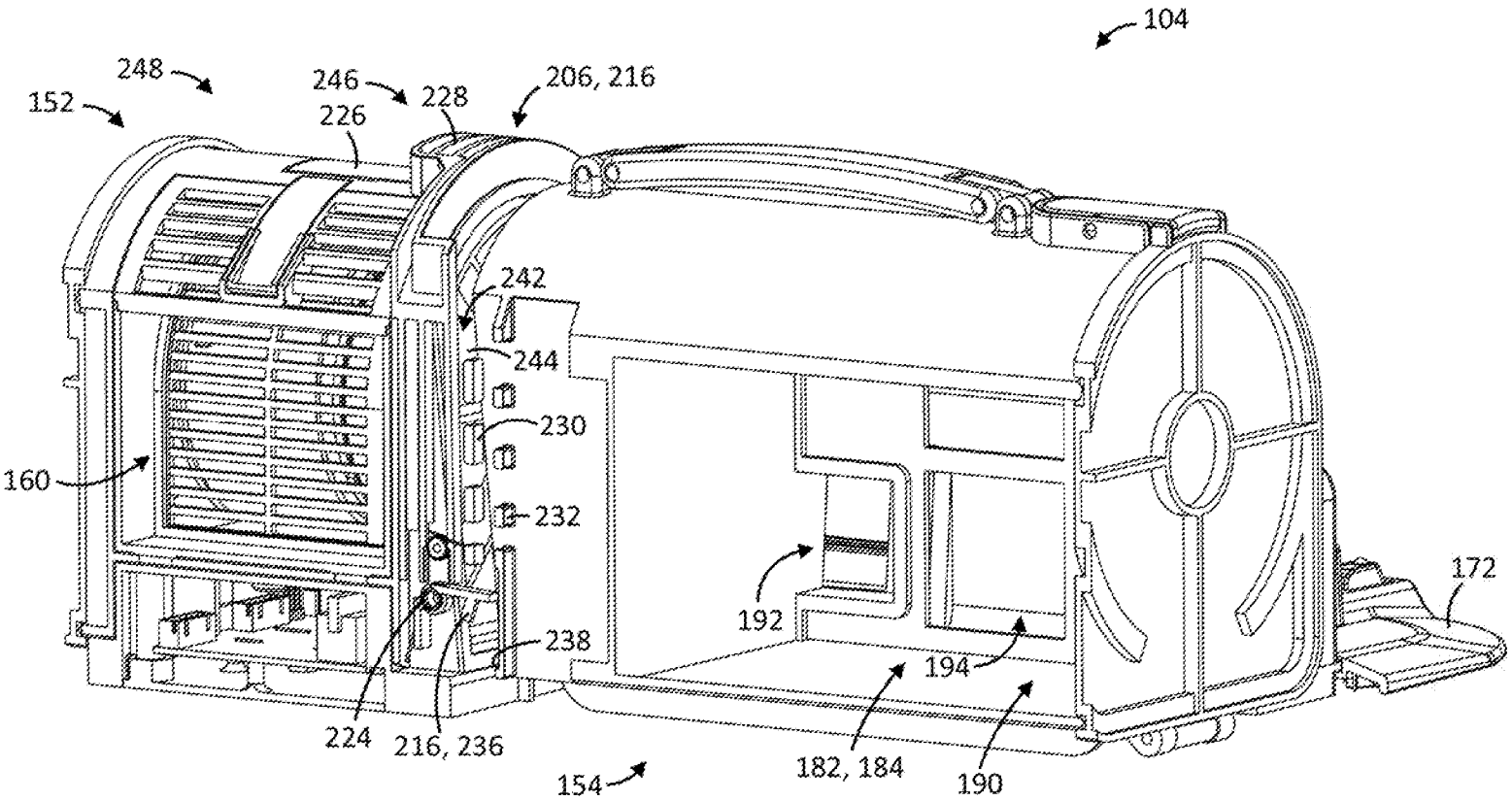
FIG. 19 is a perspective view of the evacuation station of FIG. 17, taken along the section line 6-6', wherein the air treatment member is laterally disengaged from the housing of the evacuation station.
Figure 20:
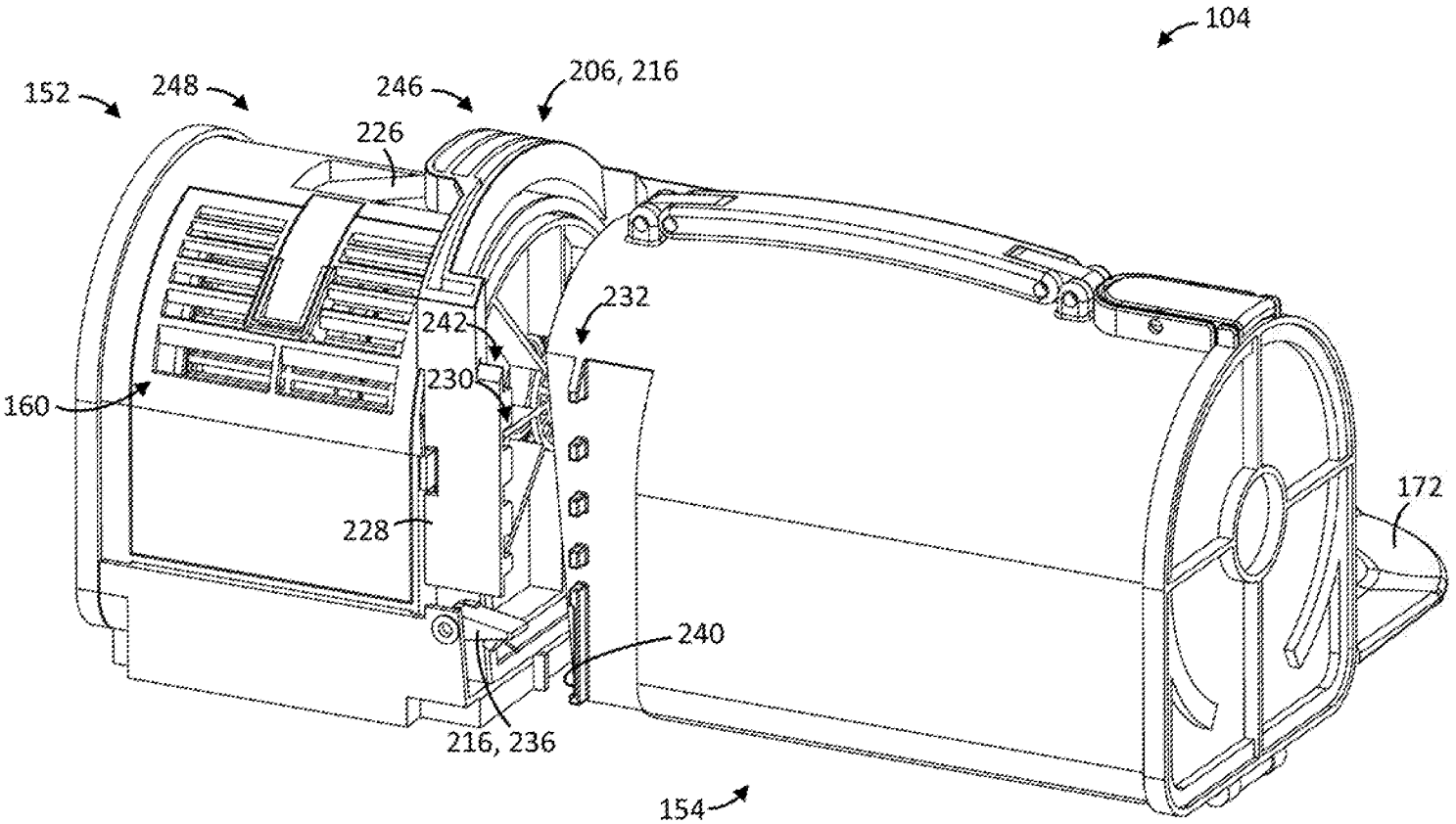
FIG. 20 is a perspective view of the evacuation station of FIG. 17, wherein the air treatment assembly of the evacuation station is laterally removed from the housing of the evacuation station.
Figure 21:
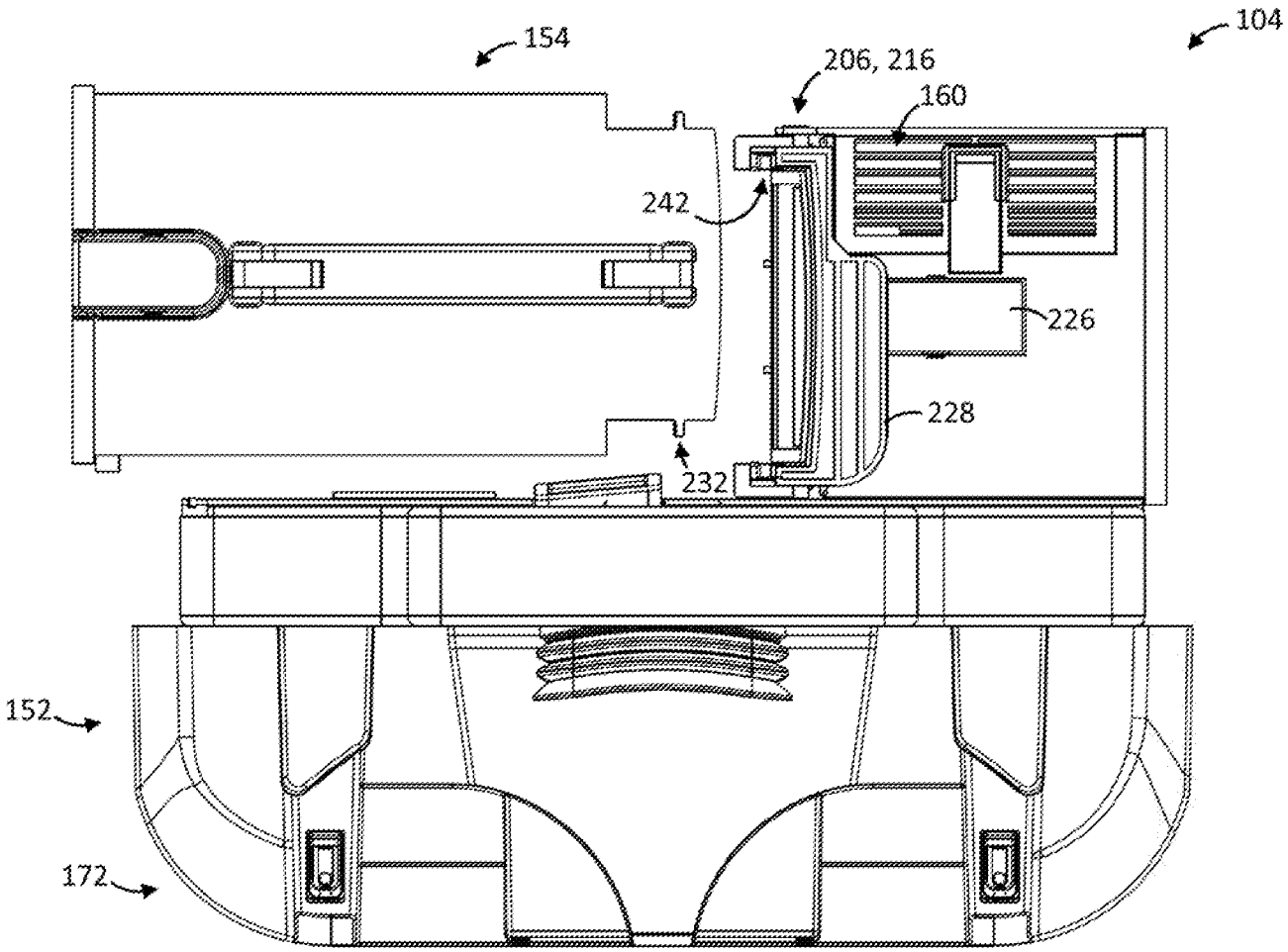
FIG. 21 is a top view of the evacuation station of FIG. 1, wherein the air treatment assembly of the evacuation station is positioned outwardly of a perimeter of the housing of the evacuation station.
Figure 22:
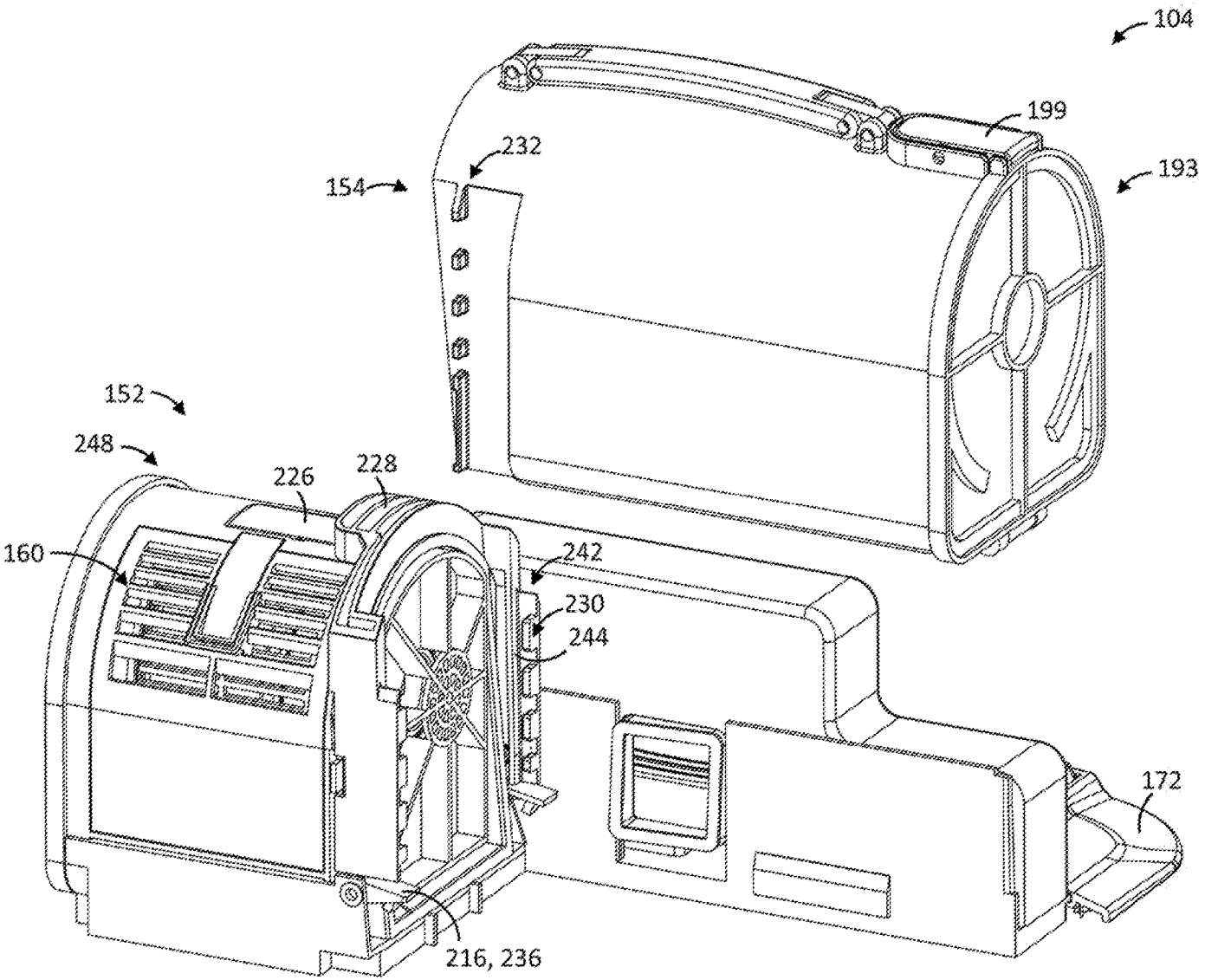
FIG. 22 is a perspective view of the evacuation station of FIG. 17, taken along the section line 6-6', wherein the air treatment assembly of the evacuation station is laterally and vertically removed from the housing of the evacuation station.
Figure 23:
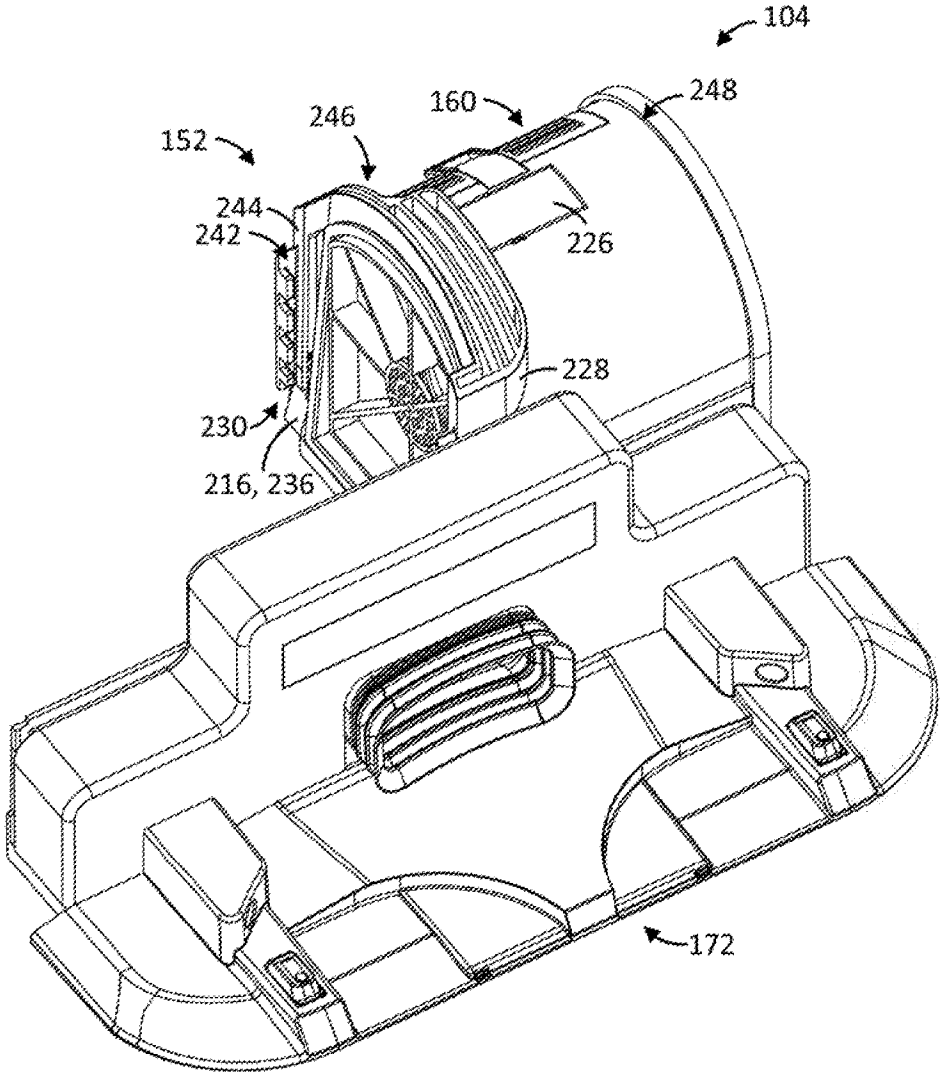
FIG. 23 is a front perspective view from above of the housing of the evacuation station of FIG. 10.
Figure 24:
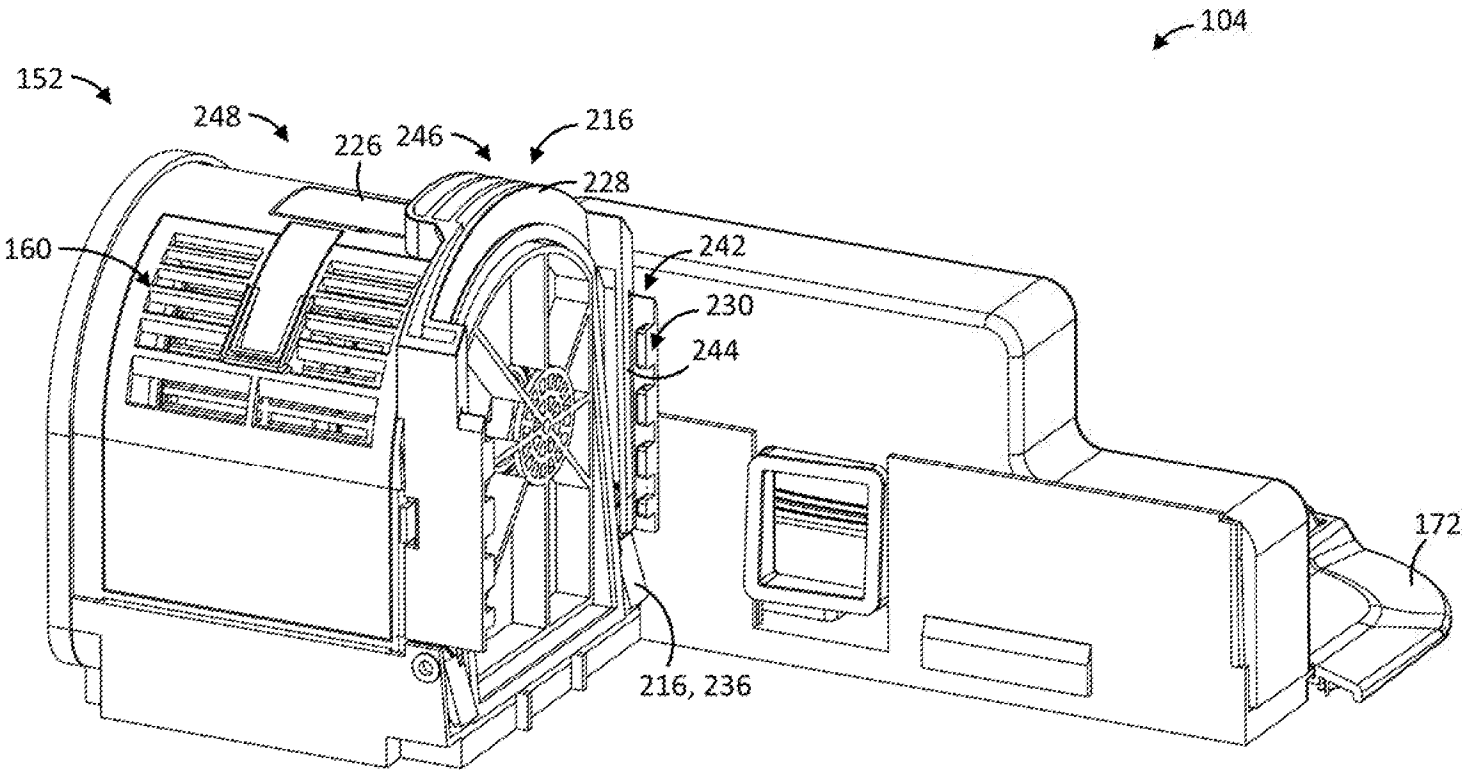
FIG. 24 is a rear perspective view of the housing of the evacuation station of FIG. 10.

Referring now to FIG. 18, in the example illustrated, the locking horseshoe 228 is shown in the unlocked position. As shown, when in the unlocked position, the first set of teeth 230 located on the locking horseshoe 228 are no longer horizontally aligned with the second set of teeth 232 located on the air treatment assembly 154. Accordingly, the air treatment assembly 154 is free to translate in the first lateral direction away from the housing 152. That is, the first set of teeth 230, travel over teeth 232 until they are located laterally from the outer end of the teeth 232. Accordingly, the first set of teeth 230 act as the translation member 206 when the locking horseshoe 228 is in the unlocked position.

As shown, in some examples, when the latch 236 is spring loaded, the latch 236 may push against a wall 240 extending cross-wise to the lateral direction (i.e., transverse to the direction of translation to move the air treatment assembly 154 from the mounted position to the removal position). In some embodiments, the spring loaded latch 236 may have enough stored energy to completely translate the air treatment assembly 154 from the mounted position to the removal position (when the locking horseshoe 228 is in the unlocked position). In other embodiments, a user of the system 100 may be required to grasp the air treatment assembly 154 and translate it in the lateral direction away from the housing 152 to the removal position. Once in the removal position, i.e., when the air treatment assembly 154 is completely exterior to the perimeter 162 of the housing 152, the user of the system 100 can only then translate the air treatment assembly 154 vertically (i.e., lift the air treatment assembly 154 away from the housing 152 to be emptied).

To re-mount the air treatment assembly 154 to the housing 152, in some embodiments, the user of the system 100 may perform the steps described above, but in reverse. That is, the user of the system 100, with the locking horseshoe 228 in the unlocked position may translated the air treatment assembly 154 in the second lateral direction (i.e., towards the housing 152). During translation towards the housing 152, the second set of teeth 232 of the air treatment assembly 154 may pass by the first set of teeth 230 on the locking horseshoe 228. Once the air treatment assembly 154 is positioned in the mounted position, the user may push down on the locking horseshoe 228 lock to lock the air treatment assembly 154 to the housing 152.

In other embodiments, housing 152 may be designed such that the air treatment assembly 154 can be re-mounted by a single, vertical, translation. For example, the locking horseshoe may have a channel 242 defined by the first set of teeth 230, and a back wall 244 of the locking horseshoe 228. The channel 242 may extend substantially vertically, and may be open at an upper end 246 of the locking horseshoe 228/an upper end 248 of the housing 152. Accordingly, with the air treatment assembly 154 located above the housing 152, a user can vertically align the second set of teeth 232 of the air treatment assembly 154 with the channel 242. The user can then translate the air treatment assembly 154 vertically downwards such that the second set of teeth 232 of the air treatment assembly 154 are located within the channel 242 of the locking horseshoe 228. The user may translate the air treatment assembly 154 downwards until the engagement surface 238 of the air treatment assembly 154 passes the latch 236 (the latch 236 may be spring loaded to allow one way translation of the engagement surface 238 past the latch 236).

EXAMPLE 2

Removal of the Air Treatment Assembly from the Housing

As exemplified in FIGS. 28-34, a reconfigurable key may be utilized to secure the air treatment member 154 to the housing 152 and may optionally translate the air treatment member 154 with respect to the housing 152 when the key is reconfigured to a removal configuration to enable the air treatment member 154 to be removed from the housing 152.

In the example illustrated, a male alignment member 208, i.e., a key 212, is located on a lower end 250 of the air treatment assembly 154. Specifically, in the example illustrated, the male alignment member 208 includes two arm members 252 that are biased in a direction crosswise (transverse) to a longitudinal axis 254 of the air treatment assembly 154 (see FIG. 33). Each of the two arm members 252 may be biased by at least one spring (not shown). In some embodiments, there may only be a single arm member.

In the example illustrated, a female alignment member 210 which is configured to receive the key 212, e.g., a slot 214, is located in the housing 152. In the exploded portion of FIG. 29, a portion of the housing 152 is shown transparent to illustrate the key 212 of the air treatment assembly 154 and the slot 214 of the housing 152.

Figure 29:
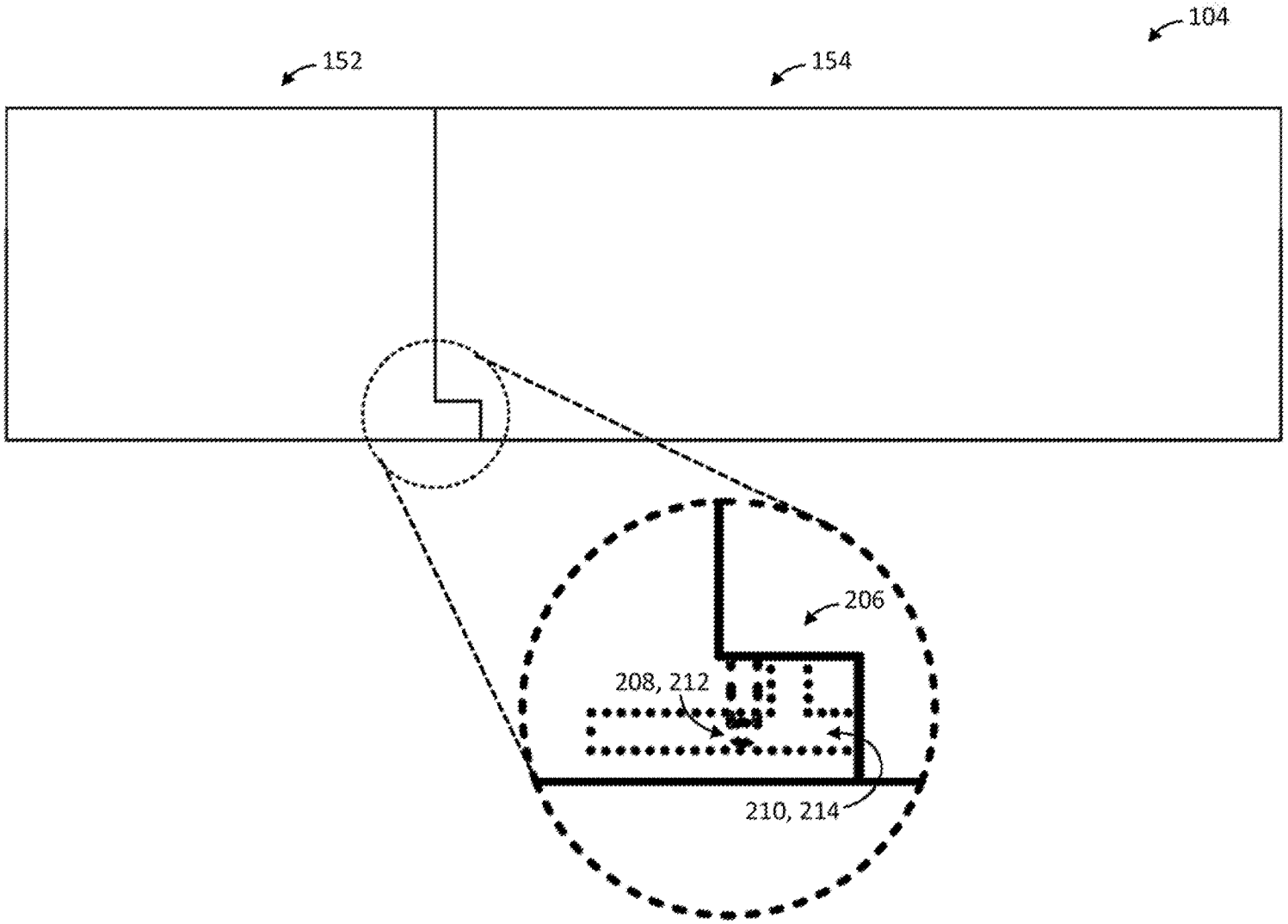
FIG. 29 is a rear view of the evacuation station of FIG. 28, wherein an air treatment assembly of the evacuation station is engaged with the housing of the evacuation station.
Figure 30:
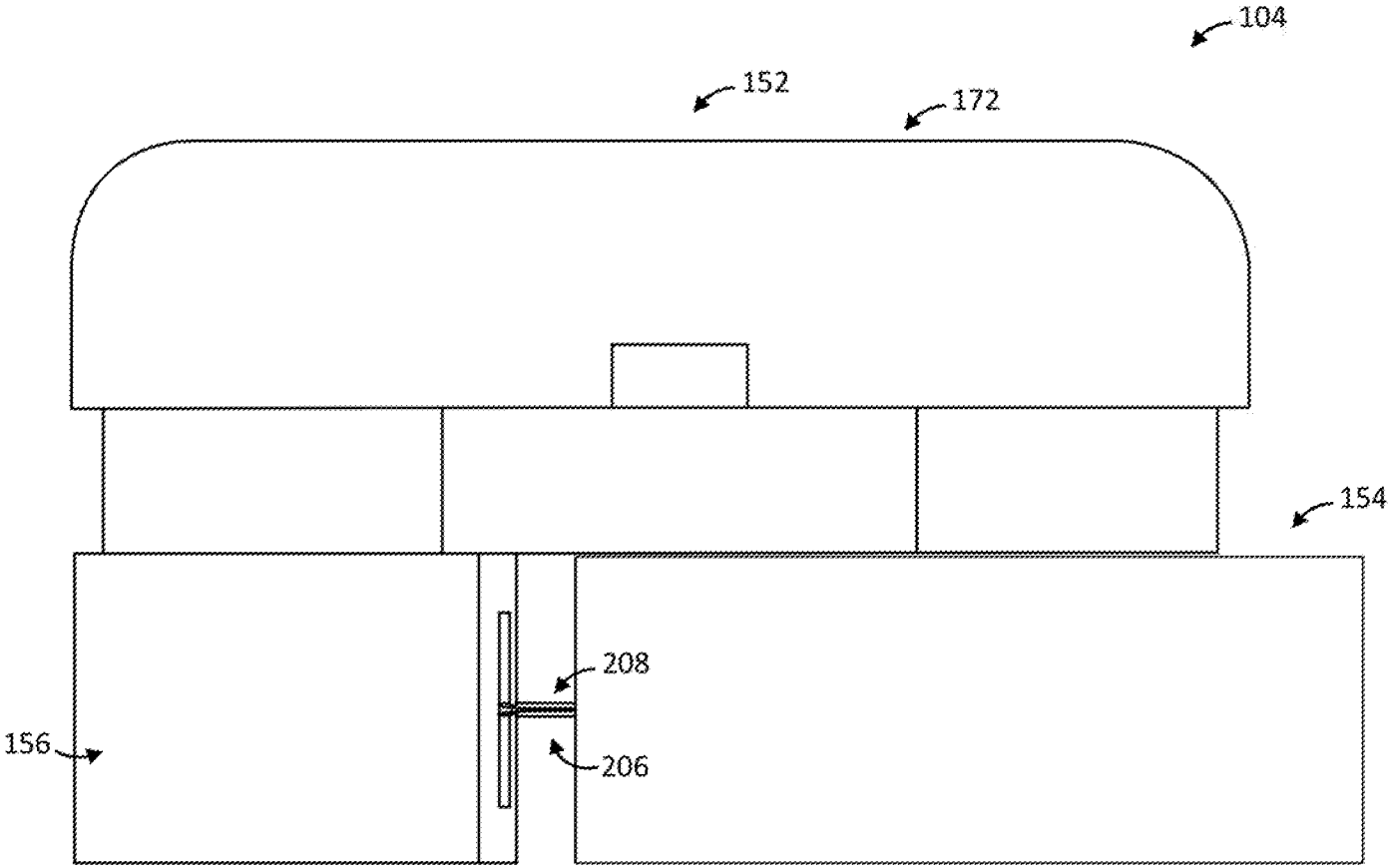
FIG. 30 is a top view of the evacuation station of FIG. 28, wherein the air treatment assembly is partially disengaged from the housing.

Still referring to FIG. 29, in the example illustrated, when in mounted position, the key 212 is located in the slot 214, and the arm members 252 are in their biased position (i.e., are facing in a direction crosswise to the longitudinal axis 254 of the air treatment assembly 154). In this position, the arm members 252 may abut an inner surface 260 of the slot 214, thereby restricting translation of the air treatment assembly 154 away from the housing 152. That is, the arm members 252 may act as a locking assembly 216.

Figure 31:
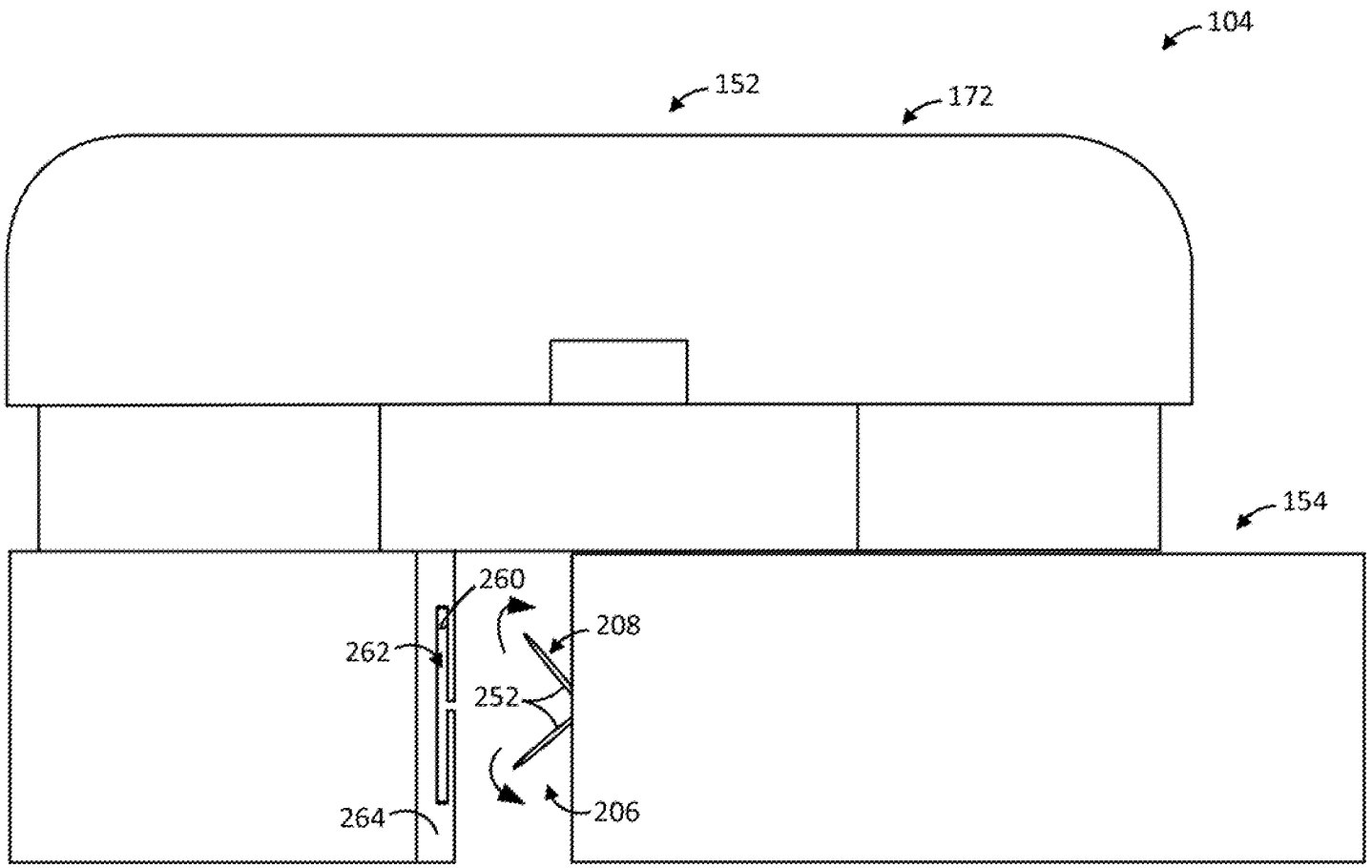
FIG. 31 is a top view of the evacuation station of FIG. 28, wherein the air treatment assembly is disengaged from the housing of the evacuation station.
Figure 32:
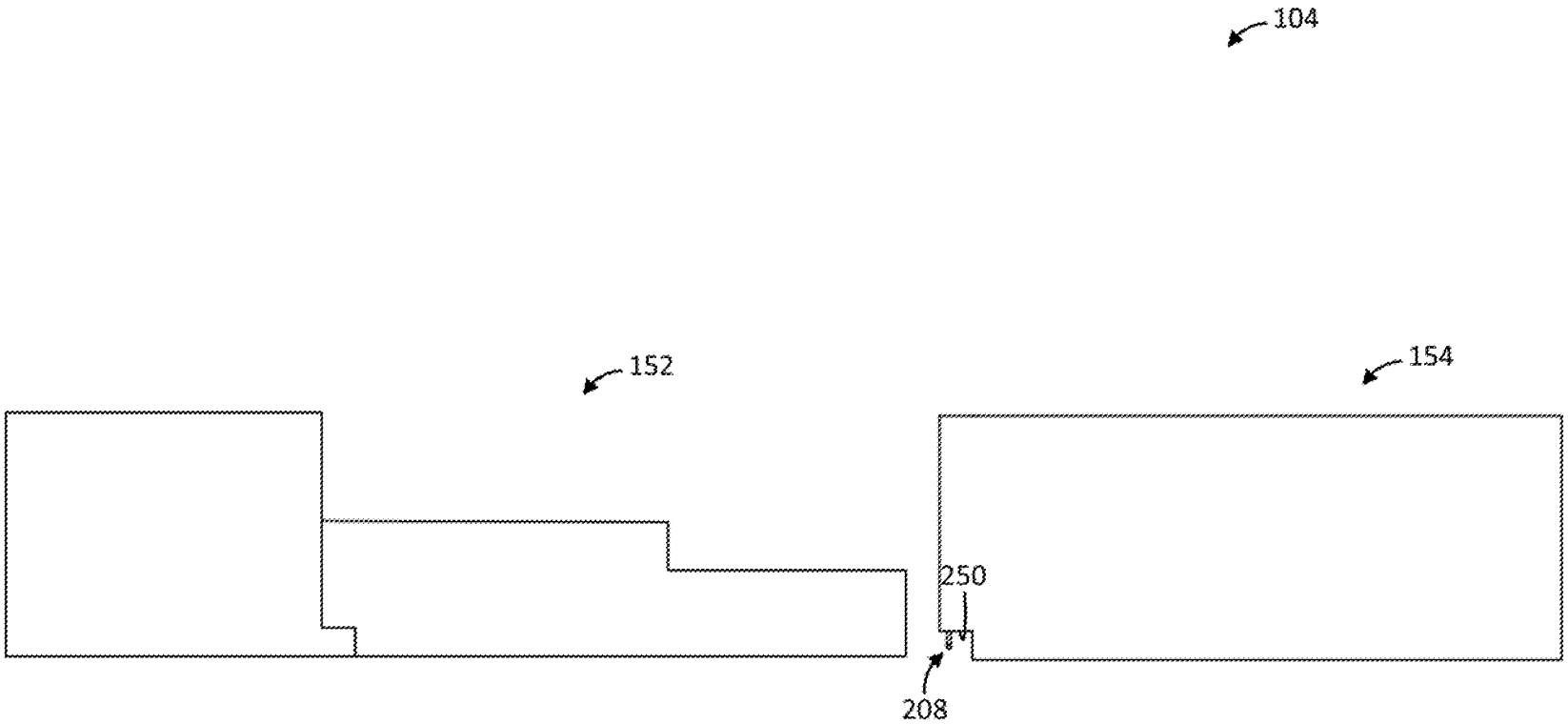
FIG. 32 is a rear view of the evacuation station of FIG. 28, wherein the air treatment assembly is disengaged from the housing of the evacuation station.
Figure 33:
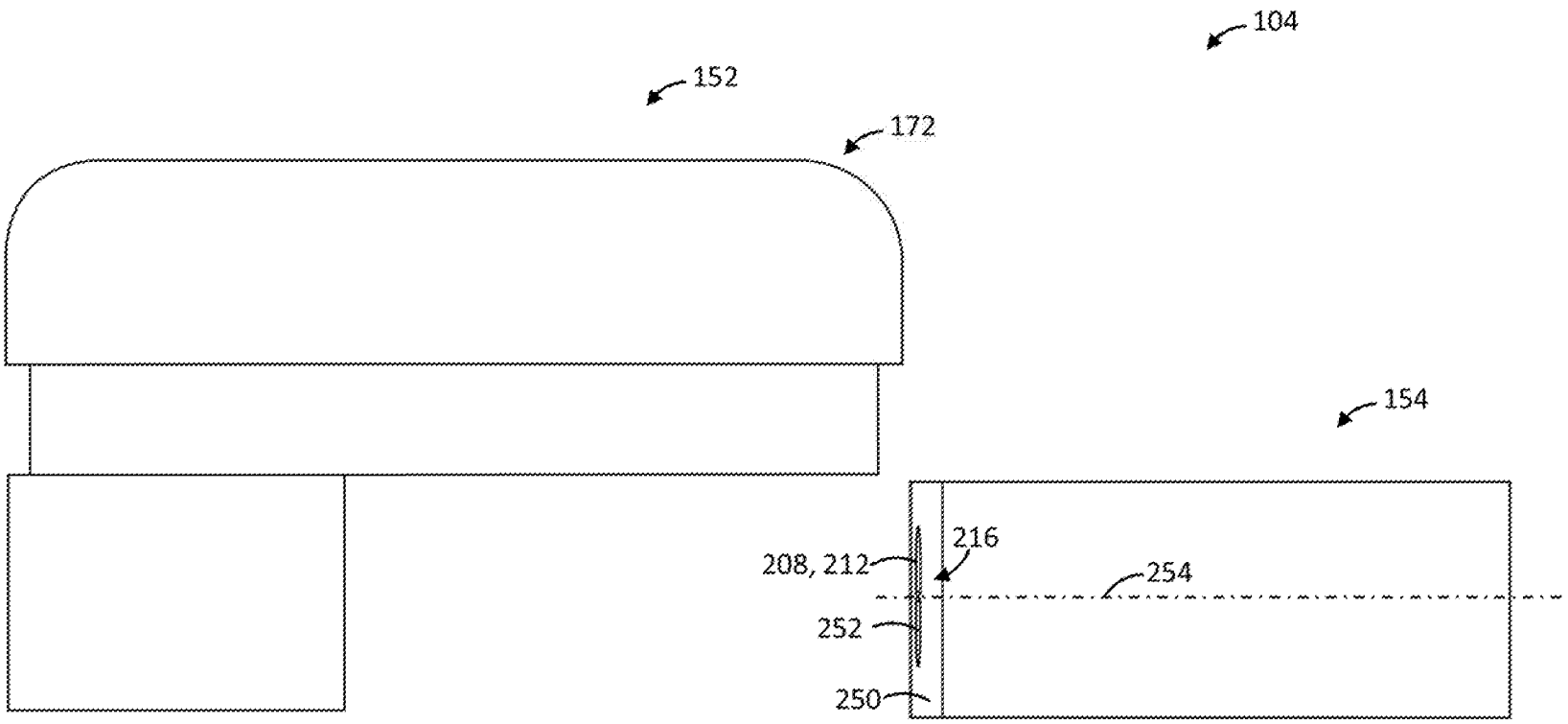
FIG. 33 is a bottom view of the evacuation station of FIG. 28, wherein the air treatment assembly is disengaged from the housing of the evacuation station.
Figure 34:
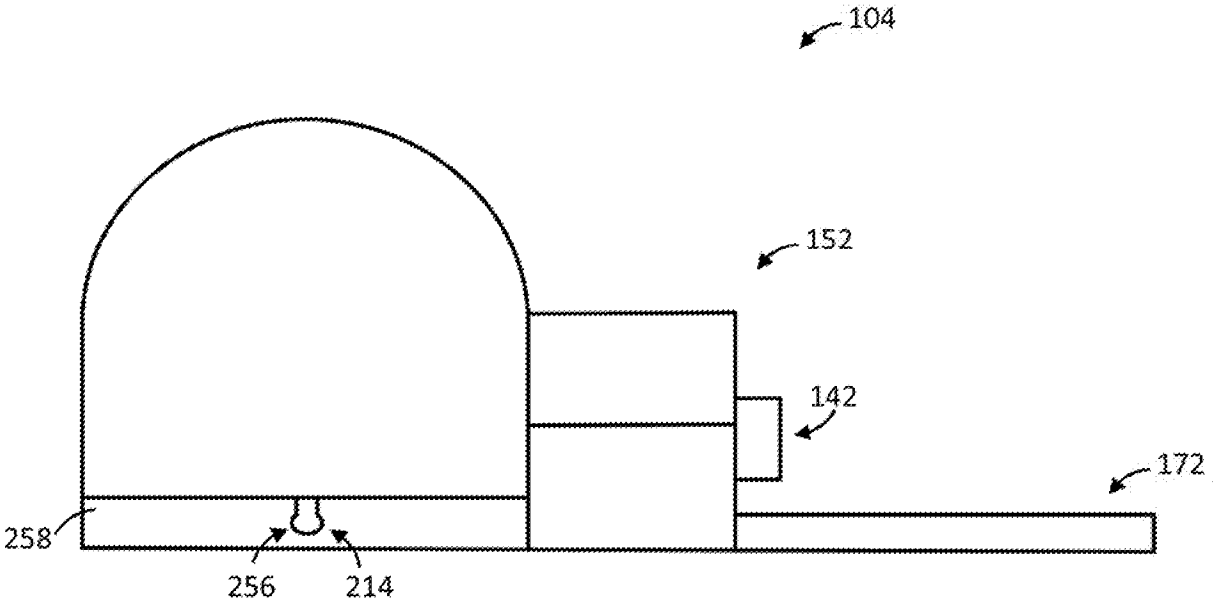
FIG. 34 is a side view of the housing of the evacuation station of FIG. 28, wherein the air treatment assembly is disengaged from the housing of the evacuation station.

Referring now to FIG. 34, in the example illustrated, the slot 214 has an opening 256 to an outer wall 258 of the housing 152. That is, the opening 256 may be centrally located along the inner surface 260 of the slot 214, against which the arm members 252 may abut. Accordingly, referring now to FIG. 30, when a user of the system 100 grasps the air treatment assembly 154, and urges the air treatment assembly 154 away from the housing 152 in the first lateral direction, the arm members 252 may engage with the inner surface 260 of the slot 214 and the opening 256, which may cause the arm members 252 to retract to a position in which the arm members 252 may pass through the opening 256 in the outer wall 258 (i.e., they may rotate to extend axially in the direction of axis 254). Once completely removed from the housing 152, the arm members 252 may snap back to their biased position (as shown in FIGS. 31-33).

To re-mount the air treatment assembly 154, in some embodiments, a user of the system 100 may pinch the arm members 252, such that they are insertable into the opening 256 in the outer wall 258 of the housing 152. The user may then translate the air treatment assembly 154 towards the housing 152, i.e., in the second lateral direction. When the air treatment assembly 154 reaches the mounted position, the arm members 252 are able to snap back to their biased position, locking the air treatment assembly 154 in place.

Alternatively, to re-mount the air treatment assembly 154, in some embodiments, as shown, the housing 152 may include a channel 262 in an upper surface 264 thereof, through which the arm members 252, in their biased positions, may pass. In some embodiments, the channel 262 may include a one-way-flap (not shown), so that the arm members 252 may pass through the channel 262 in a downward direction but not in an upward direction.

EXAMPLE 3

Removal of the Air Treatment Assembly from the Housing

As exemplified in FIGS. 35-39 a key 212 may be utilized to secure the air treatment member 154 to the housing 152 and the slot or cavity 274 in which the key 212 is received may optionally be reconfigurable to translate the air treatment member 154 with respect to the housing 152 when the slot is reconfigured to a removal configuration to enable the air treatment member 154 to be removed from the housing 152.

In the example illustrated, the air treatment assembly 154 includes a male alignment member 208. The male alignment member 208 shown in FIGS. 35-39 is similar to the male alignment member 208 described in reference to FIGS. 28-34. However, in the example illustrated in FIGS. 35-39, arm members 268 of the male alignment member 208 are rigid. Specifically, referring to FIG. 37, the male alignment member 208 includes a post 270 extending downwardly from a lower end 250 of the air treatment assembly 154, and the two arm members 268 each extend from the post 270, crosswise (transverse) to the longitudinal axis 254 of the air treatment assembly 154. It is to be understood, that the male alignment member 208 may only include a single arm member.

Figure 35:
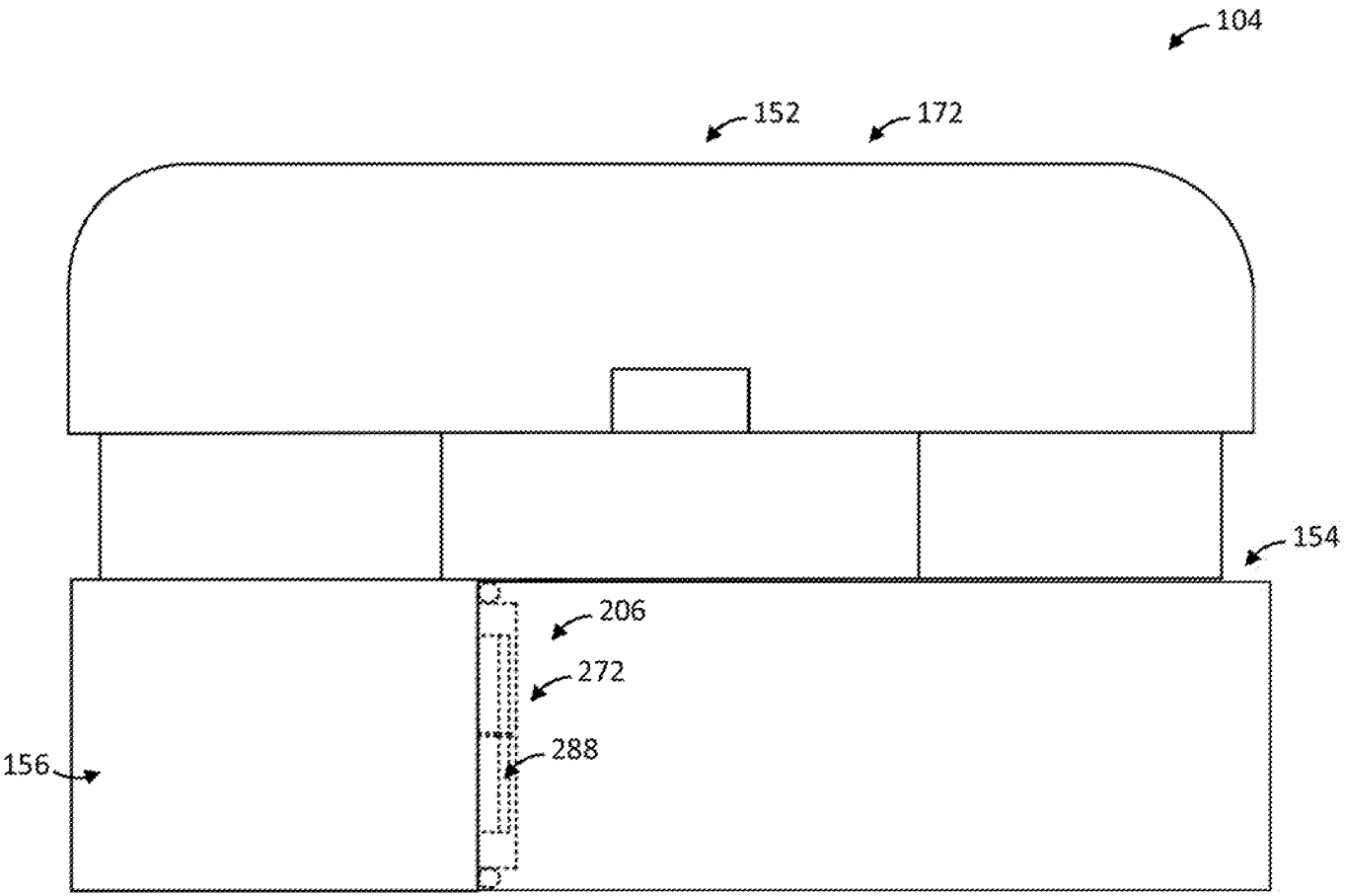
FIG. 35 is a top view of an alternate embodiment of an evacuation station for a mobile floor cleaning robot, wherein an air treatment assembly of the evacuation station is shown engaged to a housing of the evacuation station and a portion of the air treatment assembly is shown transparent.
Figure 36:
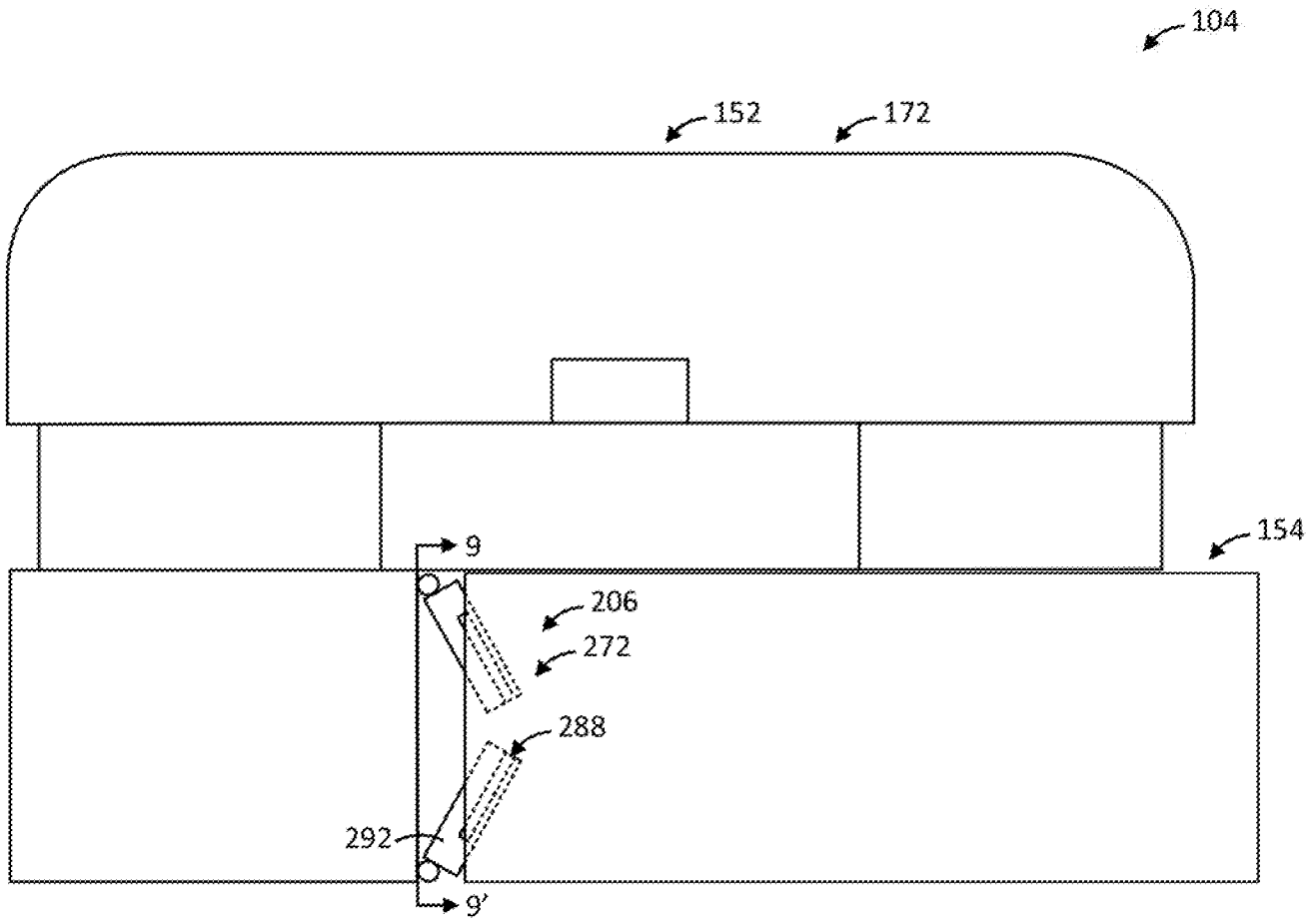
FIG. 36 is a top view of the evacuation station of FIG. 35, wherein the air treatment assembly is shown partially disengaged from the housing and a portion of the air treatment assembly is shown transparent.

Referring to FIGS. 35 and 36, in the example illustrated, a female alignment member 210 is located on the housing 152. In the example illustrated, the female alignment member 210 includes a pair of doors 272. Each door 272 may be movable from a closed position (see FIG. 35) to an open or removal position (see FIG. 38).

Figure 37:
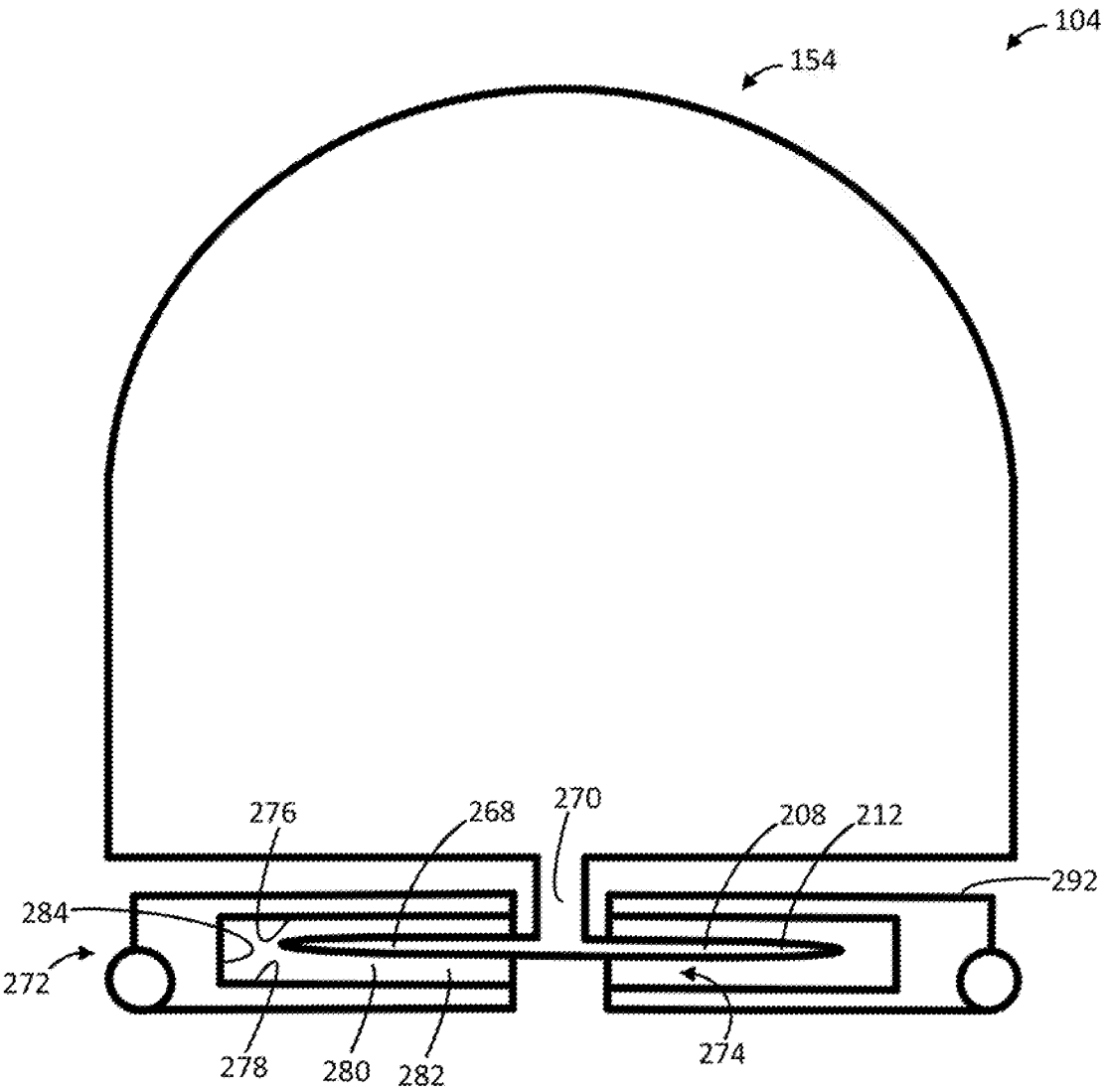
FIG. 37 is a cross-sectional view of the evacuation station of FIG. 35, taken along the section line 9-9' in FIG. 36.

Referring now to FIG. 37, the doors 272 are shown in transition from the closed position to the open position (see also FIG. 36). As shown in FIG. 37, each door 272 has a cavity 274 therein. Each cavity 274 of each door 272 may be defined by a top wall 276, a bottom wall 278, and a sidewall 280 extending about the cavity 274 between the top wall 276 and the sidewall 280. In the example illustrated, a first portion of the sidewall 280 defines a front wall 282 of the cavity 274, a second portion of the sidewall 280 defines an outer wall 284 of the cavity 274, and a third portion of the sidewall 280 defines a back wall of the cavity 274 (the back wall is shown to be transparent in FIG. 37 to better illustrate the cavity 274). As shown, the sidewall 280 does not extend about the entire cavity 274. Accordingly, there is an opening 290 at an inner region of each door 272. The openings 290 allow for the arm members 268 to extend into the cavities 274 (as shown in FIG. 37). The cavities 274 may therefore be a substantially enclosed space.

When in the mounted position and during transition, the arm members 268 may be located within the cavities 274. Accordingly, due to the enclosed nature of the cavities 274, the cavities 274 may restrict translation of the arm members 268, i.e., the air treatment assembly 154, in at least the vertical direction, when the doors 272 are in the closed and transition positions.

In some embodiments, each door 272 may include a locking assembly 216 that restricts opening of the doors 272 (not shown). Unlocking the doors 272 may allow the doors 272 to swing from the closed position (see FIG. 35) to the open position (see FIG. 38). To unlock the doors 272, a user of the system 100 may, for example, push on a button which releases hinges of the doors 272, allowing them to swing open (not shown).

When the air treatment assembly 154 is the mounted position, the arm members 268 of the air treatment assembly 154 may be located within the cavity 274 of the housing 152. To remove the air treatment assembly 154, a user of the system 100 may grasp and translate the air treatment assembly 154 in the first lateral direction away from the housing 152. The force applied by a user to the air treatment assembly 154 may cause the arm members 268 to abut the front wall 282 of the cavities 274. If enough force is applied, the doors 272 may begin to swing open. In some examples, the lock may need be activated to unlock the doors 272, prior to translating the air treatment assembly 154 away from the housing.

Figure 38:
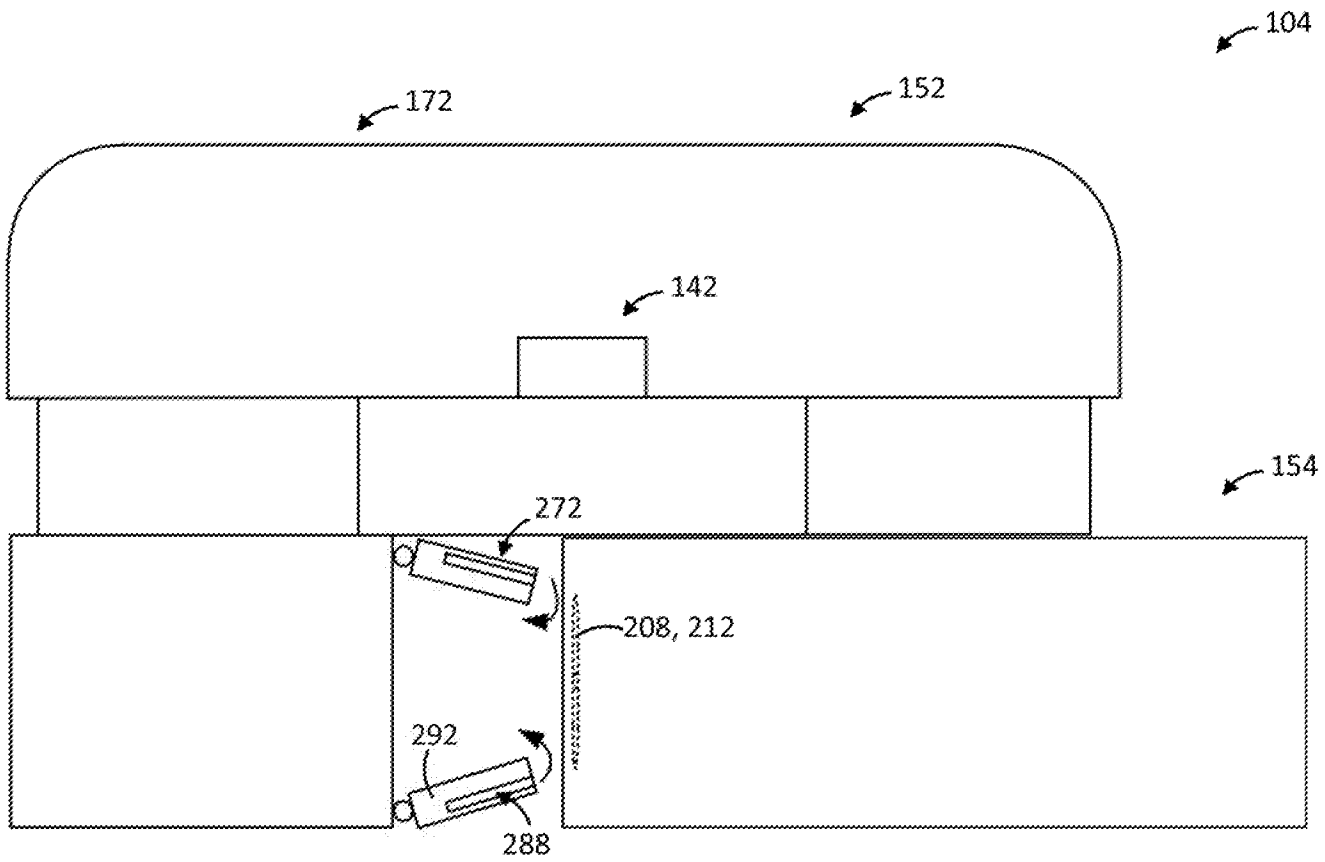
FIG. 38 is a top view of the evacuation station of FIG. 35, wherein the air treatment assembly is shown disengaged from the housing and a portion of the air treatment assembly is shown transparent; and, FIG. 39 is a top view of the housing of the evacuation station of FIG. 35.
Figure 39:
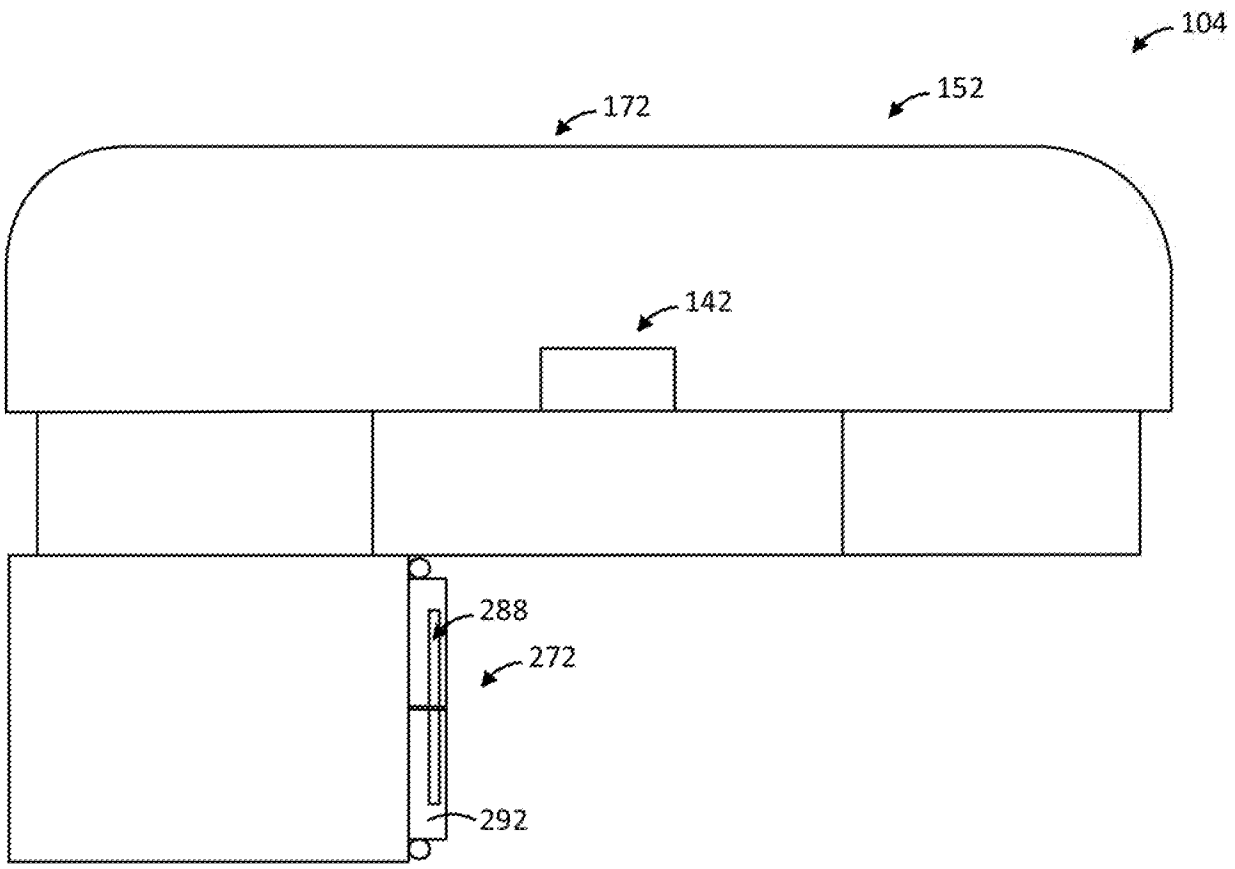

The air treatment assembly 154 may be translated until each door 272 is in the open position. At this point, the air treatment assembly 154 may be completely outside the perimeter 162 of the housing 152 (as shown in FIG. 38). A user of the system 100 may only then translate the air treatment assembly 154 vertically.

In another embodiment, the evacuation station 104 may include a biasing mechanism (not shown), that, when activated, may apply the required force to translate the air treatment assembly 154 from the mounted position to the removal position. The biasing device may be, for example, a spring. That is, when a user of the system 100 wants to empty the air treatment assembly 154, they may push a button which releases the spring. The spring may push against the air treatment assembly 154 in the first lateral direction such that arm members 268 engage the front walls 282 of the cavities 274, causing the doors 272 to open. In some embodiments, the spring might have enough force to completely translate the air treatment assembly 154 from the mounted position to the removal position. Alternatively, a piston cylinder mechanism (not shown) may be used to urge the air treatment assembly 154 from the mounted position to the removal position.

To re-mount the air treatment assembly 154 to the housing 152, in some embodiments, the user of the system 100 may perform the steps described above, but in reverse. That is, the user of the system 100, with the doors 272 in the open position, may grasp the air treatment assembly 154 and translate it in the second lateral direction towards the housing 152. When doing so, the arm members 268 will enter the cavities 274, and abut the back wall of the cavities 274. Accordingly, as the air treatment assembly 154 is translated towards the housing 152 to the mounted position, the doors 272 will move from their opened position to their closed position.

In some examples, as shown in FIG. 35, there may be a channel 288 in an upper surface 292 of each door 272 that extends to each cavity 274. Accordingly, with the air treatment assembly 154 located above the doors 272 in the closed position, a user can vertically align the arm members 268 with the channel 288 and can then translate the air treatment assembly 154 vertically downwards such that the arm members 268 pass through the channel 288 and into the cavities 274. In some embodiments, the channel 288 may include a one-way-flap (not shown), so that the arm members 268 may pass through the channel 288 in a downward direction but not in an upward direction.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. An evacuation station for a surface cleaning apparatus, the evacuation station comprising:

(a) an air flow path extending from an evacuation station air inlet to an evacuation station air outlet;

(b) a housing having a perimeter extending around the housing, the perimeter defining an outline of the housing when viewed looking down from above the housing; and, (c) an air treatment assembly comprising an air treatment member, wherein the air treatment assembly is removably mountable to the housing, the air treatment assembly is moveable from an in use position in which the air treatment assembly is mounted to the housing and a removal position in which all of the air treatment assembly is positioned outwardly of the perimeter, wherein the housing has a front surface cleaning apparatus docking side, a rear side and two laterally opposed ends and the air treatment assembly translates laterally to the removal position, and wherein the air treatment assembly is moveable to a position above the housing only after the air treatment assembly has been moved laterally to the removal position.

2. The evacuation station of claim 1 wherein the evacuation station air inlet is provided in the housing and the evacuation station air inlet is in fluid communication with an outlet port of the surface cleaning apparatus when the surface cleaning apparatus is docked with the evacuation station.

3. The evacuation station of claim 2 wherein the evacuation station further comprises a suction motor and the suction motor and the evacuation station air outlet are each provided in the housing.

4. The evacuation station of claim 1 wherein the air treatment member comprises a momentum air separator and a filter media downstream thereof, the momentum air separator comprises a chamber having an air inlet wherein at least one wall of the chamber comprises a screen forming an air outlet of the chamber.

5. The evacuation station of claim 4 wherein the filter media is housed in the removable air treatment assembly.

6. The evacuation station of claim 1 further comprising a translation member which is operable to translate the air treatment assembly to the removal position.

7. The evacuation station of claim 6 further comprising a locking assembly which locks the air treatment assembly in the in use position and the locking assembly comprises the translation member.

8. The evacuation station of claim 7 wherein the locking assembly comprises male and female alignment members.

9. The evacuation station of claim 8 wherein the male alignment member comprises a key and the female alignment member comprises a slot that removably receives the key.

10. The evacuation station of claim 1 further comprising male and female alignment members.

11. The evacuation station of claim 10 wherein the male alignment member comprises a key and the female alignment member comprises a slot that removably receives the key.

12. The evacuation station of claim 1 further comprising a handle moveable between a storage position and a removal position wherein, in the storage position, the handle extends generally laterally and, in the removal position, the handle extends generally vertically.

13. An evacuation station for a surface cleaning apparatus comprising, the evacuation station comprising:

(a) an air flow path extending from an evacuation station air inlet to an evacuation station air outlet;

(b) a housing having a perimeter extending around the housing, the perimeter defining an outline of the housing when viewed looking down from above the housing; and, (c) an air treatment assembly comprising an air treatment member, wherein the air treatment assembly is moveable from an in use position in which the air treatment assembly is mounted to the housing and a removal position in which all of the air treatment assembly is positioned outwardly of the perimeter, wherein the air treatment assembly is moveable to a position above the housing only after the air treatment assembly has been moved in a generally horizontal direction to the removal position, and wherein, in the removal position, the air treatment assembly does not overlie any portion of the housing.

14. The evacuation station of claim 1 wherein, in the removal position, the air treatment assembly does not overlie any portion of the housing.

15. The evacuation station of claim 1 wherein, the air treatment assembly has an air inlet, an openable door which is moveable between an open position and a closed position and a lock securing the door in the closed position, the air inlet is provided on one end of the air treatment assembly and the lock is provided on an opposed end of the air treatment assembly.

16. The evacuation station of claim 1 wherein the evacuation station further comprises a suction motor, a projection of the evacuation station air inlet intersects the air treatment assembly and the suction motor is positioned to one lateral side of the evacuation station air inlet.

17. The evacuation station of claim 1 wherein the evacuation station further comprises a suction motor, the air treatment assembly further comprises an openable door, and a plane intersects the evacuation station air inlet the suction motor and the openable door.

18. The evacuation station of claim 13 wherein, the air treatment assembly has an air inlet, an openable door which is moveable between an open position and a closed position and a lock securing the door in the closed position, the air inlet is provided on one end of the air treatment assembly and the lock is provided on an opposed end of the air treatment assembly.

19. The evacuation station of claim 13 wherein the evacuation station further comprises a suction motor, a projection of the evacuation station air inlet intersects the air treatment assembly and the suction motor is positioned to one lateral side of the evacuation station air inlet.

20. The evacuation station of claim 13 wherein the evacuation station further comprises a suction motor, the air treatment assembly further comprises an openable door, and a plane intersects the evacuation station air inlet the suction motor and the openable door.

* * * * *